US008291799B2

(12) United States Patent
Graushar et al.

(10) Patent No.: US 8,291,799 B2
(45) Date of Patent: Oct. 23, 2012

(54) ADJUSTABLE TRIMMING ASSEMBLY

(75) Inventors: William T. Graushar, Elm Grove, WI (US); John C. Geres, West Allis, WI (US); Patrick A. Millikin, Richfield, WI (US); David F. Christofferson, Sussex, WI (US); Michael J. Krchma, Mequon, WI (US); Greg Goss, Menomonee Falls, WI (US); Charles E. Schulz, Hartford, WI (US); Robert Kazmierczak, Waukesha, WI (US); Richard W. Schneider, Campbellsport, WI (US); Jonathan F. Thames, West Bend, WI (US)

(73) Assignee: Quad/Graphics, Inc., Sussex, WI (US)

( * ) Notice: Subject to any disclaimer, the term of this patent is extended or adjusted under 35 U.S.C. 154(b) by 108 days.

(21) Appl. No.: 12/163,664

(22) Filed: Jun. 27, 2008

(65) Prior Publication Data

US 2009/0000440 A1 Jan. 1, 2009

Related U.S. Application Data

(60) Provisional application No. 60/947,160, filed on Jun. 29, 2007.

(51) Int. Cl.
*B26D 7/01* (2006.01)

(52) U.S. Cl. ..... 83/247; 83/268; 83/934

(58) Field of Classification Search ..... 83/934, 83/368, 371, 247, 268, 269; 412/16
See application file for complete search history.

(56) References Cited

U.S. PATENT DOCUMENTS

| | | | | |
|---|---|---|---|---|
| 3,332,675 | A | 7/1967 | Bandura et al. | |
| 3,656,380 | A | 4/1972 | Creffield | |
| 3,722,336 | A | 3/1973 | Sarring | |
| 3,811,350 | A | 5/1974 | Marciniak | |
| 3,902,646 | A | 9/1975 | Kuhns | |
| 3,910,142 | A | 10/1975 | Jureit et al. | |
| 3,981,212 | A * | 9/1976 | McCain et al. | 83/155 |
| 4,089,244 | A | 5/1978 | Herb et al. | |
| 4,385,480 | A | 5/1983 | Burchette, Jr. | |
| 4,505,173 | A | 3/1985 | Hartlage | |
| 4,721,058 | A * | 1/1988 | Hayamizu et al. | 118/665 |
| 4,901,992 | A | 2/1990 | Dobeck | |
| 4,922,773 | A | 5/1990 | Ito | |
| 5,100,270 | A | 3/1992 | Dowdle et al. | |
| 5,199,341 | A | 4/1993 | Jones | |
| 5,377,569 | A | 1/1995 | Richards et al. | |
| 5,445,592 | A | 8/1995 | Richards | |
| 5,461,469 | A | 10/1995 | Farrell et al. | |
| 5,467,677 | A * | 11/1995 | Kinson, Jr. | 83/155 |
| 5,660,515 | A | 8/1997 | Hartsoe | |

(Continued)

OTHER PUBLICATIONS

Müller Martini, SigmaLine Digital Book Production brochure, May 2008, 18 pages.

(Continued)

*Primary Examiner* — Kenneth E. Peterson
(74) *Attorney, Agent, or Firm* — Michael Best & Friedrich LLP

(57) ABSTRACT

A method of trimming printed media comprises selecting printed media to be positioned on a conveyor based on predetermined delivery sequence data, positioning the printed media on the conveyor, receiving size data representative of at least one dimension of the printed media to be trimmed, and electronically controlling a trimmer based on the received size data to adjust a location at which the printed media is to be trimmed.

10 Claims, 32 Drawing Sheets

U.S. PATENT DOCUMENTS

| | | | | |
|---|---|---|---|---|
| 5,678,812 | A | 10/1997 | Hartsoe | |
| 5,685,533 | A | 11/1997 | Hartsoe | |
| 5,820,325 | A | 10/1998 | Hartsoe | |
| 5,823,934 | A | 10/1998 | Ferrone | |
| 5,868,071 | A | 2/1999 | Niemiro et al. | |
| 6,012,367 | A | 1/2000 | Westra et al. | |
| 6,193,458 | B1 * | 2/2001 | Marsh | 412/1 |
| 6,216,574 | B1 | 4/2001 | Hain | |
| 6,363,823 | B1 | 4/2002 | Myers et al. | |
| 6,443,682 | B2 | 9/2002 | Marsh | |
| 6,536,319 | B1 * | 3/2003 | Boss | 83/247 |
| 6,692,424 | B2 | 2/2004 | Pasman et al. | |
| 6,698,159 | B2 | 3/2004 | Harris et al. | |
| 6,708,967 | B1 | 3/2004 | Trovinger et al. | |
| 6,731,393 | B1 | 5/2004 | Currans et al. | |
| 6,739,228 | B1 | 5/2004 | Magnuson | |
| 6,796,209 | B2 | 9/2004 | Boss | |
| 6,810,784 | B1 | 11/2004 | Cunningham | |
| 6,910,686 | B2 | 6/2005 | Awano | |
| 6,966,552 | B2 | 11/2005 | Trovinger et al. | |
| 6,991,224 | B2 | 1/2006 | Trovinger et al. | |
| 7,021,185 | B2 | 4/2006 | Cote et al. | |
| 7,077,042 | B2 * | 7/2006 | Nogawa et al. | 83/466 |
| 7,104,537 | B2 | 9/2006 | Trovinger et al. | |
| 7,182,009 | B2 | 2/2007 | Harris et al. | |
| 7,207,249 | B1 | 4/2007 | Smith | |
| 7,213,493 | B2 | 5/2007 | Cote et al. | |
| 7,328,893 | B2 | 2/2008 | Kawatsu et al. | |
| 7,354,233 | B2 | 4/2008 | Oki et al. | |
| 7,384,039 | B2 | 6/2008 | Cote et al. | |
| 7,431,277 | B2 | 10/2008 | Silberbauer | |
| 7,448,305 | B2 | 11/2008 | Kurtz | |
| 7,478,988 | B2 | 1/2009 | Porat | |
| 7,533,596 | B2 | 5/2009 | Rathert | |
| 7,975,583 | B2 * | 7/2011 | Schmid | 83/241 |
| 2001/0023630 | A1 | 9/2001 | Nakajima et al. | |
| 2003/0024424 | A1 | 2/2003 | Pasman et al. | |
| 2003/0079584 | A1 | 5/2003 | Cote et al. | |
| 2003/0145703 | A1 * | 8/2003 | Rohe-Krebeck | 83/277 |
| 2004/0175255 | A1 | 9/2004 | Trovinger et al. | |
| 2004/0182211 | A1 * | 9/2004 | Maddalon | 83/74 |
| 2005/0016345 | A1 | 1/2005 | Lorenzi | |
| 2005/0044476 | A1 | 2/2005 | Bursten | |
| 2005/0061133 | A1 | 3/2005 | Marbacher | |
| 2005/0105988 | A9 | 5/2005 | Trovinger et al. | |
| 2007/0050081 | A1 * | 3/2007 | Brown et al. | 700/219 |
| 2007/0125211 | A1 | 6/2007 | Hilgendorf | |
| 2007/0144321 | A1 | 6/2007 | Cote et al. | |
| 2007/0209492 | A1 | 9/2007 | Schmid | |
| 2008/0310935 | A1 | 12/2008 | Hommochi et al. | |
| 2009/0165616 | A1 | 7/2009 | Rathert | |

OTHER PUBLICATIONS

Muller Martini Corp., "SigmaLine—The advanced solution for digital book manufacturing" press release, Apr. 3, 2008, 4 pages.

R. R. Donnelley and Sons Co., "RR Donnelley Announces Revolutionary New Variable Trim Binding (VTB) Technology to Maximize Postal Savings" News Release, May 5, 2008, 2 pages.

* cited by examiner

ADJUSTABLE TRIMMING ASSEMBLY

RELATED APPLICATIONS

This application claims priority to U.S. Provisional Patent Application Ser. No. 60/947,160 filed on Jun. 29, 2007, the entire content of which is incorporated herein by reference.

BACKGROUND

Conventional trimmers may be configured to perform one or more trimming operations on bound books or magazines during a production run. For example, a trimmer may be configured to trim a margin from the edge of the magazine opposite the spine (i.e., perform a "face trim"), while a three-knife trimmer may be configured to perform both a face trim and one or more side trims on the magazine, whereby respective margins are trimmed from the top and bottom edges (i.e., the "head trim" and "foot trim," respectively) of the magazine. During set-up for a production run using a conventional trimmer or a three-knife trimmer, the respective blades that perform the face trim, the head trim, and the foot trim on the magazines are manually adjusted to the desired size specifications of a particular production run of magazines. As a result, only a single size of magazines may be achieved during any particular uninterrupted production run utilizing the conventional trimmer or three-knife trimmer.

SUMMARY

One exemplary embodiment provides a method of trimming printed media, comprising selecting printed media to be positioned on a conveyor based on predetermined delivery sequence data, positioning the printed media on the conveyor, receiving size data representative of at least one dimension of the printed media to be trimmed, and electronically controlling a trimmer based on the received size data to adjust a location at which the printed media is to be trimmed.

Another exemplary embodiment provides an adjustable trimming assembly configured to receive printed media along a path. The printed media comprises a first dimension, a first edge parallel to the direction the first dimension, and a second dimension substantially perpendicular to the first dimension. The adjustable trimming assembly comprises a stop configured to position the first edge of the printed media at a location along the path, a trimming device adapted to trim a margin from the second dimension of the printed media, an actuator coupled to one of the stop and the trimming device to adjust a distance between the stop and the trimming device in a direction substantially parallel with the path, and a controller operably coupled to the actuator for controlling adjustment of the distance between the stop and the trimming device.

Another exemplary embodiment provides an adjustable trimming assembly configured to receive printed media along a path in a downstream direction. The printed media comprises a first dimension oriented perpendicular to the path and a second dimension substantially perpendicular to the first dimension. The adjustable trimming assembly comprises a trimming device adapted to trim a margin from the second dimension of the printed media, a conveyor adapted to receive printed media along the path, the conveyor being positioned adjacent the trimming device, an actuator coupled to the conveyor, and a controller operably coupled to the actuator to adjust the distance traveled by the printed media along the path before the margin is trimmed from the second dimension of the printed media.

Another exemplary embodiment provides an adjustable trimming assembly comprising a conveyor adapted to transport printed media comprising a first dimension and a second dimension substantially perpendicular to the first dimension, the printed media lying flat along a path defined by the conveyor. The adjustable trimming assembly comprises a trimming device adapted to trim a margin from the first dimension of the printed media, an actuator coupled to the trimming device to adjust the trimming device along the first dimension of the printed media, and a controller operably coupled to the actuator for controlling adjustment of the trimming device.

Another exemplary embodiment provides a method of trimming printed media having a first dimension, a first edge parallel to the direction of the first dimension, and a second dimension substantially perpendicular to the first dimension. The method comprises conveying printed media along a path, positioning the first edge of a first piece of printed media adjacent a stop, trimming a first margin from the second dimension of the first piece of printed media with a trimming device, adjusting at least one of the stop and the trimming device in a direction substantially parallel with the path to change the spacing between the stop and the trimming device, positioning the first edge of a second piece of printed media adjacent the stop after adjustment, and trimming a second margin from the second dimension of the second piece of printed media with the trimming device after adjustment.

Another exemplary embodiment provides a method of trimming printed media having a first dimension, a first edge parallel to the direction of the first dimension, and a second dimension substantially perpendicular to the first dimension. The method comprises conveying printed media, lying flat, along a path, positioning a first edge of the first piece of printed media along the path a first distance from a trimming device, trimming a first margin from the second dimension of the first piece of printed media with the trimming device, positioning the first edge of a second piece of printed media along the path a second distance from the trimming device, and trimming a second margin from the second dimension of the second piece of printed media with the trimming device after the first edge of the second piece of printed media is positioned the second distance from the trimming device. Optionally, the method further comprises detecting the first piece of printed media, and detecting the second piece of printed media after the first piece of printed media is trimmed. Optionally, the method further comprises positioning the first and second pieces of printed material relative to the trimming device according to predetermined delivery sequence data. Optionally, the method further comprises receiving printed media from a binding line, which does not stop during the trimming operation, while the printed media is being trimmed. Optionally, the method further comprises receiving untrimmed printed media from a binding line at an operational speed of at least about 150 pieces of printed media per minute.

Another exemplary embodiment provides a method of trimming printed media comprising a first dimension and a second dimension substantially perpendicular to the first dimension. The method comprises providing untrimmed printed media to a trimmer at an operational speed of at least about 150 pieces of printed media per minute, trimming a first margin from the second dimension from a first piece of printed media, trimming a second margin from the second dimension from a second piece of printed media, and adjusting the trimmer, while operating at the operational speed, between trimming the first and second pieces of printed media to provide a trimmed length, along the second dimension, of the second piece of printed media different than the trimmed length, along the second dimension, of the first piece of printed media.

Another exemplary embodiment provides a method of trimming printed media comprising detecting information representative of finished trim size from a piece of printed media, transferring the finished trim size information to a trimmer, and trimming the piece of printed media according to the finished trim size information. Optionally, the method may comprise detecting the information by a sensor that detects the size of the untrimmed printed media. Optionally, the method may comprise detecting the information by sensing a machine-readable indicia on the printed media.

Another exemplary embodiment provides a system for variable trimming printed media comprising a conveyor adapted to transport printed media along a path. The printed media comprises a first dimension and a second dimension substantially perpendicular to the first dimension. The system also comprises a stop against which the printed media abuts, a trimming device adapted to trim a margin from the second dimension of the printed media, an actuator coupled to one of the stop and the trimming device to adjust a distance between the stop and the trimming device in a direction substantially parallel with the path, a controller operably coupled to the actuator for controlling adjustment of the distance between the stop and the trimming device, and a saddle stitching line providing printed media to the conveyor.

Another exemplary embodiment provides a system for variable trimming printed media comprising an adjustable trimming assembly configured to receive printed media along a path. The printed media comprises a first dimension oriented perpendicular to the path and a second dimension substantially perpendicular to the first dimension. The adjustable trimming assembly comprises a trimming device adapted to trim a margin from the second dimension of the printed media, a conveyor adapted to receive printed media along the path, the conveyor being positioned adjacent the trimming device, an actuator coupled to the conveyor, a controller operably coupled to the actuator to adjust the distance traveled by the printed media along the path before the margin is trimmed from the second dimension of the printed media, and a saddle stitching line providing printed media to the adjustable trimming assembly.

Other features and aspects of the exemplary embodiments will become apparent by consideration of the following detailed description and accompanying drawings.

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1A:
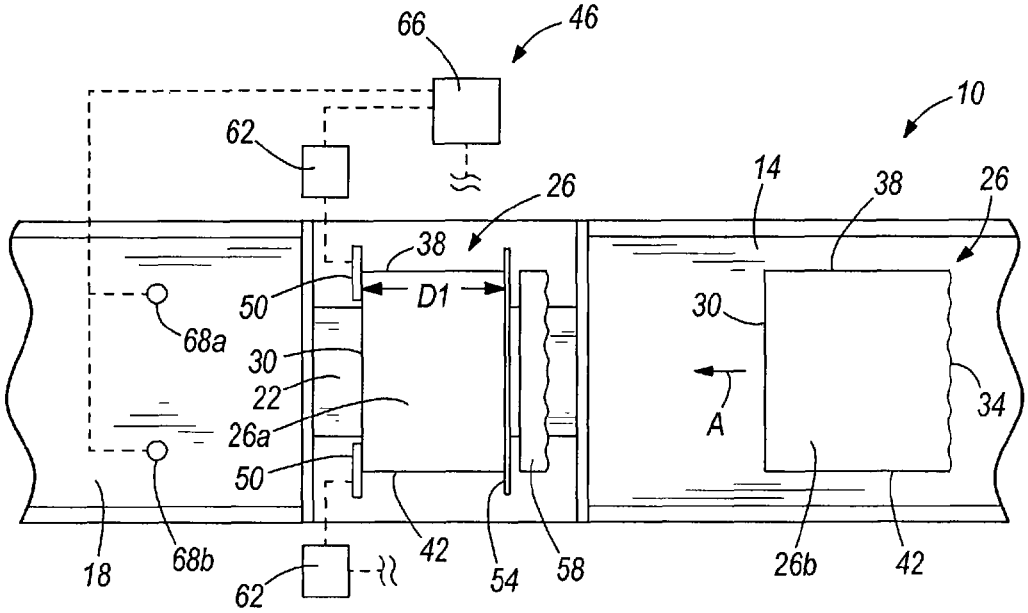
FIG. 1*a* is schematic top view of a portion of a trimmer incorporating a first construction of an adjustable trimming assembly, according to an exemplary embodiment.
Figure 1B:
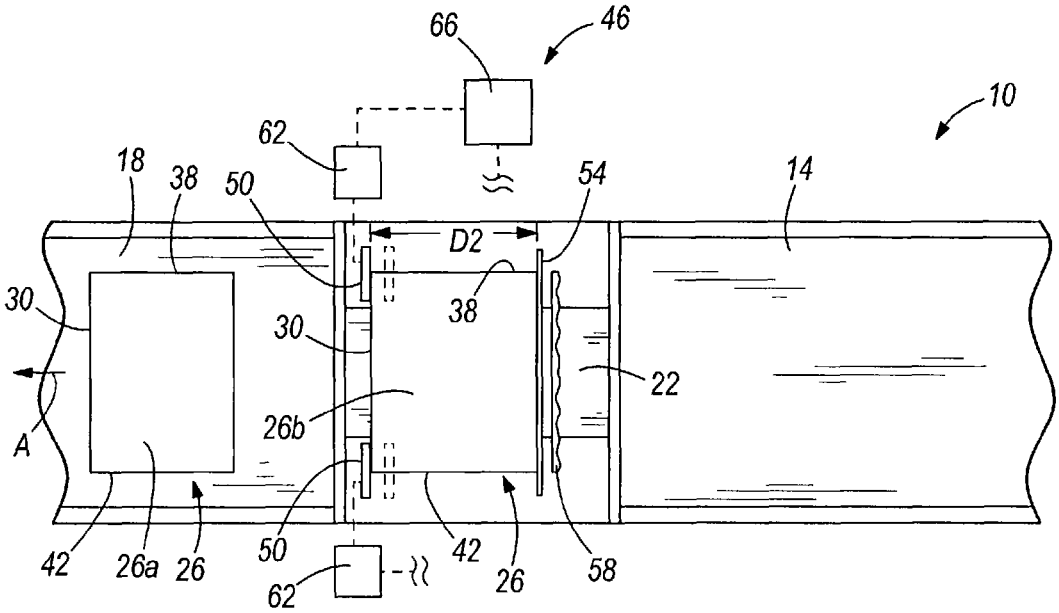
FIG. 1*b* is a schematic top view of a portion of the trimmer and adjustable trimming assembly of FIG. 1*a*, showing an alternate configuration of the adjustable trimming assembly, according to an exemplary embodiment.

FIGS. 1*a* and 1*b* schematically illustrate a portion of a trimmer 10 comprising an input conveyor 14, and output conveyor 18, and an intermediate conveyor 22, the combination of which defines a path (indicated by arrow A) along which printed media 26 is conveyed. The printed media or printed products 26 illustrated herein are generally rectangularly-shaped, defining a major dimension or a first dimension along the length or height of the printed products 26, and a minor dimension or a second dimension, substantially transverse to the direction of the major dimension, along the width of the printed products 26. Also, as shown in FIGS. 1*a* and 1*b*, the printed products 26 may be oriented on the conveyors 14, 18, 22 such that they are lying flat and the minor dimension of the printed products 26 is substantially parallel with the direction of the path as indicated by arrow A. In this orientation, each of the printed products 26 includes a leading edge 30 and a trailing edge 34, relative to the direction of motion of the conveyors 14, 18, 22 as indicated by arrow A, each of which is substantially parallel with the direction of the major dimension. Also, in this orientation, each of the printed products 26 includes a top edge 38 and a bottom edge 42, each of which is substantially parallel with the direction of the minor dimension. It should be noted, however, that the major dimension of a printed product need not coincide with the leading edge of the printed product, as it is conveyed along the path. Rather, the leading edge of a printed product may coincide with the minor dimension of the product.

When the printed products 26 are assembled by conventional binding processes (e.g., saddle-stitch or perfect-binding processes), the leading edge 30 of the printed products 26 is often referred to as the spine of the assembled product 26. It should be noted that the various embodiments may be used in conjunction with saddle stitch, perfect binding, and other binding methods. Printed media or printed products 26, as used herein, may comprise a signature, an envelope, a single sheet, a bound book such as a magazine, a catalog, a book, a direct mail piece, and the like, newspapers, labels, flyers, brochures, directories, advertisements, or any other printed media. In alternative embodiments, the teachings herein may be applied to other products which are not printed media.

With continued reference to FIGS. 1*a* and 1*b*, the trimmer 10 also incorporates an adjustable trimming assembly 46 comprising a pair of stops 50 against which the leading edges 30 of the respective printed products 26 abut, and a sizing or trimming device (e.g., a blade 54) oriented to trim the product. Trimming performed in this manner can be referred to as "face-trims" on the printed products 26. As shown in FIGS. 1*a* and 1*b*, a face-trim on a printed product 26 yields a margin 58 trimmed from the minor dimension of the printed product 26. The face-trim may also trim a margin from the major dimension of a printed product, when the leading edge of the product coincides with the minor dimension of the product. In either case, the trimmed margin 58 includes the trailing edge 34 of the untrimmed product 26. In other embodiments, the sizing or trimming device may be configured as any device that can be used to change the size of a material through mechanical, fluid, light, energy, or other available technologies or combinations thereof. Other sizing or trimming devices may include, for example, a laser, an air jet, a water jet, a gas jet, etc.)

Although schematically illustrated herein, the structure of the stops 50 and the blade 54 may be similar to that found in a conventional trimmer. Also, it should be noted that the schematic illustration of the input conveyor 14, output conveyor 18, and intermediate conveyor 22 in FIGS. 1*a* and 1*b* may differ from the actual structure utilized in conventional trimmers. In other words, the actual structure utilized to convey an untrimmed printed product 26 to a location in which the leading edge 30 or spine of the printed product 26 abuts the stops 50, and the actual structure utilized to convey the trimmed printed product 26 away from the location in which it was trimmed, may differ from what is schematically shown in FIGS. 1*a* and 1*b*.

The adjustable trimming assembly 46 can further comprise, in one embodiment, an actuator 62 coupled to each of the respective stops 50 to adjust the distance between the stops 50 and the blade 54, and a motion controller 66 operably coupled to the actuators 62 to control the adjustment of the distance between the stops 50 and the blade 54, or "controllably adjust," or "selectively control" the distance between the stops 50 and the blade 54. As shown in FIG. 1*b*, the controller 66 is operable to automatically adjust the distance between the stops 50 and the blade 54 in a direction substantially parallel with the path indicated by arrow A, or in a direction substantially parallel with the direction of the minor dimension of the printed product 26, to yield a custom-trimmed printed product 26. Although two actuators 62, associated with respective stops 50, are shown in the schematic illustration of FIGS. 1*a* and 1*b*, it should be noted that a single actuator 62, through any of a number of different linkages or motion-transmitting structures, may be utilized to move or adjust both of the stops 50 at the same time. It should also be noted that in other embodiments only a single stop 50 may be used or there may be used a plurality of stops 50.

Controller 66 may comprise analog and/or digital electrical components, comprising one or more microprocessors, microcontrollers, application-specific integrated circuits, input/output circuitry, signal processing circuits and software, user interface circuitry for receiving inputs from a user and providing outputs to a user (e.g., audible and/or visual), etc. Controller 66 is configured to operate according to software or an algorithm programmed on a computer-readable medium configured to carry out one or more of the functions described herein.

Figure 36:
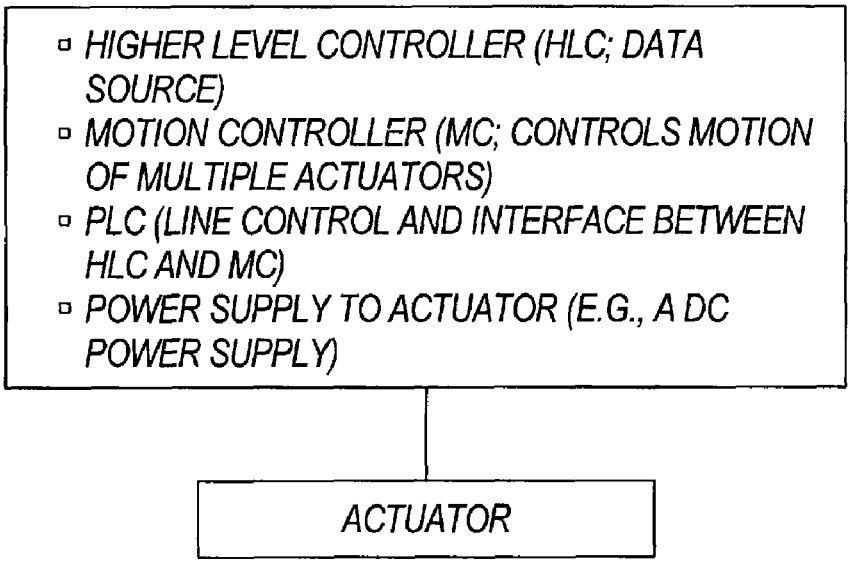
FIG. 36 is a block diagram illustrating the electronic components incorporated with any of the adjustable trimming assemblies of FIGS. 1*a*-3*d* and 12-27 arranged in a centralized control system.
Figure 37:
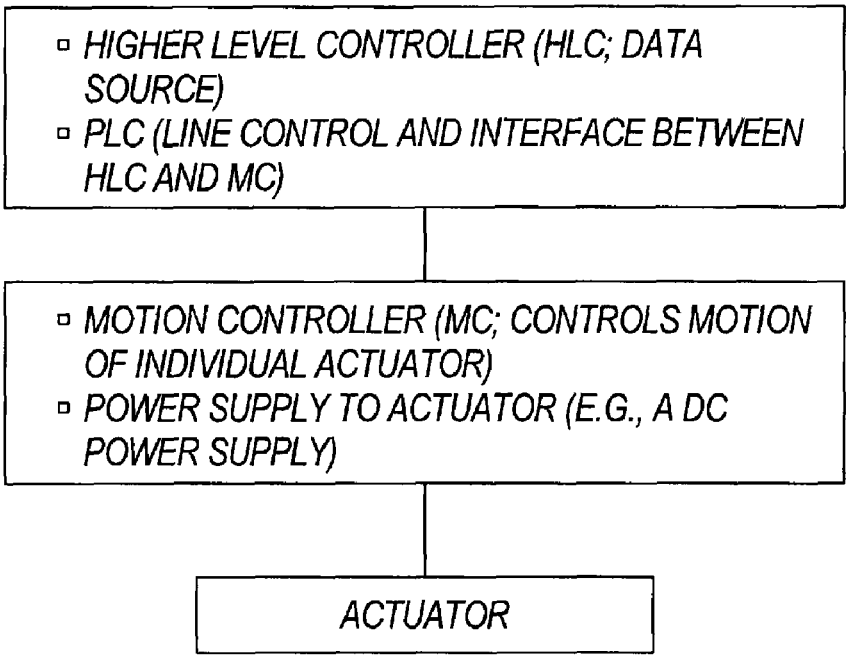
FIG. 37 is a block diagram illustrating the electronic components incorporated with any of the adjustable trimming assemblies of FIGS. 1*a*-3*d* and 12-27 arranged in a distributed control system.
Figure 38:
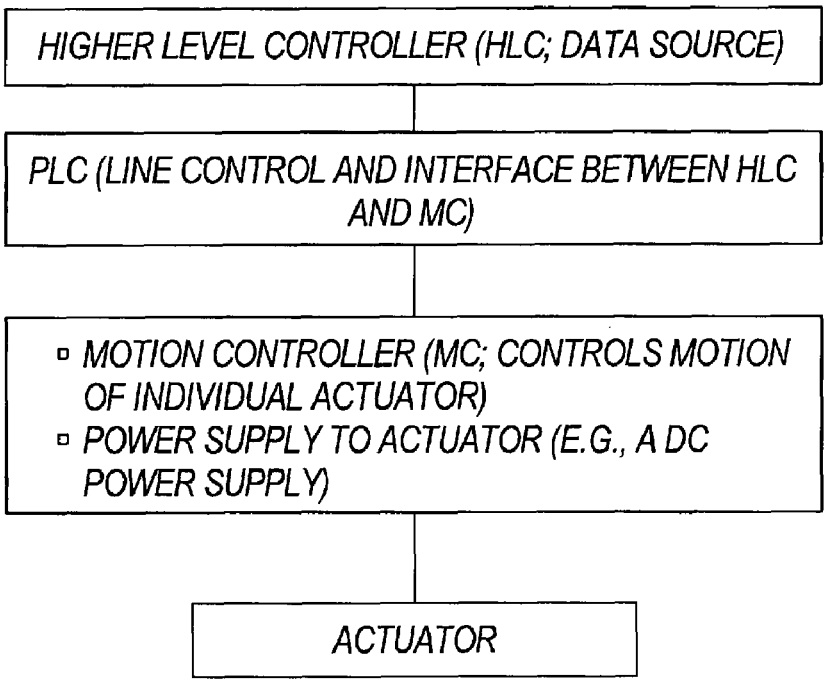
FIG. 38 is a block diagram illustrating an alternative arrangement of a control system including the electronic components incorporated with any of the adjustable trimming assemblies of FIGS. 1*a*-3*d* and 12-27.
Figure 39:
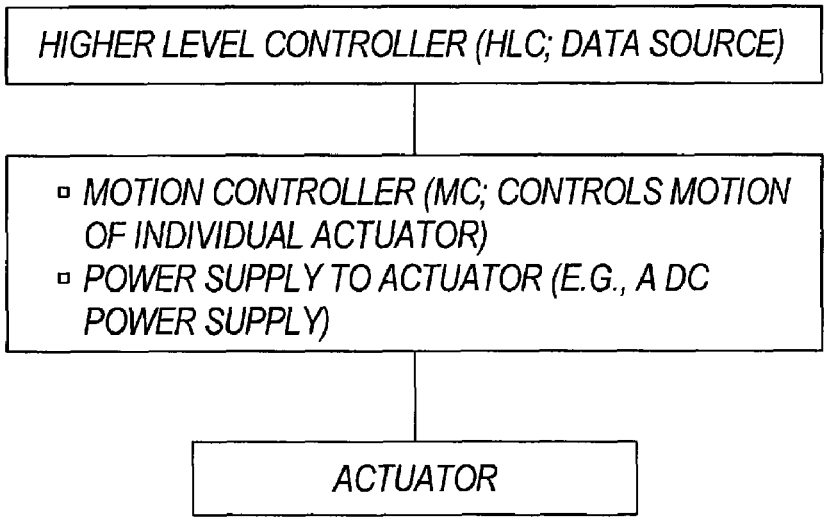
FIG. 39 is a block diagram illustrating another alternative arrangement of a control system including the electronic components incorporated with any of the adjustable trimming assemblies of FIGS. 1*a*-3*d* and 12-27.
Figure 40:
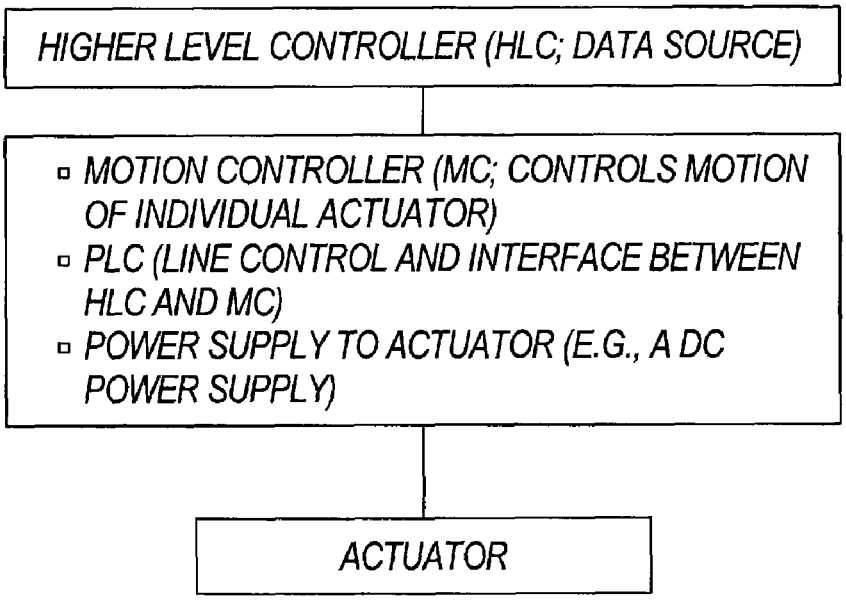
FIG. 40 is a block diagram illustrating yet another alternative arrangement of a control system including the electronic components incorporated with any of the adjustable trimming assemblies of FIGS. 1*a*-3*d* and 12-27.
Figure 41:
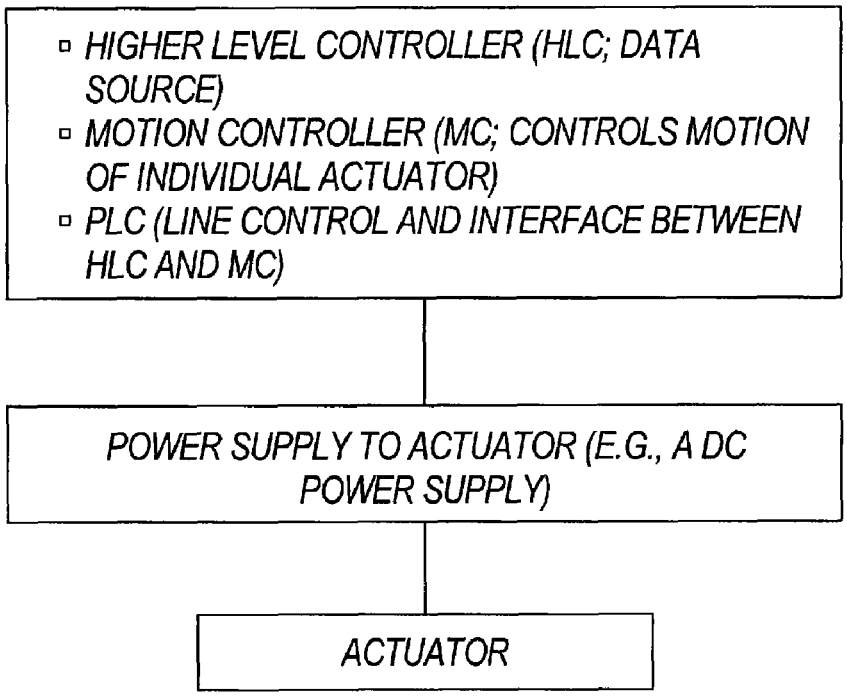
FIG. 41 is a block diagram illustrating another alternative arrangement of a control system including the electronic components incorporated with any of the adjustable trimming assemblies of FIGS. 1*a*-3*d* and 12-27.

The adjustable trimming assembly 46 may be configured to interface with a higher level controller 67 (see FIGS. 28-30) that is programmed with the particular size specifications (i.e., the "custom trim sizes") of each untrimmed printed product 26 in a particular production or binding run. With reference to FIG. 36, the combination of the higher level controller 67, the motion controller 66, an optional PLC or line controller interfacing the controllers 66, 67, and a power supply (e.g., a DC power supply) may be considered a "centralized" control system that interfaces with one or more actuators of the adjustable trimming assembly 46 (e.g., the actuator 62). Alternatively, as shown in FIG. 37, multiple motion controllers (e.g., controller 66, only one of which is shown), each with a dedicated power supply, may be arranged in a "distributive" control system, in which each of the motion controllers 66 interface with the higher level controller 67 (and optional PLC), and in which each of the motion controllers 66 interfaces with an individual actuator in the adjustable trimming assembly 46 (e.g., the actuator 62). The higher level controller may receive trim size information for each printed product 26 from a source such as a data source, database, manual entry, sensors (e.g., photoeyes or other electronic eyes), etc. FIGS. 38-41 illustrate alternative arrangements of the control system including the higher level controller, the motion controller(s), the optional PLC, and the actuator power supply (or power supplies) interfaced with an actuator (e.g., the actuator 62).

During operation of the trimmer 10 incorporating one embodiment of the adjustable trimming assembly 46, a first untrimmed printed product 26*a* is conveyed to a location on the intermediate conveyor 22 in which the leading edge 30 of the product 26*a* abuts the stops 50. Before the leading edge 30 of the untrimmed printed product 26*a* abuts the stops 50, the finishing control system 67 associates the incoming untrimmed printed product 26*a* with a particular size specification or custom trim size, and outputs a signal to the controller 66 which, in turn, triggers the actuators 62 to adjust the distance between the stops 50 and the blade 54 according to that particular custom trim size. In this manner, the controller 66 prompts the actuators 62 to move the stops 50 (either backwards or forwards along the path) to a first distance D1 from the stationary blade 54 to yield the custom trim size (see FIG. 1*a*). After the blade 54 trims the margin 58 from the minor dimension of the printed product 26*a*, the stops 50 are displaced from the path (discussed in further detail below) to allow the now custom-trimmed printed product 26*a* to be conveyed along the output conveyor 18.

The same process is repeated for the subsequent printed product 26*b* on the input conveyor 14. In one instance, the product 26*b* may have a specified width greater than the width of the preceding product 26*a*. To accommodate this custom trim size, the controller 66 prompts the actuators 62 to move the stops 50 (again, either backwards or forwards along the path) to a second distance D2 from the stationary blade 54 before the leading edge 30 of the product 26*b* abuts the stops 50 (see FIG. 1*b*). After the stops 50 are moved, the leading edge 30 of the product 26*b* abuts the stops 50, and the blade 54 trims the margin 58 from the minor dimension of the product 26*b*. The stops 50 are again displaced from the path to allow the custom-trimmed printed product 26*b* to be conveyed along the output conveyor 18. This process may be repeated for all of the printed products 26 in a particular production run, thereby allowing each printed product 26 trimmed during the production run to receive a custom trim size. As discussed above, conventional trimmers may only be manually adjusted between production runs, such that differently-sized printed products may only be made during separate production runs. The adjustable trimming assembly 46 allows "on the fly" adjustment of the trim size of the printed products 26 during the same production run.

With reference to FIG. 1*a*, a plurality of sensors 68*a*, 68*b* (e.g., photoeyes) may be incorporated into the adjustable trimming assembly 46 at a location downstream of the blade 54. In the illustrated construction of the adjustable trimming assembly 46, two sensors 68*a*, 68*b* are positioned above the output conveyor 18 and are substantially aligned with each other in a direction perpendicular to the path (indicated by arrow A). Alternatively, more than two sensors may be utilized. The sensors 68*a*, 68*b* are operably coupled to the controller 66. During operation of the trimmer 10 and the adjustable trimming assembly 46, the sensors 68*a*, 68*b* (in combination with the controller 66) are configured to measure the second dimension, or the width, of the custom-trimmed trimmed printed product 26*a* at their respective locations along the first dimension, or the height, of the printed product 26*a*. The width measurements of the printed product 26*a* performed by the respective sensors 68*a*, 68*b* indicate the squareness, skew, and width dimension of the face trim performed by the blade 54 on the printed product 26*a*. Too large of a variation between the width measurements of the respective sensors 68*a*, 68*b* may cause the printed product 26*a* to be rejected and redirected to a recycling bin (not shown) by a redirection device. As such, the sensors 68*a*, 68*b* serve as a quality control system by which the quality of the face trims of the printed products 26 is measured. Sensors may also be used and configured to determine what trim size is appropriate for each printed product, and may be coupled, directly or indirectly, to the controller 66 to control the adjustable trimming assembly 46.

Figure 2A:
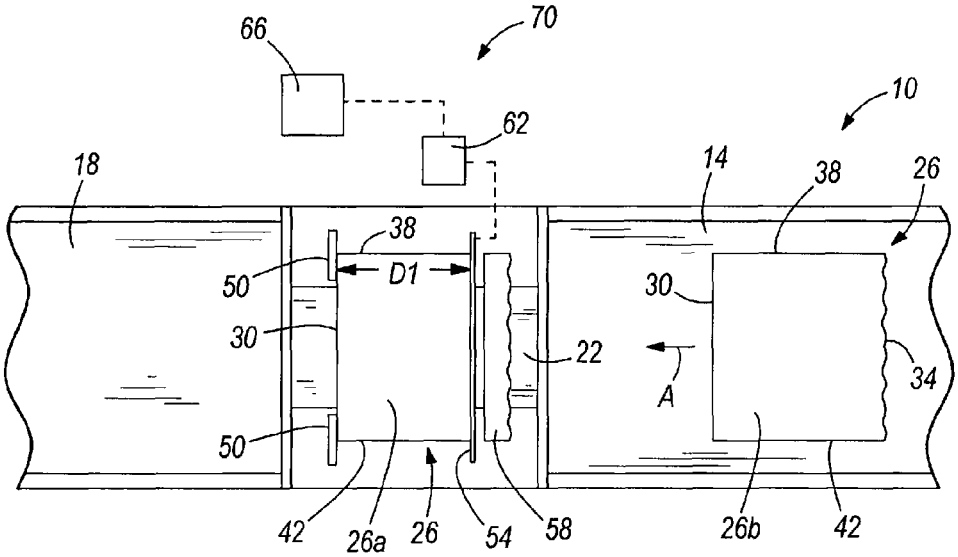
FIG. 2*a* is a schematic top view of a portion of a trimmer incorporating a second construction of the adjustable trimming assembly, according to an exemplary embodiment.
Figure 2B:
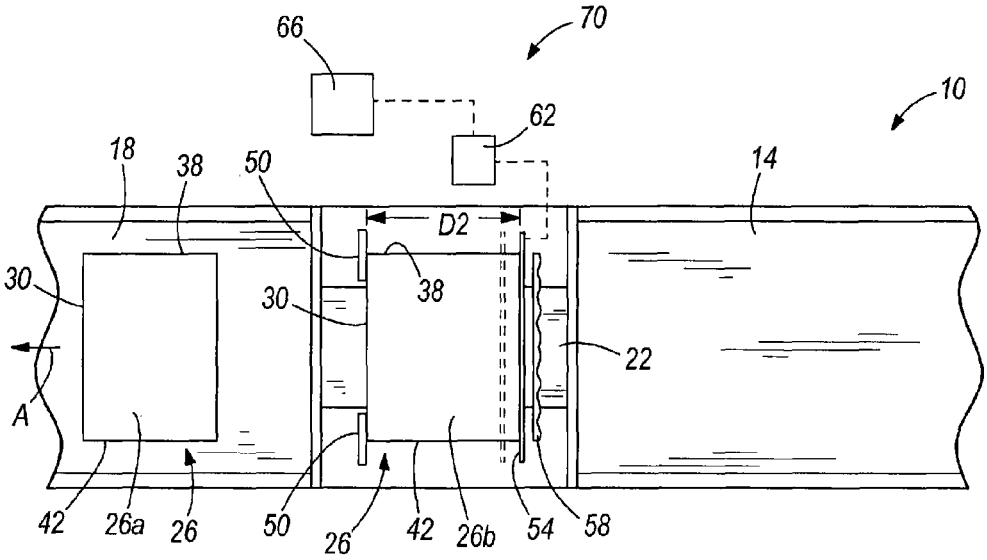
FIG. 2*b* is a schematic top view of a portion of the trimmer and adjustable trimming assembly of FIG. 2*a*, showing an alternate configuration of the adjustable trimming assembly, according to an exemplary embodiment.
Figure 3A:
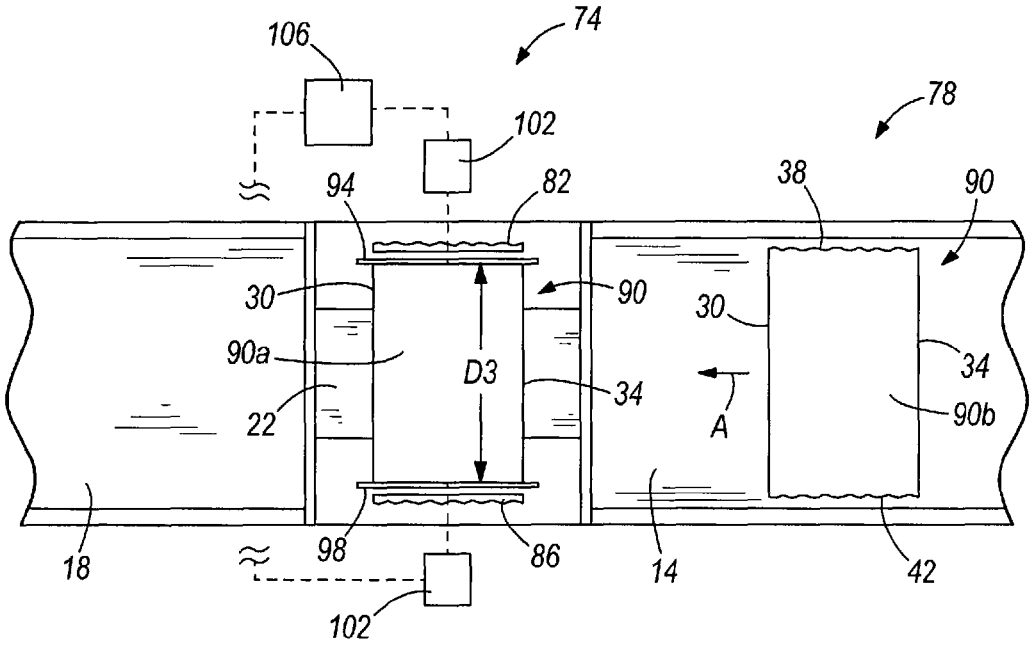
FIG. 3*a* is a schematic top view of a portion of a trimmer incorporating a third construction of the adjustable trimming assembly, according to an exemplary embodiment.
Figure 3B:
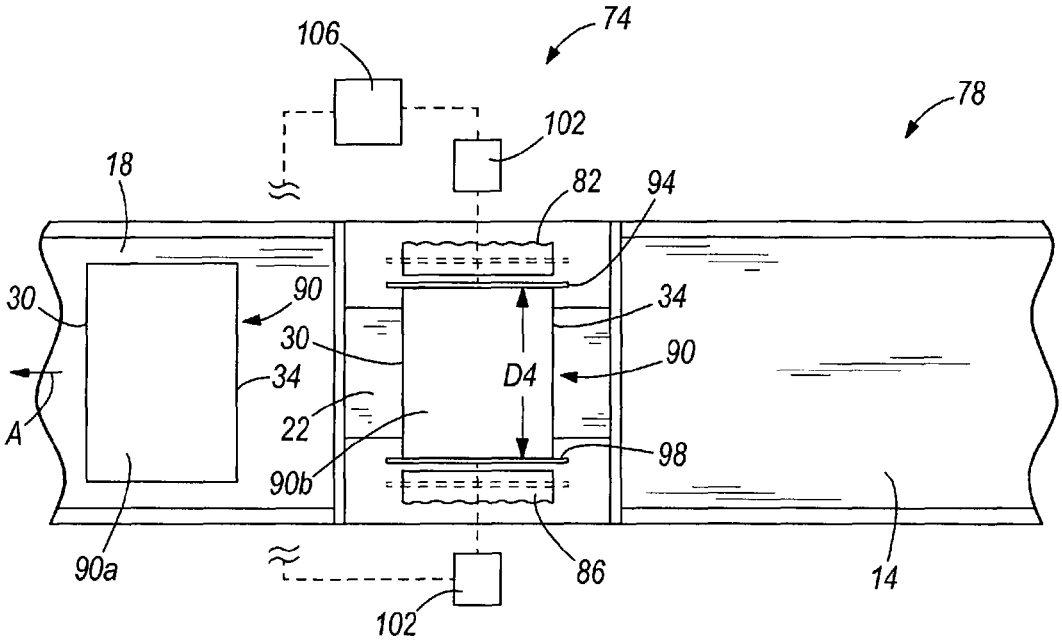
FIG. 3*b* is a schematic top view of a portion of the trimmer and adjustable trimming assembly of FIG. 3*a*, showing an alternate configuration of the adjustable trimming assembly, according to an exemplary embodiment.

FIGS. 2*a* and 2*b* are similar to FIGS. 1*a* and 1*b*, however, FIGS. 2*a* and 2*b* illustrate an alternative construction of an adjustable trimming assembly 70, in which the stops 50 are stationary and the actuator 62 is coupled to the blade 54 to adjust the distance between the blade 54 and the stops 50 in a direction substantially parallel with the path indicated by arrow A. Like components are labeled with like reference numerals. The discussion above with respect to the adjustable trimming assembly 46 of FIGS. 1*a* and 1*b* is also applicable to the adjustable trimming assembly 70 of FIGS. 2*a* and 2*b*, with the exception that the actuator 62 is coupled to the blade 54 rather than the stops 50 to adjust the distance between the blade 54 and the stops 50. As shown in FIGS. 1*a* and 2*a*, and in FIGS. 1*b* and 2*b*, the same custom-trimmed printed products 26*a*, 26*b* may be achieved using either constructions of the adjustable trimming assembly 46, 70. The adjustable trimming assembly 70 may also incorporate the quality-control sensors 68*a*, 68*b* shown in FIG. 1*a*, or any other features described herein. With reference to FIGS. 3*a* and 3*b*, yet another construction of an adjustable trimming assembly 74 is shown incorporated into a portion of a trimmer 78, with like components labeled with like reference numerals. The trimmer 78 is configured to trim respective margins 82, 86 from the major dimension of printed products 90. Specifically, the trimmer 78 is configured to trim respective margins 82, 86 from the respective top and bottom edges 38, 42 (i.e., the "head trim" and "foot trim," respectively) of the printed products 90. As noted above, the major dimension of a printed product need not coincide with the leading edge of the printed product, as it is conveyed along the path. Rather, the leading edge of a printed product may coincide with the minor dimension of the product. As such, the trimmer 78 may also trim respective margins from the minor dimension of a printed product.

The trimmer 78 may be configured as a three-knife trimmer, only a portion of which is shown, which includes a first knife or blade (not shown) for making face trims on printed products 90, a second knife or blade 94 for making head trims on printed products 90, and a third knife or blade 98 for making foot trims on printed products 90. Three-knife trimmers are typically configured to perform the face trims before the head and the foot trims, which are typically performed at the same time; however, the three-knife trimmer may be configured to perform the head and foot trims before the face trim or simultaneously with the face trim. It should be noted that the schematic illustration of the trimmer 78 in FIGS. 3*a* and 3*b* may differ from the actual structure utilized in three-knife trimmers to carry out the head and foot trims on the printed products 90. With continued reference to FIGS. 3*a* and 3*b*, the trimmer 78 includes conveyors 14, 18, 22 similar to those illustrated in FIGS. 1*a*-2*b*. The conveyors 14, 18, 22 define a path indicated by arrow A along which the printed products 90 are conveyed. The adjustable trimming assembly 74 includes two blades 94, 98, one blade 94 oriented to perform head-trims on the printed products 90 and one blade 98 oriented to perform foot-trims on the printed products 90, and respective actuators 102 coupled to the blades 94, 98 to adjust the distance between the blades 94, 98 in a direction substantially transverse to the path. The adjustable trimming assembly 74 also includes a controller 106 operably coupled to the actuators 102 to selectively control the adjustment of the distance between the respective blades 94, 98, or "controllably adjust" the distance between the respective blades 94, 98. As shown in FIG. 3*b*, the controller 106 is operable to automatically adjust the distance between the respective blades 94, 98 in a direction substantially transverse to the path, or in a direction substantially parallel with the direction of the major dimension of the printed products 26, to yield custom-trimmed printed products 26. Although two actuators 102 are shown in the schematic illustration of FIGS. 3*a* and 3*b*, it should be noted that a single actuator 102, through any of a number of different linkages or motion-transmitting structures, may be utilized to move or adjust both of the blades 94, 98 at the same time. The adjustable trimming assembly 74 may also incorporate the quality-control sensors 68*a*, 68*b* shown in FIG. 1*a*, or any other features described herein. Further, the adjustable trimming assembly 74 may interface with a higher level controller (e.g., the controller 67; see FIG. 28) programmed with the custom trim size data for each of the untrimmed printed products 26 in a particular production or binding run.

During operation of the trimmer 78 incorporating the adjustable trimming assembly 74, a first untrimmed printed product 90*a* is conveyed to a location between the blades 94, 98. Before the untrimmed printed product 90*a* comes into position between the blades 94, 98, the higher level controller 67 associates the incoming untrimmed printed product 90*b* with a particular size specification or custom trim size, and outputs a signal to the controller 106 which, in turn, triggers the actuators 102 to adjust the distance between the blades 94, 98 according to that particular custom trim size. In this manner, the controller 106 prompts the actuators 102 to move the blades 94, 98 (either inwards or outwards, in a direction substantially transverse to the path) to a first distance D3 to yield the custom trim size (see FIG. 3*a*). After the blades 94, 98 trim the margins 82, 86 from the major dimension of the printed product 90*a* (i.e., make the head and foot trims), the conveyors 18, 22 transport the now custom-trimmed printed product 90*a* away from the blades 94, 98 along the path.

With reference to FIG. 3*b*, the same process is repeated for the subsequent printed product 90*b* that follows the printed product 90*a*. In one instance, the product 90*b* might have a specified height less than the height of the preceding product 90*a*. To accommodate this custom trim size, the controller 106 prompts the actuators 102 to move the blades 94, 98 (again, either inwards or outwards, in a direction substantially transverse to the path) to a second distance D4 before the product 90*b* comes into position between the blades 94, 98. After the blades 94, 98 are in position to accommodate the custom trim size of the product 90*b*, the blades 94, 98 trim the margins 82, 86 from the major dimension of the product 90*b*. The now custom-trimmed product 90*b* is then conveyed away from the blades 94, 98 along the path. This process may be repeated for all of the printed products 90 in a particular production run, thereby allowing each printed product 90 trimmed during the production run to receive a custom trim size. As discussed above, conventional three-knife trimmers may only be manually adjusted between production runs, such that differently-sized printed products may only be made during separate production runs. The adjustable trimming assembly 74 allows "on the fly" adjustment of the trim size of the printed products 90 during the same production run.

Figure 3C:
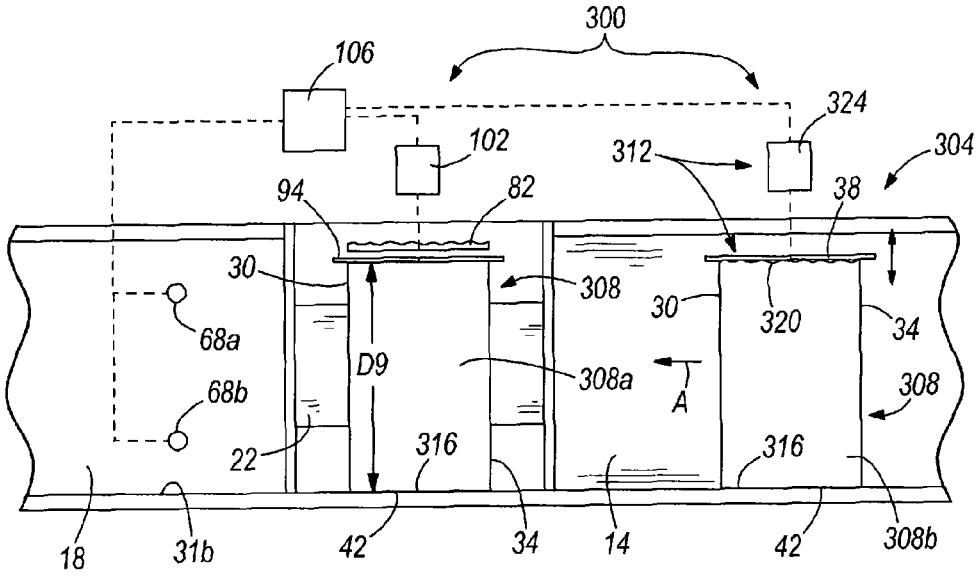
FIG. 3*c* is a schematic top view of a portion of a trimmer incorporating a fourth construction of the adjustable trimming assembly, according to an exemplary embodiment.
Figure 3D:
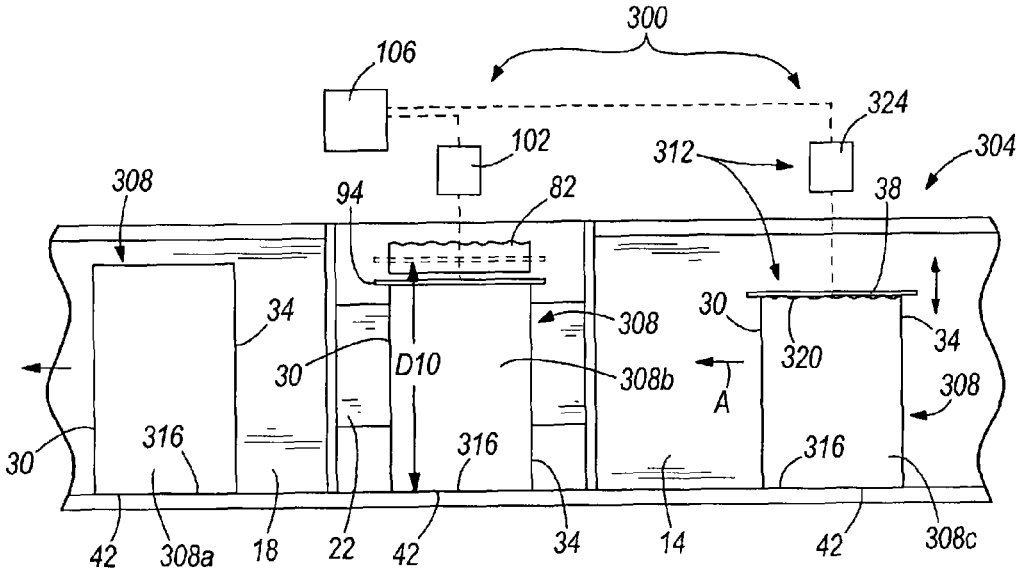
FIG. 3*d* is a schematic top view of a portion of the trimmer and adjustable trimming assembly of FIG. 3*c*, showing an alternate configuration of the adjustable trimming assembly, according to an exemplary embodiment.

With reference to FIGS. 3*c* and 3*d*, another construction of an adjustable trimming assembly 300 is shown incorporated into a portion of a trimmer 304, with like components labeled with like reference numerals. The trimmer 304 is configured to trim a margin 82 from the major dimension of printed products 308. Specifically, the trimmer 304 is configured to trim a margin 82 from the top edge 38 (i.e., the "head trim") of the printed products 308. As noted above, the major dimension of a printed product 308 need not coincide with the leading edge 30 of the printed product 308, as it is conveyed along the path. Rather, the leading edge of a printed product may coincide with the minor dimension of the product. As such, the trimmer 304 may also trim a margin from the minor dimension of a printed product.

With continued reference to FIGS. 3*c* and 3*d*, the adjustable trimming assembly 300 includes one blade 94 oriented to perform head-trims on the printed products 308 and an actuator 102 coupled to the blade 94 to adjust the blade 94 in a direction substantially transverse to the path. The controller 106 is operably coupled to the actuator 102 to control the adjustment of the blade 94, or "controllably adjust" the blade 94. As shown in FIG. 3*d*, the controller 106 is operable to automatically adjust the blade 94 in a direction substantially transverse to the path, or in a direction substantially parallel with the direction of the major dimension of the printed products 308, to yield custom-trimmed printed products 308.

The adjustable trimming assembly 300 also includes a side-jogging device or a tamping device 312 configured to bias the bottom edge 42 of the printed products 308 against a guide surface 316 that extends in a direction substantially parallel with the path (see FIGS. 3*c* and 3*d*). The trimmer 304 may incorporate the guide surface 316 in any of a number of different configurations; for example, the guide surface 316 may be fixed to the support structure of the trimmer 304 such that the conveyors 14, 18, 22 and printed products 308 are moving with respect to the guide surface 316. In such a configuration, the guide surface 316 may include a low-friction surface to facilitate sliding between the printed products 308 and the guide surface 316. Conversely, discrete sections of the guide surface 316 may be coupled to the respective conveyors 14, 18, 22 such that the guide surface 316 moves with the conveyors 14, 18, 22.

The tamping device 312 includes another guide surface 320 extending in a direction substantially parallel with the path, in facing relationship with the guide surface 316. An actuator 324 is coupled to the guide surface 320 to adjust the distance between the guide surface 320 with respect to the guide surface 316 along the first dimension of the printed products 308, or in a direction substantially transverse to the path. The actuator 324, like the actuator 102, is operably coupled to the controller 106. As shown in FIGS. 3*c* and 3*d*, the actuator 324 is configured as a cylinder that may be hydraulically or pneumatically powered. Alternatively, the actuator 324 may comprise any of a number of different devices to move the guide surface 320 toward or away from guide surface 316, in a direction substantially transverse to the path. In addition, the actuator 324 may include a pressure relief valve (not shown) or other device to limit the amount of force or pressure exerted on the printed products 308 between the guide surfaces 320, 316. The adjustable trimming assembly 300 may also incorporate the quality-control sensors 68*a*, 68*b* or any other features described herein.

During operation of the trimmer 304 incorporating the adjustable trimming assembly 300, a first untrimmed printed product 308*a* is conveyed to a location between the blade 94 and the guide surface 316. Before the untrimmed printed product 308*a* comes into position between the blade 94 and guide surface 316, the higher level controller 67 associates the incoming untrimmed printed product 308*a* with a particular size specification or custom trim size, and outputs a signal to the controller 106 which, in turn, triggers the actuator 102 to adjust the distance between the blade 94 and the guide surface 316, according to that particular custom trim size. In this manner, the controller 106 prompts the actuator 102 to move the blade 94 (either inwards or outwards, in a direction substantially transverse to the path) to a first distance D9 to yield the custom trim size (see FIG. 3*c*). After the blade 94 trims the margin 82 from the major dimension of the printed product 308*a* (i.e., makes the head trim), the conveyors 18, 22 transport the now custom-trimmed printed product 308*a* away from the blade 94 along the path.

While the blade 94 is being adjusted with respect to the guide surface 316 in anticipation of trimming the printed product 308*a*, or while the printed product 308*a* is being trimmed, the controller 106 may prompt the actuator 324 to move the guide surface 320 to push the subsequent product 308*b* toward the guide surface 316 and bias the bottom edge 42 of the printed product 308*b* against the guide surface 316. The same trimming process described above for the printed product 308*a* may then be repeated for the subsequent printed product 308*b*, with the controller 106 prompting the actuator 102 to move the blade 94 to a second distance D10 to yield a different custom trim size for the printed product 308*b* (see FIG. 3*d*). While the blade 94 is being adjusted with respect to the guide surface 316 in anticipation of trimming the printed product 308*b*, or while the printed product 308*b* is being trimmed, the controller 106 prompts the actuator 324 to move the guide surface 320 to push a subsequent printed product 308*c* toward the guide surface 316 and bias the bottom edge 42 of the printed product 308*c* against the guide surface 316.

Features of the embodiments in FIGS. 1*a*-3*d* may be combined in various configurations. For example, a system can comprise three blades configured to cut three edges of printed product with one or more edges being adjustable to accommodate different sizes of printed product. Cuts can be made sequentially or simultaneously using the three blades.

Figure 4:
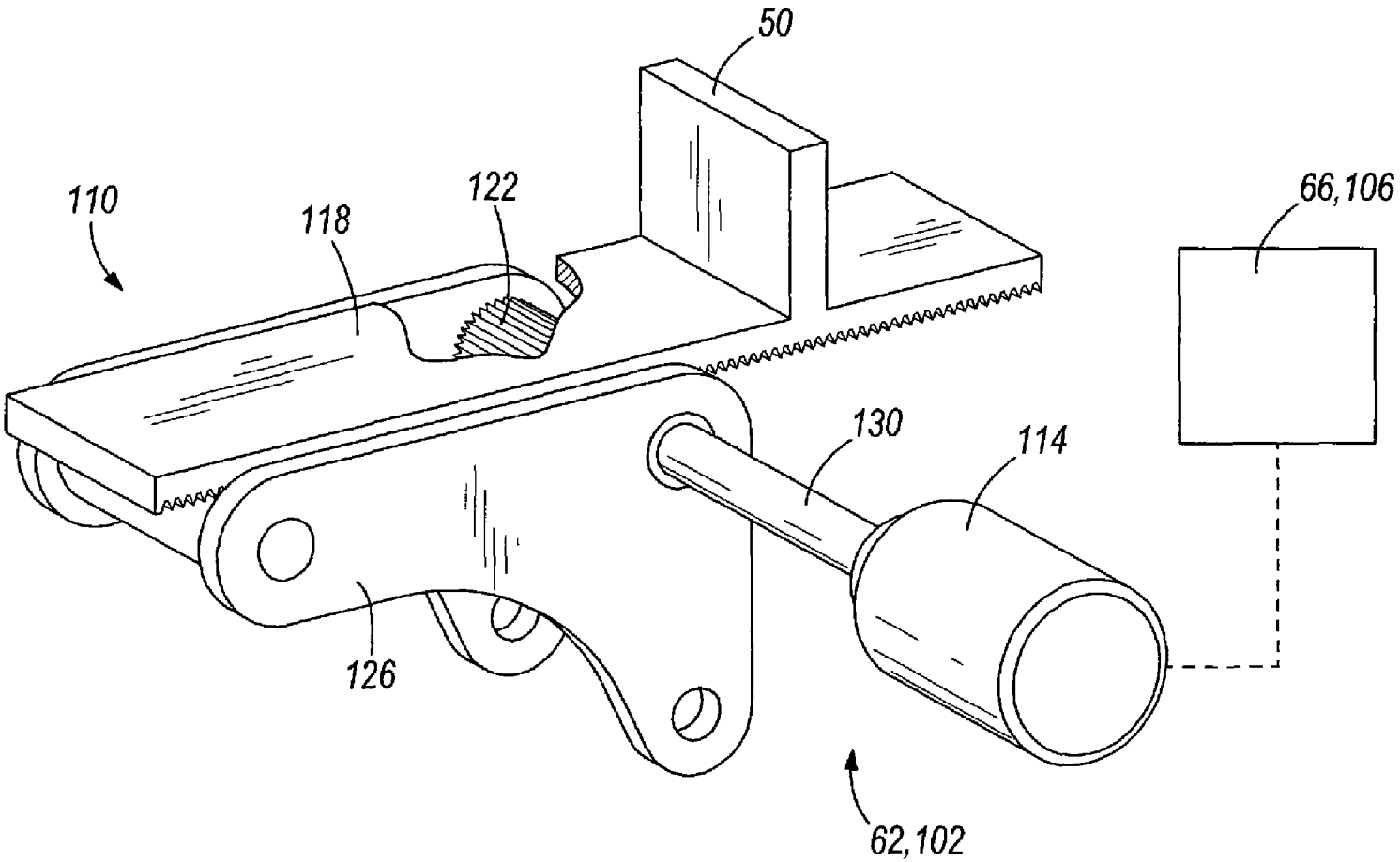
FIG. 4 is a schematic perspective view of a first construction of an actuator used in any of the adjustable trimming assemblies of FIGS. 1*a* and 1*b*, according to an exemplary embodiment.

With reference to FIG. 4, a first construction of the actuator 62, 102 includes a rack and pinion mechanism 110 operably driven by a motor 114, or a rotary servo motor 114, such as those available from Exlar, Inc., of Minneapolis, Minn. In the illustrated construction of the rack and pinion mechanism 110, the mechanism 110 is configured to move the stop 50 in a direction substantially parallel with the path of the trimmer 10 (see FIGS. 1*a* and 1*b*). Alternatively, the rack and pinion mechanism 110 may be configured to move the blade 54 that performs face-trims on the printed products 26 in a direction substantially parallel with the path of the trimmer 10 (see FIGS. 2*a* and 2*b*). Further, the rack and pinion mechanism 110 may be configured to move the blades 94, 98 that perform, respectively, head-trims and foot-trims on the printed products 90 in a direction substantially transverse to the path of the trimmer 78 (see FIGS. 3*a* and 3*b*).

With reference to FIG. 4, the illustrated rack and pinion mechanism 110 includes a rack 118 having the stop 50 coupled thereto, and a pinion 122 supported relative to the rack 118 to drivingly engage the rack 118. A rigid shaft 130 couples the pinion 122 to the motor 114. The illustrated rack and pinion mechanism 110 is also supported by a link 126, which is a portion of a mechanism that displaces the stop 50 from the path as printed products 26 are conveyed from the intermediate conveyor 22 to the output conveyor 18. Because the motor 114 is coupled to the pinion 122 by a rigid shaft 130, the motor 114 is also supported by the link 126 and is movable with the link 126. However, when the rack and pinion mechanism 110 is utilized in conjunction with any of the blades 94, 98, other structure, besides the link, may be utilized to couple the respective blades 94, 98 and the rack and pinion mechanism 110.

Figure 5:
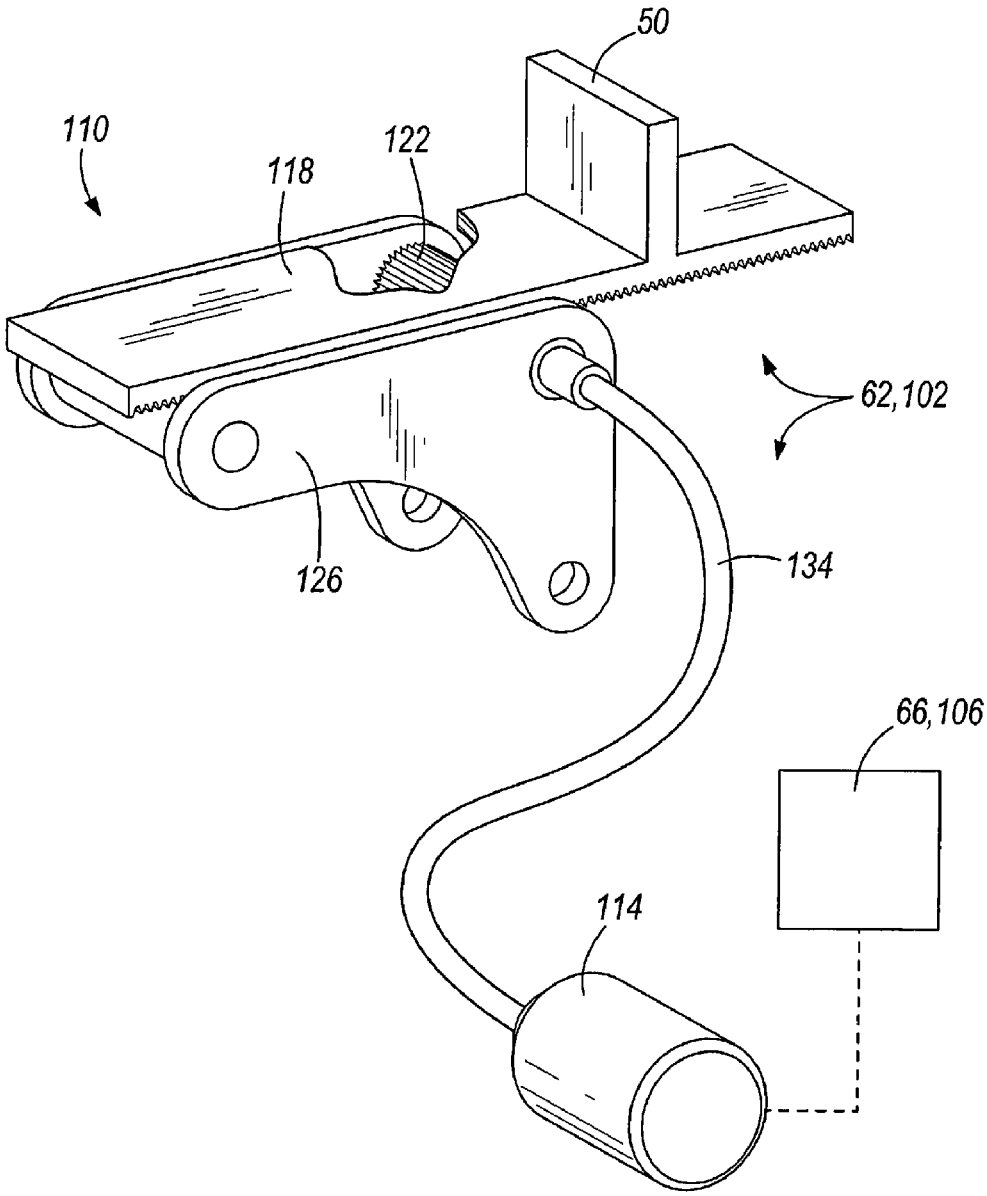
FIG. 5 is a schematic perspective view of a second construction of an actuator used in any of the adjustable trimming assemblies of FIGS. 1*a* and 1*b*, according to an exemplary embodiment.

With reference to FIG. 5, another construction of the actuator 62, 102 includes the rack and pinion mechanism 110 and the motor 114 of FIG. 4, with like components having like reference numerals. However, a flexible shaft 134, rather than the rigid shaft 130, may be utilized to couple the pinion 122 to the motor 114 (see FIG. 5). The flexible shaft 134 permits remote mounting of the motor 114, such that the motor 114 need not be mounted to the link 126 to move with the link 126.

Figure 6:
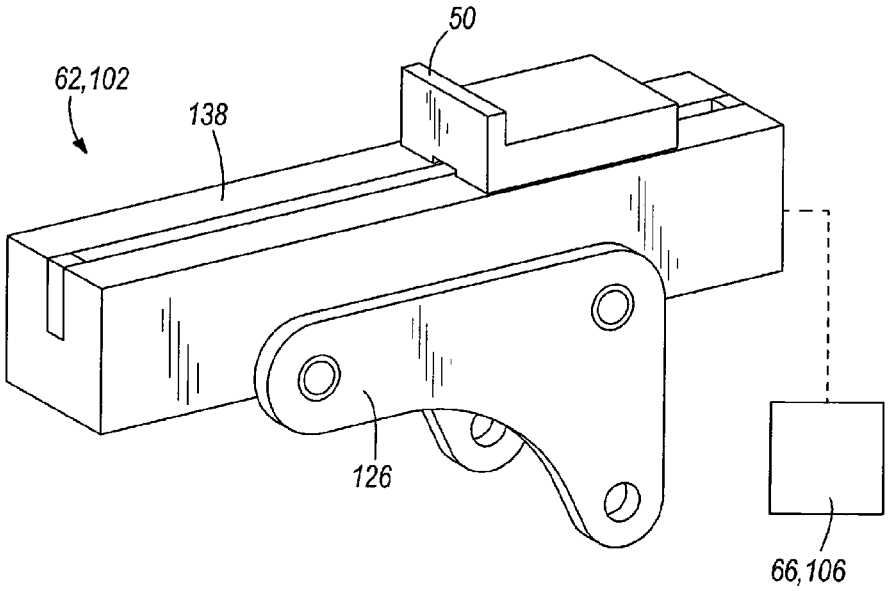
FIG. 6 is a schematic perspective view of a third construction of an actuator used in any of the adjustable trimming assemblies of FIGS. 1*a* and 1*b*, according to an exemplary embodiment.

With reference to FIG. 6, yet another construction of the actuator 62, 106 includes a linear motor 138, or a linear servo motor 138, such as those available from Exlar, Inc., of Minneapolis, Minn. In the illustrated construction of the linear motor 138, the linear motor 138 is configured to move the stop 50 in a direction substantially parallel with the path of the trimmer 10 (see FIGS. 1*a* and 1*b*). Alternatively, the linear motor 138 may be configured to move the blade 54 that performs face-trims on the printed products 26 in a direction substantially parallel with the path of the trimmer 10 (see FIGS. 2*a* and 2*b*). Further, the linear motor 138 may be configured to move the blades 94, 98 that perform, respectively, head-trims and foot-trims on the printed products 90 in a direction substantially transverse to the path of the trimmer 78 (see FIGS. 3*a* and 3*b*).

Figure 7:
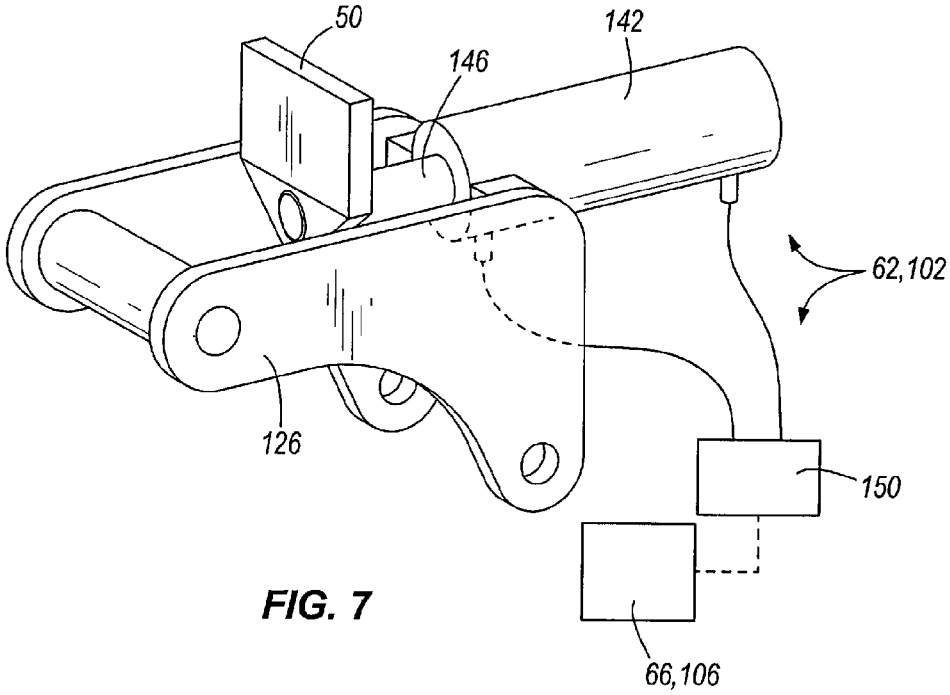
FIG. 7 is a schematic perspective view of a fourth construction of an actuator used in any of the adjustable trimming assemblies of FIGS. 1*a* and 1*b*, according to an exemplary embodiment.

With reference to FIG. 7, another construction of the actuator 62, 102 includes a cylinder 142 having an extensible rod 146 and a source of compressed fluid 150 (i.e., a compressed gas or a compressed liquid) operably coupled to the cylinder 142. In the illustrated construction of the cylinder 142, the cylinder 142 is configured to move the stop 50 in a direction substantially parallel with the path of the trimmer 10 (see FIGS. 1*a* and 1*b*) during extension and retraction of the rod 146. Although the stop 50 is shown coupled to the rod 146 in FIG. 7, the cylinder 142 may be mounted to the link 126 such that the rod 146 is stationary relative to the link 126 and the cylinder housing, having the stop 50 coupled thereto, is movable relative to the link 126. Alternatively, the cylinder 142 may be configured to move the blade 54 that performs face-trims on the printed products 26 in a direction substantially parallel with the path of the trimmer 10 (see FIGS. 2*a* and 2*b*). Further, the cylinder 142 may be configured to move the blades 94, 98 that perform, respectively, head-trims and foot-trims on the printed products 90 in a direction substantially transverse to the path of the trimmer 78 (see FIGS. 3*a* and 3*b*).

Figure 8:
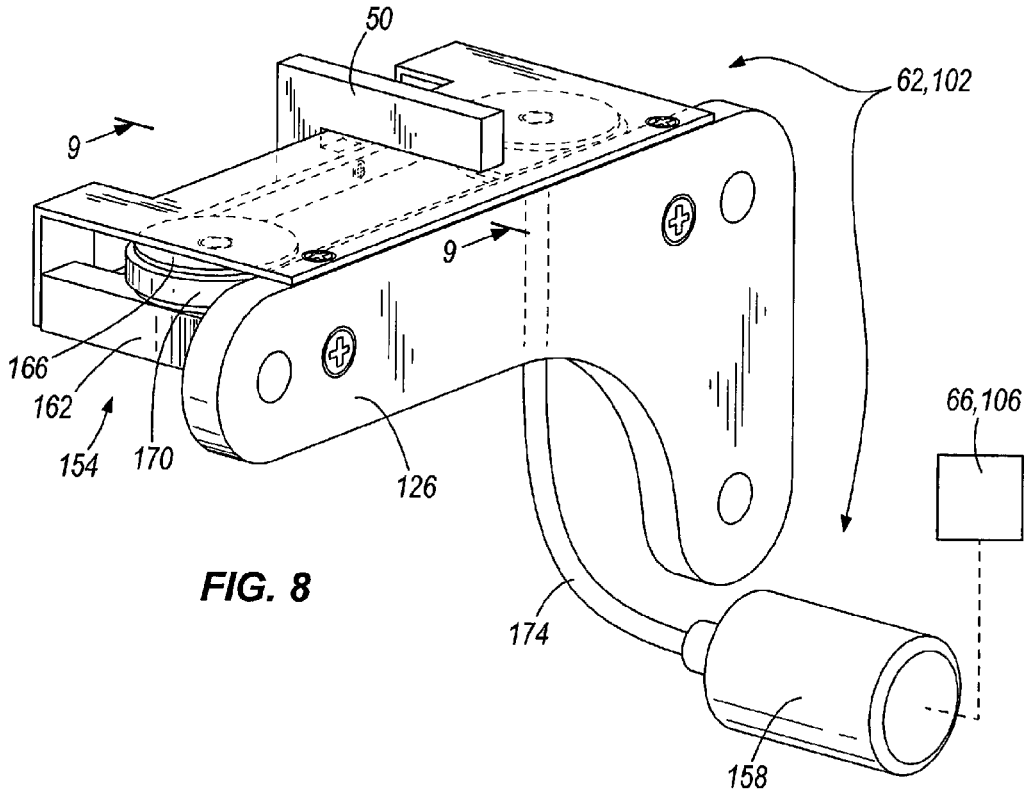
FIG. 8 is a schematic perspective view of a fifth construction of an actuator used in any of the adjustable trimming assemblies of FIGS. 1*a* and 1*b*, according to an exemplary embodiment.
Figure 9:
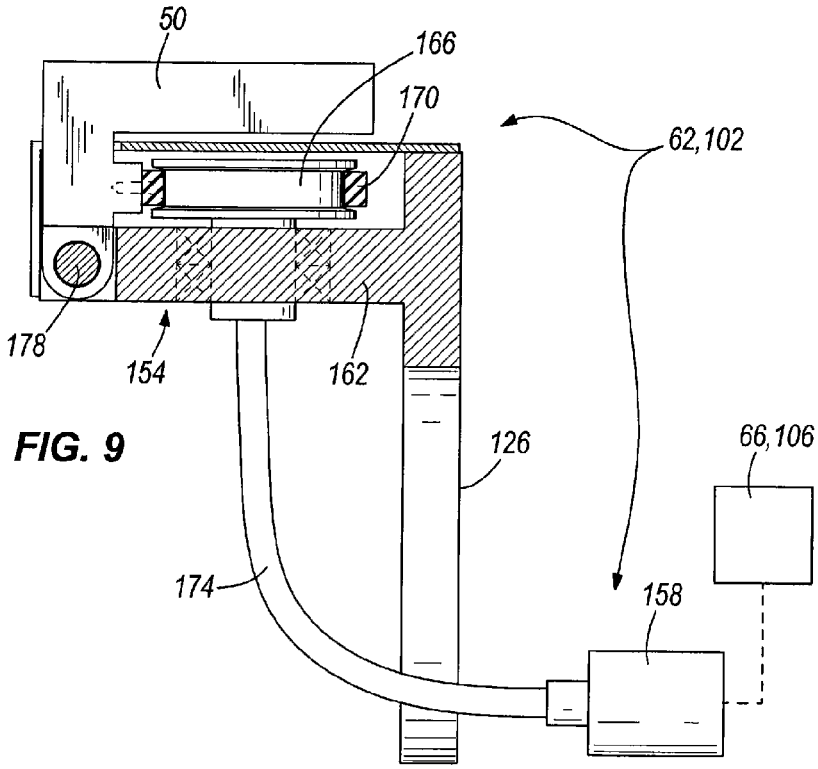
FIG. 9 is a cross-sectional view of the actuator of FIG. 8 through section 9-9 in FIG. 8, according to an exemplary embodiment.
Figure 10:
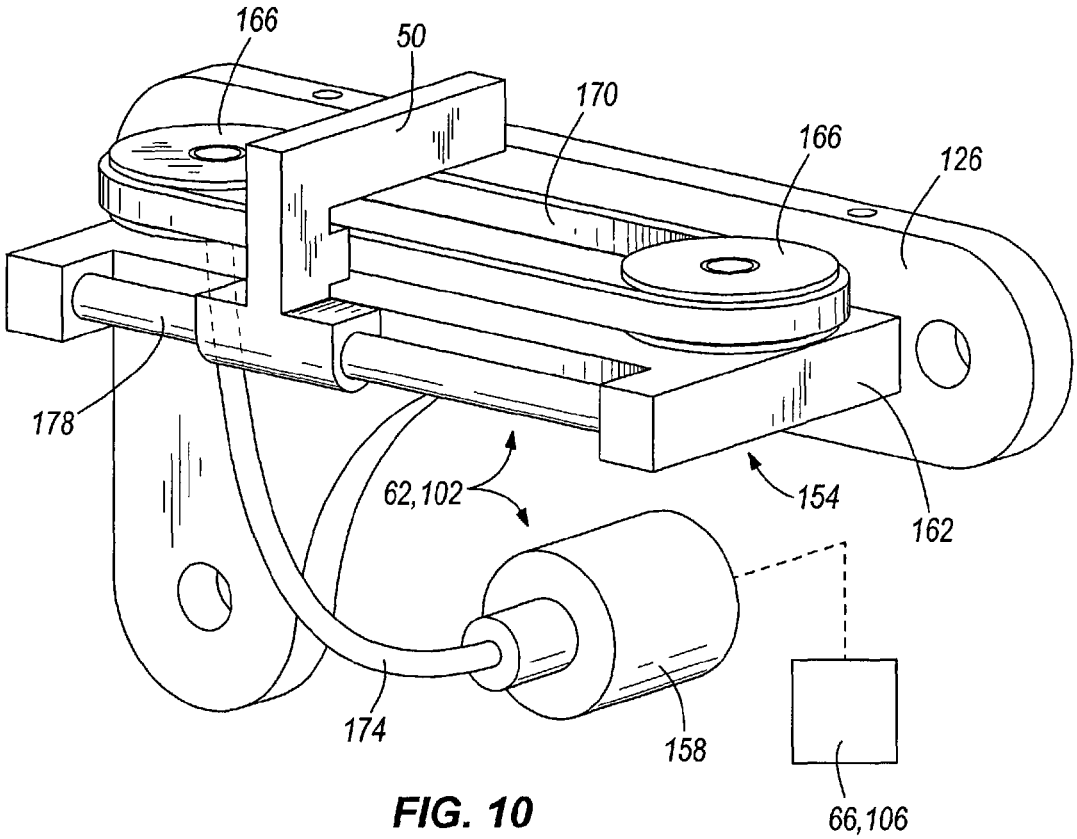
FIG. 10 is a schematic, reverse perspective view of the actuator of FIG. 8, according to an exemplary embodiment.

With reference to FIGS. 8-10, yet another construction of the actuator 62, 102 includes a linear belt mechanism 154 operably driven by a motor 158, or a rotary servo motor 158, such as those available from Exlar, Inc., of Minneapolis, Minn. In the illustrated construction of the linear belt mechanism 154, the mechanism 154 is configured to move the stop 50 in a direction substantially parallel with the path of the trimmer 10 (see FIGS. 1*a* and 1*b*). Alternatively, the linear belt mechanism 154 may be configured to move the blade 54 that performs face-trims on the printed products 26 in a direction substantially parallel with the path of the trimmer 10 (see FIGS. 2*a* and 2*b*). Further, the linear belt mechanism 154 may be configured to move the blades 94, 98 that perform, respectively, head-trims and foot-trims on the printed products 90 in a direction substantially transverse to the path of the trimmer 78 (see FIGS. 3*a* and 3*b*).

Figure 11:
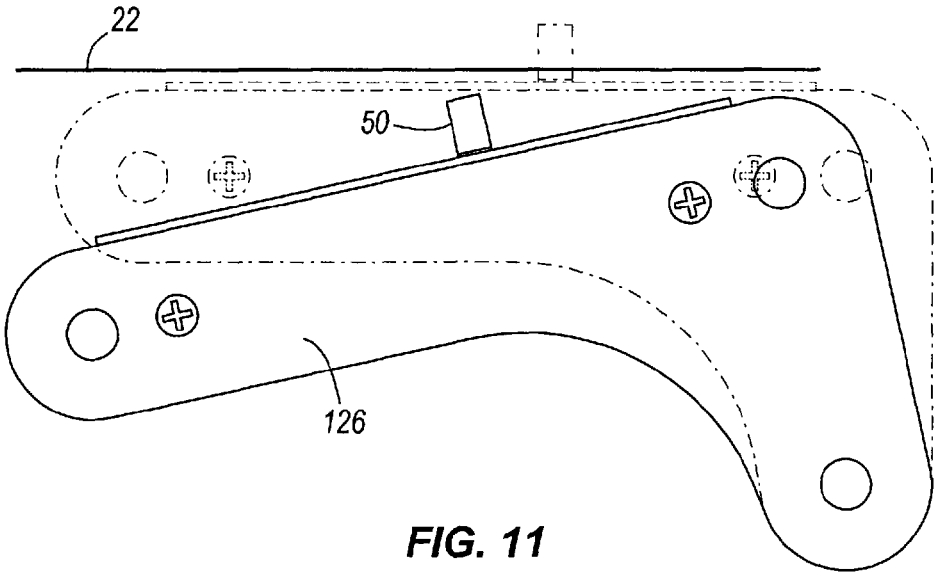
FIG. 11 is a schematic, side view of the actuator of FIG. 8 displaced from a path defined by conveyors of the trimmers of FIGS. 1*a* and 1*b*, according to an exemplary embodiment.

With reference to FIGS. 8-10, the linear belt mechanism 154 includes a mounting member 162 (e.g., a plate), two pulleys 166 rotatably coupled to the mounting member 162, and a belt 170 extending between the pulleys 166. The motor 158 is operably coupled to one of the pulleys 166 by a flexible shaft 174 to permit remote mounting of the motor 158 similar to the actuator 62 of FIG. 5. The linear belt mechanism 154 also includes an axial guide member 178 along which the stop 50 is moved in the direction substantially parallel with the path of the trimmer 10 (see FIGS. 1*a* and 1*b*). The stop 50 may be coupled in any of a number of different ways to the belt 170 (e.g., by clamping, fastening, etc.) such that rotation of the shaft 174, the pulleys 166, and the belt 170 imparts axial movement to the stop 50. Like the other actuators 62 of FIGS. 4-7, the linear belt mechanism 154 is mounted to the link 126 to allow the stop 50 to be displaced from the path of the trimmer 10 (see FIG. 11). Although each of the embodiments of the actuator 62, 102 in FIGS. 4-11 has been described as inclusive of a power unit (e.g., the servo motor 114, 158), the term "actuator" may also be construed to cover only the mechanical linkage or structure between the stop 50 and the power unit (e.g., the servo motor 114, 158).

Figure 12:
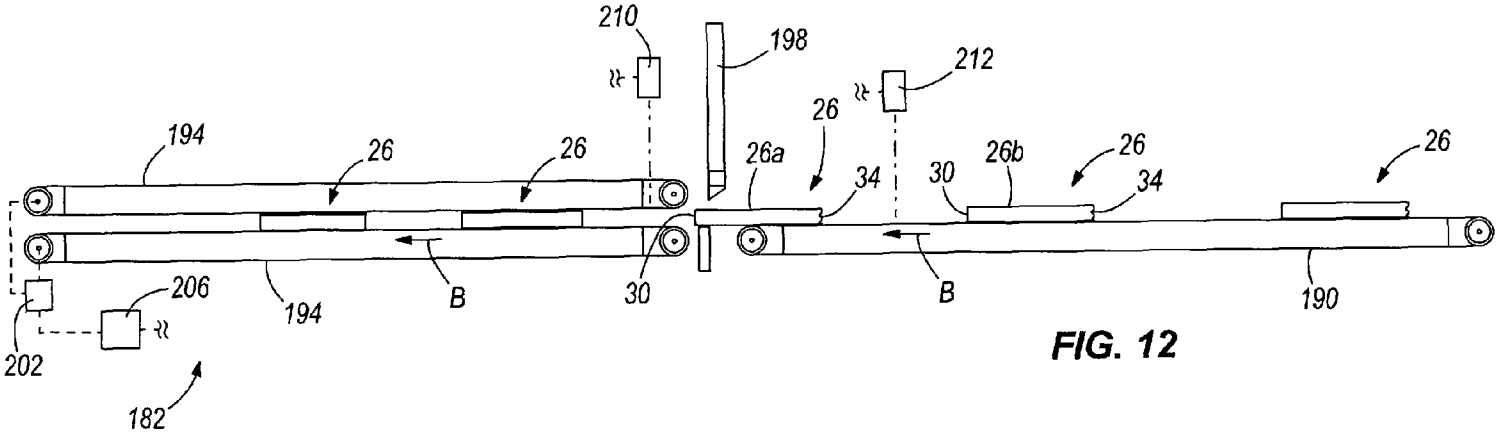
FIG. 12 is a schematic side view of a portion of a trimmer incorporating a fourth construction of an adjustable trimming assembly, illustrating a first piece of printed media being conveyed to a first trimming position, according to an exemplary embodiment.
Figure 13:
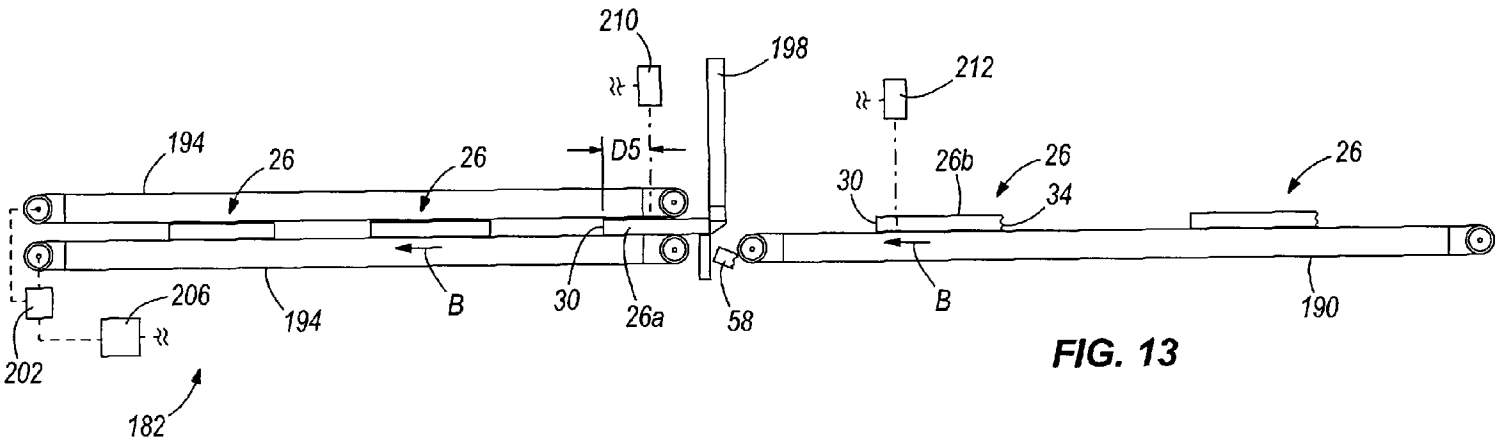
FIG. 13 is the schematic side view of the adjustable trimming assembly of FIG. 12, illustrating the first piece of printed media being trimmed in the first trimming position, according to an exemplary embodiment.
Figure 14:
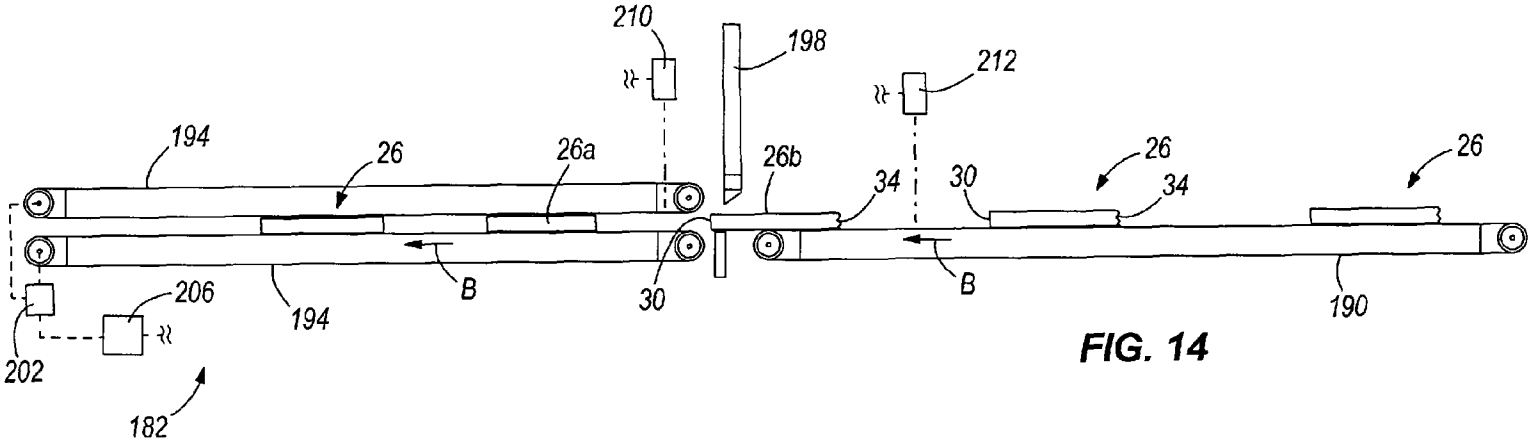
FIG. 14 is the schematic side view of the adjustable trimming assembly of FIG. 12, illustrating a second piece of printed media being conveyed to a second trimming position, according to an exemplary embodiment.
Figure 15:
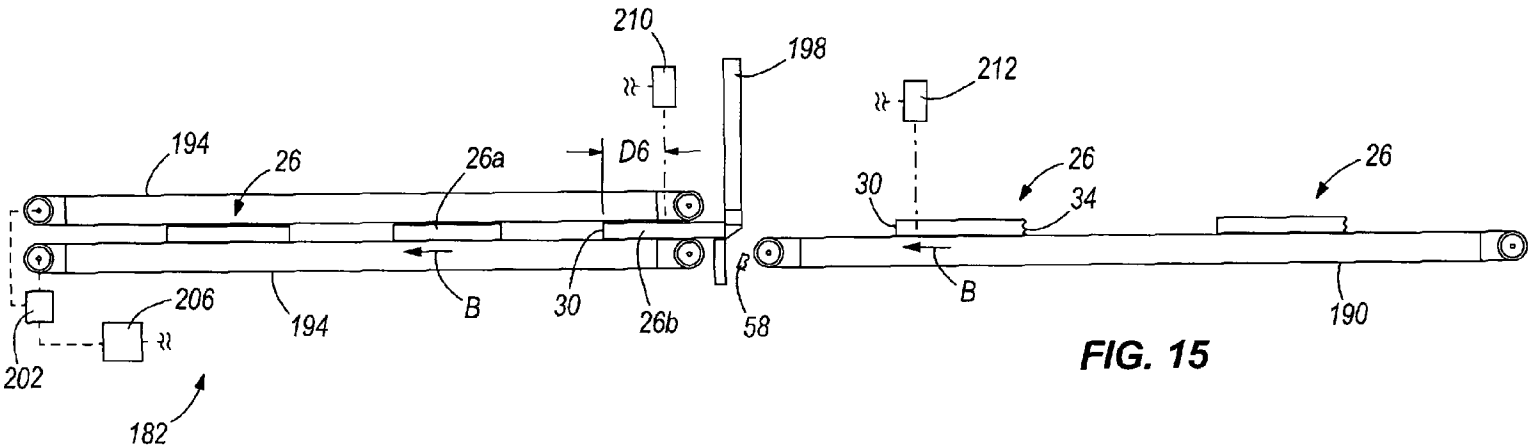
FIG. 15 is the schematic side view of the adjustable trimming assembly of FIG. 12, illustrating the second piece of printed media being trimmed in the second trimming position, according to an exemplary embodiment.

With reference to FIGS. 12-15, another construction of an adjustable trimming assembly 182 is shown incorporated into a portion of a trimmer (e.g., a trimmer manufactured by MULLER MARTINI of Zofingen, Switzerland), comprising an infeed or input conveyor 190 and a transport or output conveyor 194, the combination of which defines a path along which printed products 26 are conveyed in the direction of arrow B. With reference to FIG. 12, the adjustable trimming assembly 182 also includes a blade 198 positioned downstream of the input conveyor 190, with respect to the direction of arrow B; the output conveyor 194 is positioned downstream of the blade 198, with respect to the direction of arrow B. The adjustable trimming assembly 182 further includes an actuator 202 coupled to the output conveyor 194, a controller 206 operably coupled to the actuator 202, and a sensor 210 operably coupled to the controller 206. Like the adjustable trimming assemblies 46, 70, 74, 300 described above, the adjustable trimming assembly 182 may interface with a higher level controller (e.g., the controller 67; see FIG. 29) programmed with the custom trim size data for each of the untrimmed printed products 26 in a particular production or binding run.

With continued reference to FIG. 12, the actuator 202 may include a servo motor directly or indirectly coupled (e.g., through a gearbox or transmission mechanism) to the output conveyor 194 to incrementally drive the output conveyor 194. The sensor 210 (e.g., a photoeye sensor) may be configured to detect the leading edge 30 of the printed products 26 as they are fed to the output conveyor 18. The controller 206 may be operably coupled to the actuator 202 and the sensor 210 via a wired or wireless communication or network links.

During operation of the trimmer incorporating the adjustable trimming assembly 182, a first untrimmed printed product 26*a* is conveyed from the input conveyor 190, beneath the blade 198, and to the output conveyor 194 (see FIG. 12). Before the leading edge 30 of the untrimmed printed product 26*a* is received by the output conveyor 194, the higher level controller 67 associates the incoming untrimmed printed product 26*a* with a particular size specification or custom trim size, and outputs a signal to the controller 206 which, in turn, signals the actuator 202 to drive the output conveyor 194 an incremental distance D5 after the leading edge 30 of the first untrimmed printed product 26*a* is detected by the sensor 210, according to that particular custom trim size (see FIG. 13). Alternatively, the controller 206, with input from a master encoder 213 coupled to the input conveyor 190 (see FIG. 29), may signal the actuator 202 to drive the output conveyor 194 the incremental distance D5 without utilizing an input from the sensor 210.

The adjustable trimming assembly 182 is configured to provide a book-to-book trim variability of about 25 mm. In other words, the maximum difference in custom trim sizes that the assembly 182 is configured to accommodate, from one printed product to another, is 25 mm. An adjustment spanning the entire range of variability (i.e., 25 mm) by the adjustable trimming assembly 182 may take about 20 ms, and such variability may be accomplished at an operational speed of the adjustable trimming assembly 182 of about 340 books or printed products per minute. Alternatively, the assembly 182 may be configured to provide a book-to-book trim variability more (e.g., about 40 mm) or less (e.g., about 20 mm) than about 25 mm. If configured to provide a book-to-book trim variability more than about 25 mm, the adjustable trimming assembly 182 may require more time to make such an adjustment between consecutive printed products 26. However, if configured to provide a book-to-book trim variability less than about 25 mm, the adjustable trimming assembly 182 may function at higher operational speeds (e.g., up to 700 books or printed products per minute).

When the leading edge 30 of the first untrimmed printed product 26*a* is positioned the distance D5 from the line-of-sight of the sensor 210, the controller 206 signals the actuator 202 to stop the output conveyor 194 to allow the blade 198 to trim the margin 58 from the minor dimension of the printed product 26*a* according to the particular desired custom trim size. After the margin 58 is trimmed from the minor dimension of the printed product 26*a*, the controller 206 signals the actuator 202 to resume driving the output conveyor 194 to carry away the now trimmed product 26*a*.

The same process is repeated for the subsequent printed product 26*b* on the input conveyor 190. In one instance, the product 26*b* might have a specified width greater than the width of the preceding product 26*a* (see FIG. 14). To accommodate this custom trim size, the higher level controller 67 associates the incoming untrimmed printed product 26*b* with its particular custom trim size, and outputs a signal to the controller 206 which, in turn, signals the actuator 202 to drive the output conveyor 194 an incremental distance D6 after the leading edge 30 of the untrimmed printed product 26*b* is detected by the sensor 210, according to that particular custom trim size. When the leading edge 30 of the untrimmed printed product 26*b* is positioned the distance D6 from the line-of-sight of the sensor 210, the controller 206 signals the actuator 202 to stop the output conveyor 194 to allow the blade 198 to trim the margin 58 from the minor dimension of the printed product 26*b* according to its particular desired custom trim size (see FIG. 15). This process may be repeated for all of the printed products 26 in a particular production or binding run, thereby allowing each printed product 26 trimmed during the production run to receive a custom trim size. Moreover, consecutive printed products 26 passing through the adjustable trimming assembly 182 may have a different thicknesses. As discussed above, conventional trimmers may only be manually adjusted between production runs, such that differently-sized printed products may only be made during separate production runs. The adjustable trimming assembly 182 allows "on the fly" adjustment of the trim size of the printed products 26 during the same production run.

In other embodiments of the adjustable trimming assembly 182, another sensor 212 may be positioned upstream of the blade 198 to detect the leading edge 30 of the printed products 26 on the input conveyor 190. Like the sensor 210, the sensor 212 may be operably coupled to the controller 206. The sensor 212, optionally in combination with a master encoder 213 (see FIGS. 28-30) coupled to the input conveyor 190, may be utilized to determine whether the leading edge 30 of each printed product 26 is indeed where it is supposed to be on the input conveyor 190 relative to the entry or nip of the output conveyor 194 at a given time. If the actual position of the leading edge 30 varies from its supposed or target position on the input conveyor 190, the controller 206 may increase or decrease the speed of the input conveyor 190 to deliver the leading edge 30 of a particular printed product 26 to the entry or nip of the output conveyor 194 at the correct time.

In other embodiments, an encoder could be used in addition to the sensor 210 to reference components of the trimmer other than the leading edge 30 of the printed products 26. For example, the sensor 210 could sense pusher lugs, infeed chains, and timing positions of the trimmer.

Figure 16:
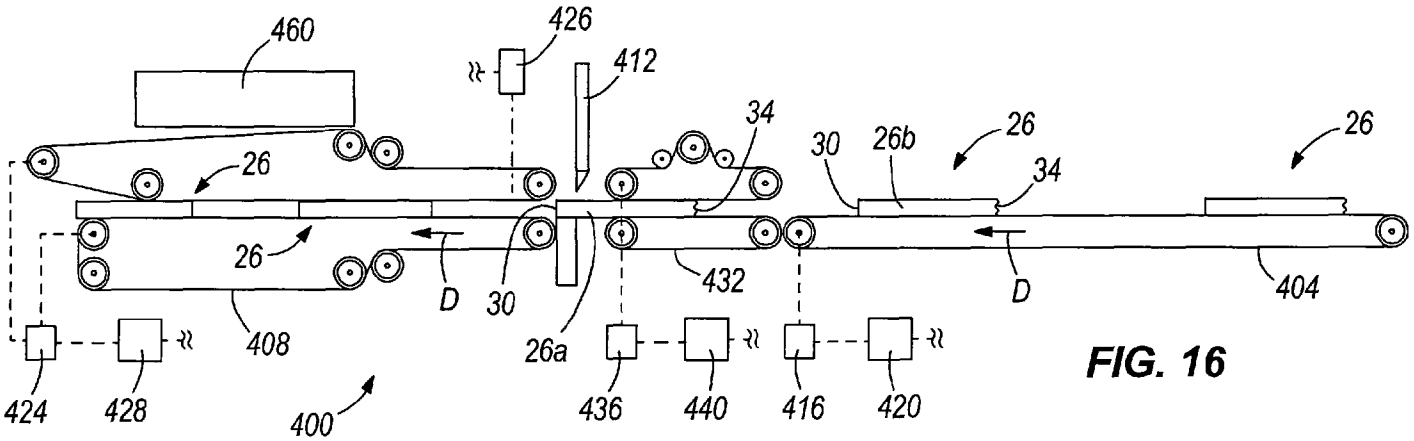
FIG. 16 is a schematic side view of a portion of a trimmer incorporating a fifth construction of an adjustable trimming assembly, illustrating a first piece of printed media being conveyed to a first trimming position, according to an exemplary embodiment.
Figure 17:
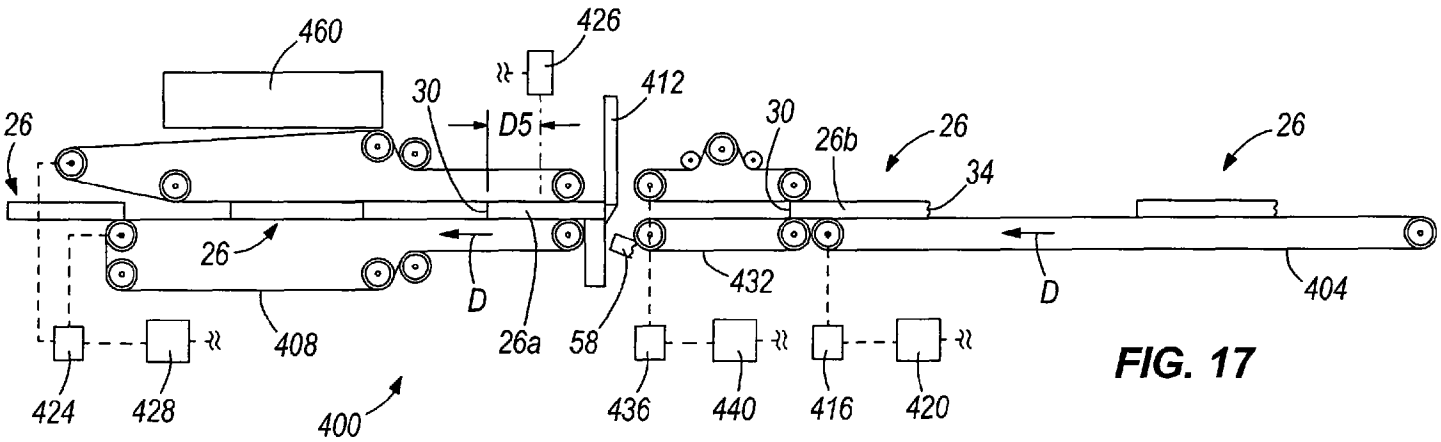
FIG. 17 is the schematic side view of the adjustable trimming assembly of FIG. 16, illustrating the first piece of printed media being trimmed in the first trimming position, according to an exemplary embodiment.
Figure 18:
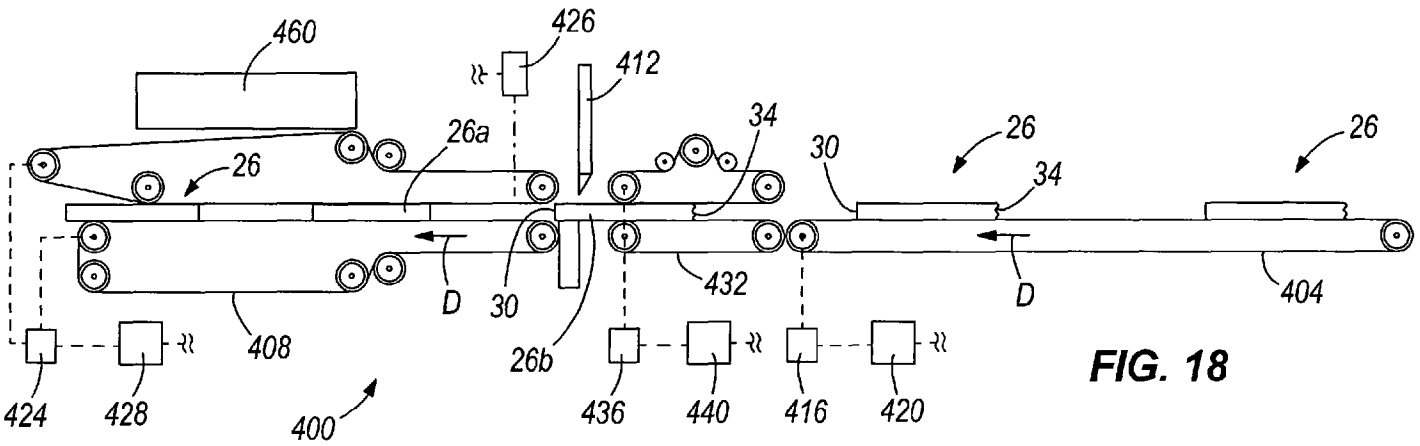
FIG. 18 is the schematic side view of the adjustable trimming assembly of FIG. 16, illustrating a second piece of printed media being conveyed to a second trimming position, according to an exemplary embodiment.

With reference to FIGS. 16-19, yet another construction of an adjustable trimming assembly 400 is shown incorporated into a portion of a trimmer (e.g., a MULLER MARTINI trimmer), comprising an infeed or input conveyor 404 and a transport or output conveyor 408, the combination of which at least partially defines a path along which printed products 26 are conveyed in the direction of arrow D. With reference to FIG. 16, the adjustable trimming assembly 400 also includes a blade 412 positioned downstream of the input conveyor 404, with respect to the direction of arrow D. The output conveyor 408 is positioned downstream of the blade 412, with respect to the direction of arrow D. The adjustable trimming assembly 400 further includes an actuator 416 coupled to the input conveyor 404, a controller 420 operably coupled to the actuator 416, an actuator 424 coupled to the output conveyor 408, a controller 428 operably coupled to the actuator 424, and a sensor 426 operably coupled to the controller 428.

With continued reference to FIG. 16, the adjustable trimming assembly 400 also includes an intermediate conveyor 432 positioned between the infeed and outfeed conveyors 404, 408. An actuator 436 is coupled to the conveyor 432, and a controller 440 is operably coupled to the actuator 436. The actuators 424, 436 may each include a servo motor directly or indirectly coupled (e.g., through a gearbox or transmission mechanism) to the conveyors 408, 432 to incrementally drive the conveyors 408, 432. The sensor 426 (e.g., a photoeye sensor) may be configured to detect the leading edge 30 of the printed products 26 as they are fed to the output conveyor 408. The controller 428 may be operably coupled to the actuator 424 and the sensor 426 via a wired or wireless communication or network links. Likewise, the controllers 420, 440 may be operably coupled to the respective actuators 416, 436 via a wired or wireless communication or network links. Like the adjustable trimming assemblies 46, 70, 74, 182, 300 described above, the adjustable trimming assembly 400 may interface with a higher level controller (e.g., the controller 67; see FIG. 30) programmed with the custom trim size data for each of the untrimmed printed products 26 in a particular production or binding run.

During operation of the trimmer incorporating the adjustable trimming assembly 400, a first untrimmed printed product 26*a* is conveyed from the input conveyor 404 to the intermediate conveyor 432, which provides a "coarse" adjustment of the custom trim size for each printed product 26. The feed rate of printed products 26 from the input conveyor 404 to the intermediate conveyor 432 is configured to operate at a synchronous 1:1 position with a master encoder 444 (see FIG. 30). Such phasing of the input conveyor 404 may accommodate the largest-width printed product 26 in a particular production or binding run.

As previously mentioned, the intermediate conveyor 432 is operable to provide a coarse adjustment of the custom trim size for each printed product 26. The largest-width printed product 26 in a particular production or binding run is passed through the intermediate conveyor 432, without slowing or adjusting the position or phasing of the printed product 26 relative to the input conveyor 404. The intermediate conveyor 432 is also configured to operate at a synchronous 1:1 position with the master encoder 444. Such a "base" motion may be achieved utilizing a gearing arrangement or a continuously-running cam (not shown). However, printed products 26 having a width less than that of the largest-width printed product 26 in the production or binding run may have an index or cam cycle layered on the base motion to slow or adjust the position or phasing of the printed product 26 relative to the input conveyor 404. Before a particular printed product 26 is transferred to the intermediate conveyor 432, the distance or amount of the layered motion associated with that particular printed product 26 is transferred from the higher level controller 67 (see FIG. 30) to the controller 440 which, in turn, triggers the actuator 436 to drive the conveyor 432 accordingly. The distance or amount of the layered motion imparted by the intermediate conveyor 432 may be about 15 mm or less. Alternatively, the intermediate conveyor 432 may be configured to provide more or less than about 15 mm of layered motion.

From the intermediate conveyor 432, the printed product 26 to be trimmed passes beneath a blade 452, and is transferred to the output conveyor 408 (see FIG. 16). Before the leading edge 30 of the untrimmed printed product 26*a* is received by the output conveyor 408, the higher level controller 67 associates the incoming untrimmed printed product 26*a* with a particular size specification or custom trim size, and outputs a signal to the controller 428 which, in turn, triggers the actuator 424 to drive the output conveyor 408 an incremental distance D5 after the leading edge 30 of the first untrimmed printed product 26*a* is detected by the sensor 426, according to that particular custom trim size (see FIG. 17). In this manner, the output conveyor 408 provides a "fine" adjustment of the custom trim size for each printed product 26. When the leading edge 30 of the first untrimmed printed product 26*a* is positioned the distance D5 from the line-of-sight of the sensor 426, the controller 428 signals the actuator 424 to stop the output conveyor 408 to allow the blade 452 to trim a margin 58 from the minor dimension of the printed product 26*a* according to the particular desired custom trim size.

The adjustable trimming assembly 400 is configured to provide a book-to-book trim variability of about 25 mm. In other words, the maximum difference in custom trim sizes that the assembly 400 is configured to accommodate, from one printed product to another, is 25 mm. An adjustment spanning the entire range of variability (i.e., 25 mm) by the adjustable trimming assembly 400 may take about 20 ms, and such variability may be accomplished at an operational speed of the adjustable trimming assembly 400 of about 340 books or printed products per minute. Alternatively, the assembly 400 may be configured to provide a book-to-book trim variability more (e.g., about 40 mm) or less (e.g., about 20 mm) than about 25 mm. If configured to provide a book-to-book trim variability more than about 25 mm, the adjustable trimming assembly 400 may require more time to make such an adjustment between consecutive printed products 26. However, if configured to provide a book-to-book trim variability less than about 25 mm, the adjustable trimming assembly 400 may function at higher operational speeds (e.g., up to 700 books or printed products per minute).

Figure 19:
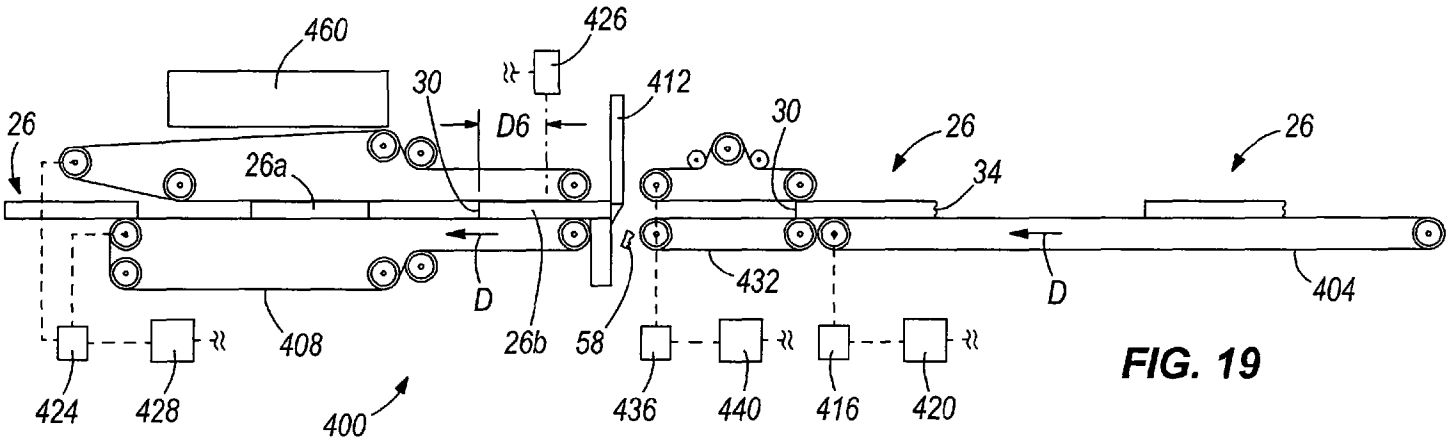
FIG. 19 is the schematic side view of the adjustable trimming assembly of FIG. 16, illustrating the second piece of printed media being trimmed in the second trimming position, according to an exemplary embodiment.

After the margin 58 is trimmed from the minor dimension of the printed product 26*a*, the controller 428 signals the actuator 424 to resume driving the output conveyor 408 to transfer the now trimmed product 26*a* to a location corresponding with a head and foot trim assembly 460 (similar to the adjustable trimming assembly 74 schematically illustrated in FIGS. 3*a* and 3*b*; see also FIG. 19). The head and foot trim assembly 460, as previously described, trims respective margins (not shown) from the head and the foot of each of the printed products 26. From the head and foot trim assembly 460, the fully trimmed printed products are again accelerated by the output conveyor 408 toward the exit of the adjustable trimming assembly 400.

The same process is repeated for the subsequent printed product 26*b* on the input conveyor 404. In one instance, the product 26*b* might have a specified width greater than the width of the preceding product 26*a* (see FIG. 18). To accommodate this custom trim size, the higher level controller 67 associates the incoming untrimmed printed product 26*b* with its particular custom trim size, and outputs a signal to the controller 428 which, in turn, triggers the actuator 424 to drive the output conveyor 408 an incremental distance D6 after the leading edge 30 of the untrimmed printed product 26*b* is detected by the sensor 426, according to that particular custom trim size. When the leading edge 30 of the untrimmed printed product 26*b* is positioned the distance D6 from the line-of-sight of the sensor 426, the controller 428 signals the actuator 424 to stop the output conveyor 408 to allow the blade 452 to trim the margin 58 from the minor dimension of the printed product 26*b* according to its particular desired custom trim size (see FIG. 19).

This process may be repeated for all of the printed products 26 in a particular production run, thereby allowing each printed product 26 trimmed during the production run to receive a custom trim size. As discussed above, conventional trimmers may only be manually adjusted between production runs, such that differently-sized printed products may only be made during separate production runs. The adjustable trimming assembly 400 allows "on the fly" adjustment of the trim size of the printed products 26 during the same production run.

In addition to the functionality of the higher level controller 67, the actuator 424, the controller 428, and the output conveyor 408 described above, the adjustable trimming assembly 400 may include dual sensors 426, spaced along the length of the leading edge 30 of the untrimmed printed products 26, to detect the leading edge 30 of the untrimmed printed products 26 near the head and the foot of each printed product 26 to determine the skew of the printed product 26 on the conveyor 408. Using this "skew" data, the higher level controller 67 may determine whether the printed product 26 should be accepted or rejected. The skew value is calculated as the difference in position from the head to the foot of the printed product 26 as the printed product 26 is detected by the sensors 426. The current skew value is compared to a tolerance setting to determine whether the product 26 should be accepted or rejected. A bit corresponding with the acceptance or rejection of the product 26 is transmitted to an existing higher-level controller (e.g., controller 464; see FIG. 30) for data collection.

The adjustable trimming assembly 400 may also determine skew tendency of the printed products 26. In one embodiment, skew tendency may be determined by taking a rolling average of the printed products 26 entering the assembly 400. The value can be calculated in the controller 464 from a value transmitted from the controller 428. Alternatively, the skew tendency may be determined by other methods known in the art.

The adjustable trimming assembly 400 may also determine a correction amount of the printed products 26. The correction amount, also referred to position deviation, is the calculated correction amount needed to be applied to a particular printed product 26 for proper face-cut trimming. As the leading edge 30 of each of the printed products 26 passes the dual sensors 426, the measurements of the sensors 426 are averaged, and a value is calculated reflecting the difference between the actual position of the printed product 26 and the desired position of the product 26. The correction amount can be compared to a tolerance setting to determine whether a correction should or should not be supplied. The correction amount value can also be transmitted to the controller 464 for data collection.

The adjustable trimming assembly 400 may also determine a correction tendency of the printed products. In one embodiment, correction tendency may be determined by taking a rolling average of the printed products entering the assembly 400. This value can be calculated in the controller 464 from a value transmitted from the controller 428. Alternatively, the correction tendency may be determined by other methods known in the art.

The adjustable trimming assembly 400 may also determine the measured or actual length of the leading edge 30 of each of the printed products 26. As the leading edge 30 or spine of the printed product 26 passes the sensors 426, the sensors record two length values, averages them, and stores the averaged value as the lead-sensor position. After a trimmed product 26 is moved away from the face knife or blade 452, the trailing edge 34 of the product 452 passes the sensors 426. The two values are averaged, and the average value is stored as the trail-sensor position. The difference between the trail and lead sensor positions is the measured or actual length. This value is transmitted to the controller 464 for data collection.

The adjustable trimming assembly 400 may also determine a measured length tendency of the printed products 26. In one embodiment, measured length tendency may be determined by taking a rolling average of the printed products 26 entering the assembly 400. This value can be calculated in the controller 464 from a value transmitted from the controller 428. Alternatively, the measured length tendency may be determined by other methods known in the art.

The adjustable trimming assembly 400 may also determine a product width deviation of the printed products 26. The product width deviation is the calculated difference between the measured length and the desired product length. This value can be compared to a tolerance setting to determine whether the product 26 is acceptable or should be rejected. This value also can be transmitted to the controller 464 for data collection.

The adjustable trimming assembly 400 may also determine a product width deviation tendency. In one embodiment, width deviation tendency may be determined by taking a rolling average of the printed products 26 entering the assembly 400. This value can be calculated in the controller 464 from a value transmitted from the controller 428. Alternatively, the product width deviation tendency may be determined by other methods known in the art.

The adjustable trimming assembly 400 may also be capable of allowing an operator to enable or disable trim correction on the fly as the assembly 400 is running.

The adjustable trimming assembly 400 may also be operable such that the book-to-book stopping motion of the output conveyor 408 converts to continuous motion after any number of empty chain slots. The output conveyor 408 may revert to book-to-book stopping when the next book or printed product is detected by the sensors 426, or when it is known (e.g., by the higher level controller 67) that a book or printed product is positioned in a particular chain slot.

The adjustable trimming assembly 400 may also be capable of allowing an operator to modify the entered product size and the tolerance settings on the fly using an operator interface during production.

With reference to FIGS. 20-23, yet another construction of an adjustable trimming assembly 214 is shown incorporated into a portion of a trimmer (e.g., a HARRIS-GOSS style trimmer), comprising an input conveyor 222 which defines a path along which printed media or printed products 26 are conveyed in the direction of arrow C, a blade 226 positioned downstream of the input conveyor 222, with respect to the direction of arrow C, an adjustable stop assembly 230 positioned downstream of the blade 226, with respect to the direction of arrow C, and a controller 234 operably coupled to the adjustable stop assembly 230. Like the adjustable trimming assemblies 46, 70, 74, 182, 300, 400 described above, the adjustable trimming assembly 214 may interface with a higher level controller (e.g., the controller 67; see FIG. 28) programmed with the custom trim size data for each of the untrimmed printed products 26 in a particular production or binding run.

The adjustable trimming assembly 214 of FIGS. 20-23 is incorporated into a "flying cut" trimmer, such that the blade 226 is coupled to a housing 238 that reciprocates in the direction of arrow C as the blade 226 moves up and down to trim margins 58 from the printed products 26. A portion of the adjustable stop assembly 230 also reciprocates in the direction of arrow C with the blade housing 238, such that at any particular time when a piece of printed media or a printed product 26 is being trimmed, the blade housing 238, the printed product 26 being trimmed, and a portion of the adjustable stop assembly 230 move in unison in the direction of arrow C. The operation of the adjustable trimming assembly 214 is described in more detail below.

With reference to FIGS. 20-23, the adjustable stop assembly 230 includes a carriage 242 having substantially vertically-oriented stops 246 (only one of which is shown) and a first actuator 250 coupled to the stops 246. The adjustable stop assembly 230 also includes a track 254 having the carriage 242 mounted thereon, and a second actuator 258 coupled to the carriage 242. The controller 234 is operably coupled to the first and second actuators 250, 258.

As shown in FIGS. 20-23, the first actuator 250 can include a servo motor 264, a power transmission mechanism 266 coupled to the servo motor 264, and links 270 (only one of which is shown) coupling the power transmission mechanism 266 and the stops 246. The power transmission mechanism 266 includes offset output shafts 274 (only one of which is shown) to which the links 270 are pivotably coupled. Although not shown in FIGS. 20-23, the carriage 242 includes additional structure to maintain the stops 246 in a substantially vertical orientation while allowing the stops 246 to move up and down (i.e., transverse to the direction of arrow C). The links 270, therefore, transfer the circular motion of the offset output shafts 274 to substantially vertical motion of the stops 246. The track 254 includes a belt assembly (not shown) to which the carriage 242 is coupled. The second actuator 258 (e.g., a servo motor) is coupled to the carriage 242 via the belt assembly. The second actuator 258 is configured to drive the belt assembly, and therefore the carriage 242, in a direction parallel with arrow C when prompted by the controller 234.

During operation of the trimmer incorporating the adjustable trimming assembly 214, a first untrimmed printed product 26*a* is pushed from the input conveyor 222 by a pusher 278 such that the leading edge 30 of the product 26*a* abuts the stops 246. Before the leading edge 30 of the untrimmed printed product 26*a* abuts the stops 246, the higher level controller 67 associates the incoming untrimmed printed product 26*a* with a particular custom trim size, and outputs a signal to the controller 234 which, in turn, triggers the second actuator 258 to adjust the distance between the stops 246 and the blade 226 according to that particular custom trim size. In this manner, the controller 234 prompts the second actuator 258 to move the stops 246 (either backwards or forwards along the path) to a first distance D7 from the blade 226 to yield the custom trim size (see FIG. 20).

The adjustable trimming assembly 214 is configured to provide a book-to-book trim variability of about 25 mm. In other words, the maximum difference in custom trim sizes that the assembly 214 is configured to accommodate, from one printed product to another, is 25 mm. An adjustment spanning the entire range of variability (i.e., 25 mm) by the adjustable trimming assembly 214 may take about 20 ms, and such variability may be accomplished at an operational speed of the adjustable trimming assembly 214 of about 340 books or printed products per minute. Alternatively, the assembly 214 may be configured to provide a book-to-book trim variability more (e.g., about 40 mm) or less (e.g., about 20 mm) than about 25 mm. If configured to provide a book-to-book trim variability more than about 25 mm, the adjustable trimming assembly 214 may require more time to make such an adjustment between consecutive printed products 26. However, if configured to provide a book-to-book trim variability less than about 25 mm, the adjustable trimming assembly 214 may function at higher operational speeds (e.g., up to 700 books or printed products per minute).

Figure 20:
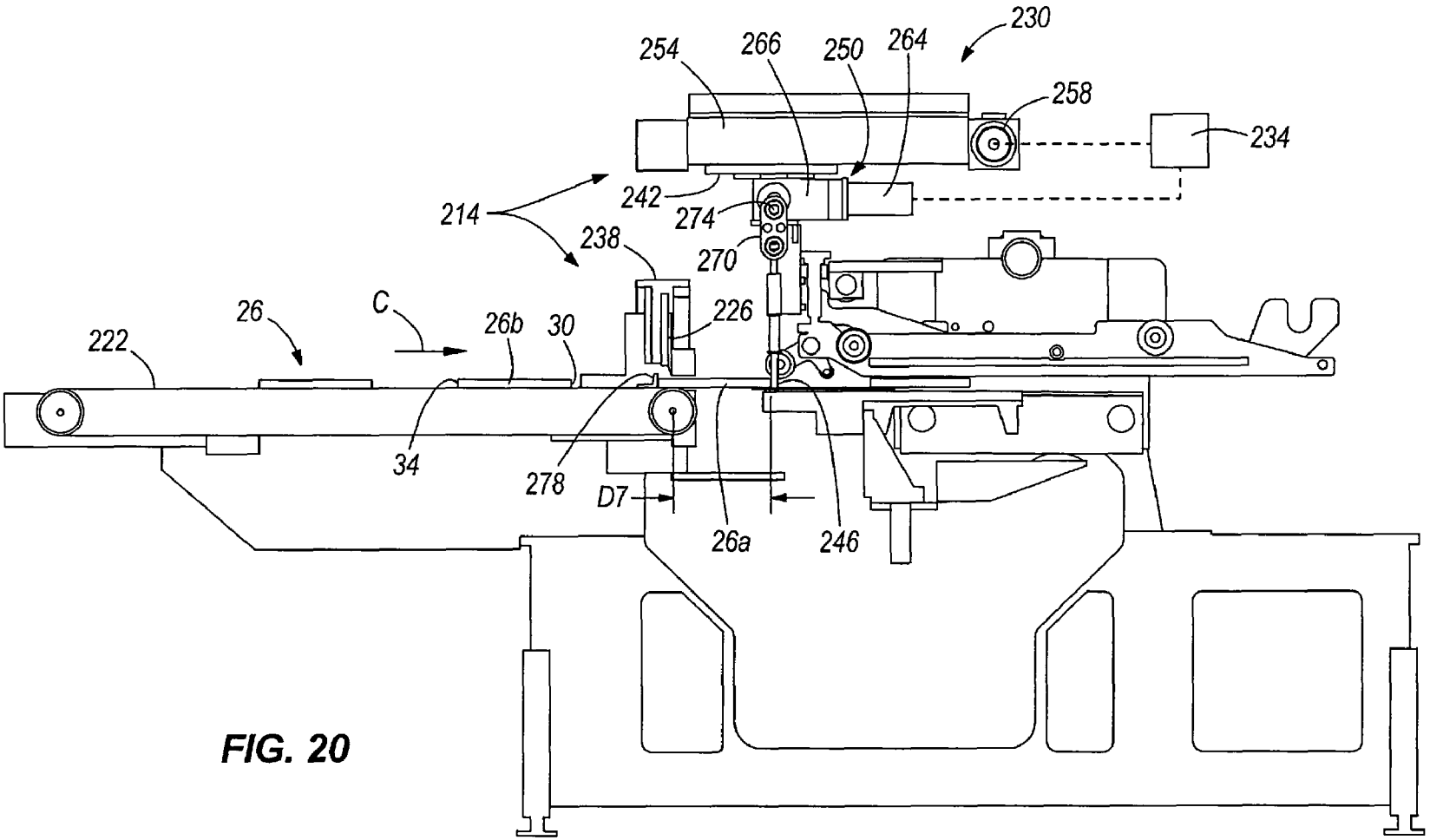
FIG. 20 is a side view of a portion of a trimmer incorporating a sixth construction of an adjustable trimming assembly, illustrating a first piece of printed media being conveyed to a first trimming position, according to an exemplary embodiment.
Figure 21:
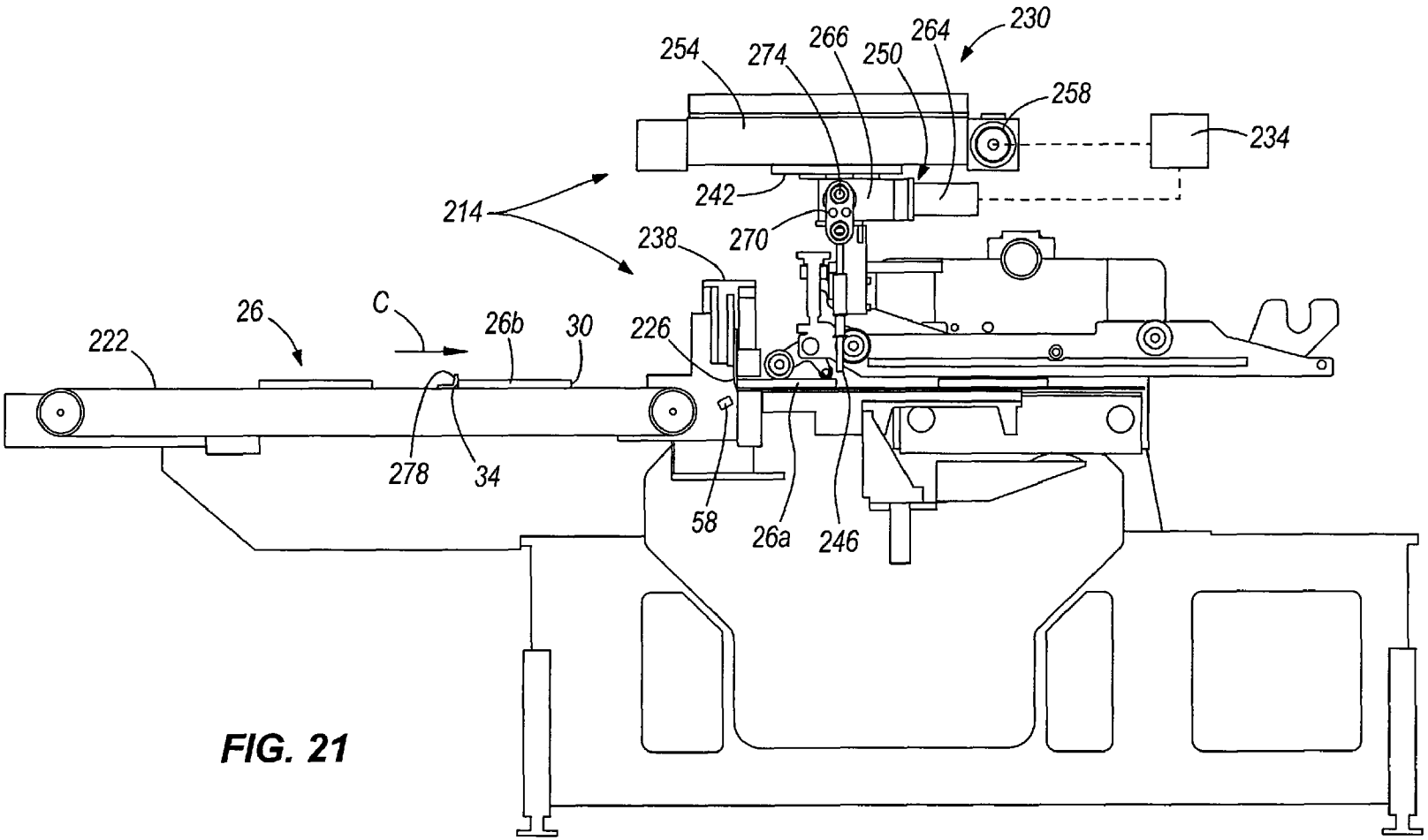
FIG. 21 is a side view of the adjustable trimming assembly of FIG. 20, illustrating the first piece of printed media being trimmed in the first trimming position, according to an exemplary embodiment.
Figure 22:
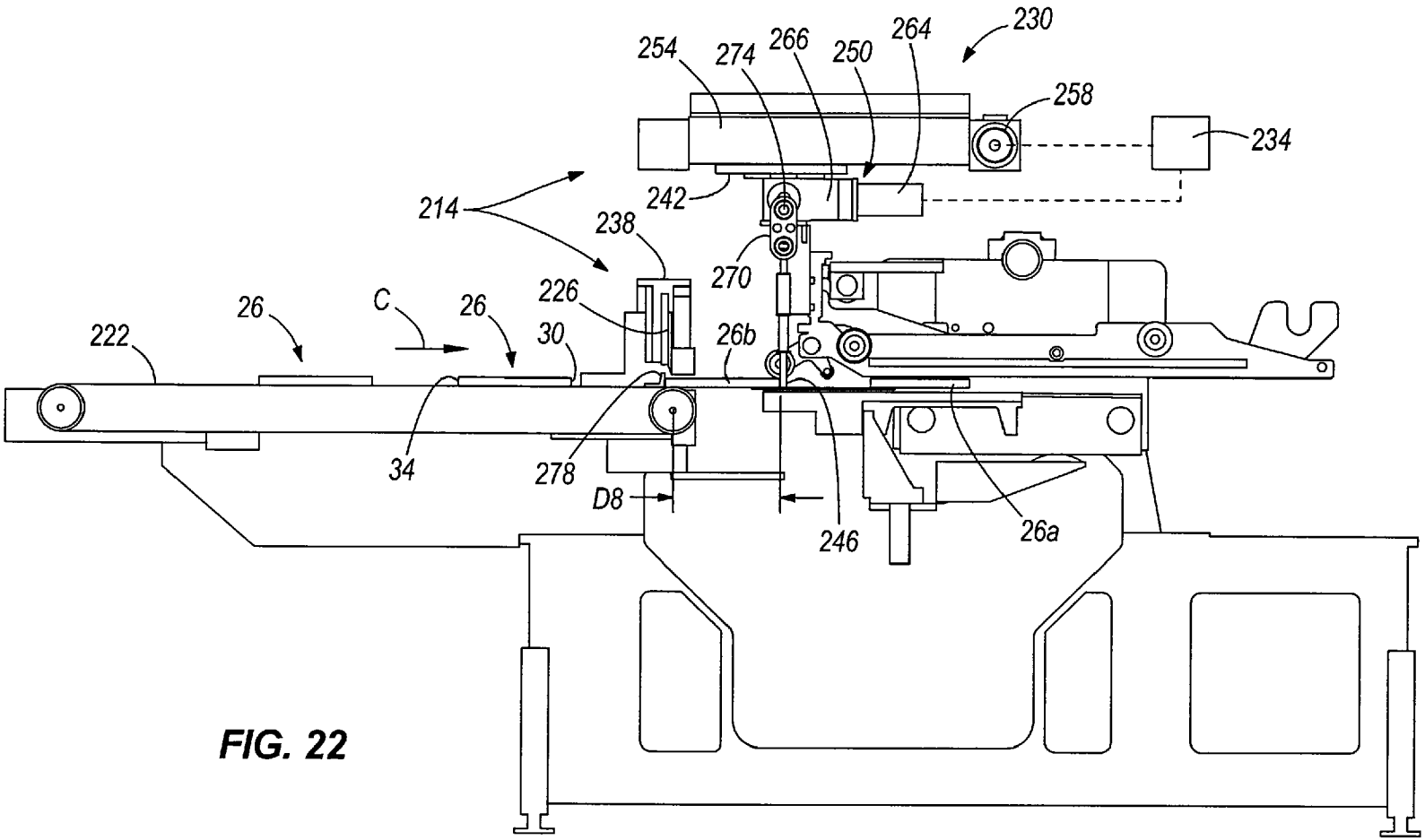
FIG. 22 is a side view of the adjustable trimming assembly of FIG. 20, illustrating a second piece of printed media being conveyed to a second trimming position, according to an exemplary embodiment.
Figure 23:
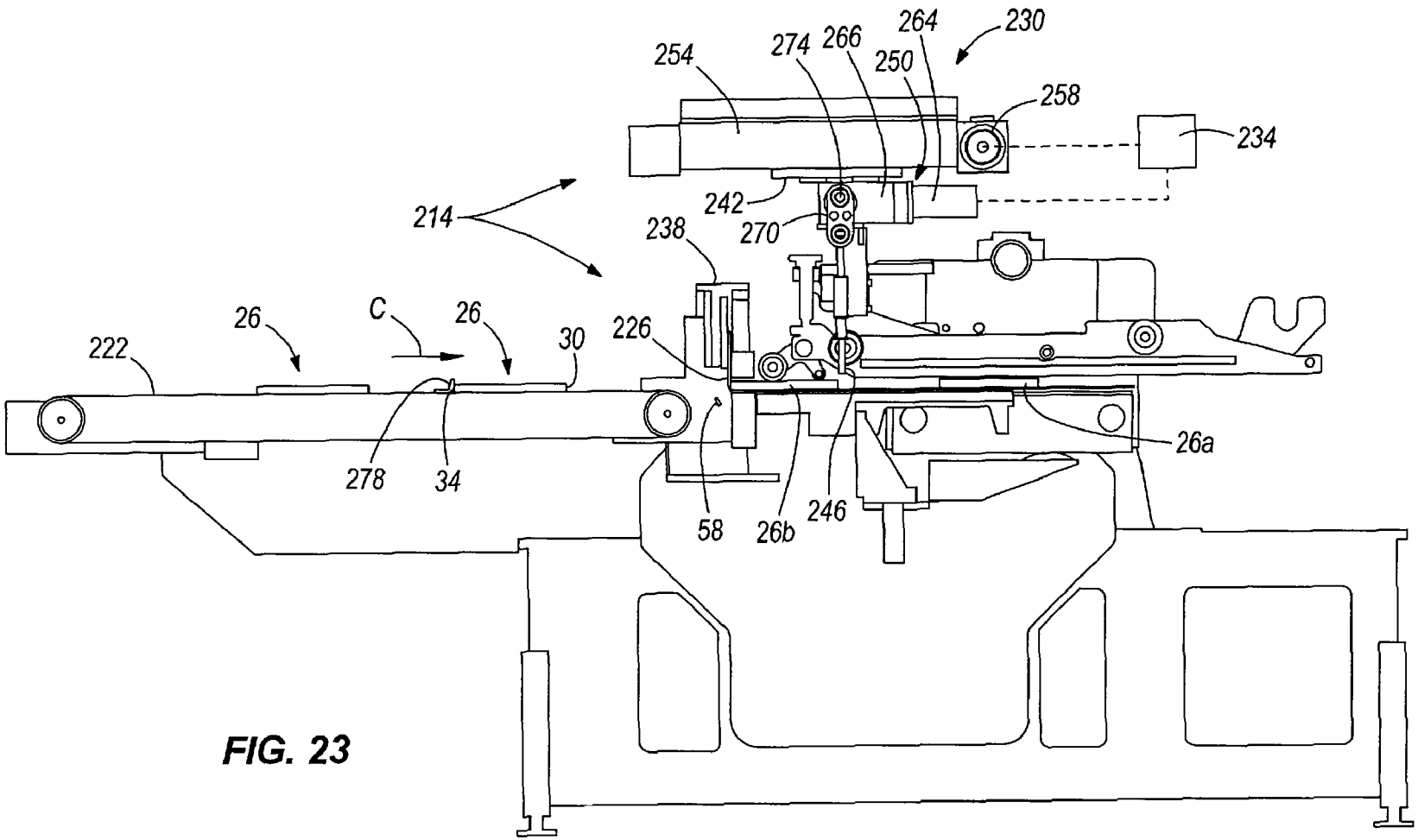
FIG. 23 is a side view of the adjustable trimming assembly of FIG. 20, illustrating the second piece of printed media being trimmed in the second trimming position, according to an exemplary embodiment.

Although not shown in FIG. 20, the trimmer includes a retractable clamp that maintains the product's position relative to the blade 226 after the leading edge 30 of the product 26*a* abuts the stops 246, such that the stops 246 may subsequently be retracted (i.e., moved upwardly with respect to the path; see FIG. 21). To retract the stops 246, the controller 234 signals the servo motor 264 to drive the power transmission mechanism 266, causing rotation of the offset output shafts 266 from a "6 o'clock" position to a "12 o'clock" position. As previously described, the links 270 transfer the circular motion of the shafts 266 to substantially vertical motion of the stops 246; the stops 246 are fully retracted when the shafts 266 reach the "12 o'clock" position. After the stops 246 are fully retracted, the blade 226 trims the margin 58 from the minor dimension of the printed product 26*a*, which is then carried away by an output conveyor (not shown).

As described above, the process for trimming the margin 58 from the product 26*a* occurs while the blade housing 238, the stops 246, the retractable clamp, and the product 26*a* move in unison as they reciprocate in the direction of arrow C. After the product 26*a* is trimmed (e.g., as in FIG. 21), the blade housing 238, the stops 246, and the retractable clamp reciprocate in unison in the direction opposite arrow C, back to the position shown in FIG. 20, assuming that the next product 26*b* to be trimmed has the same custom trim size as the product 26*a*. While the carriage 242 reciprocates in the direction opposite arrow C, the controller 234 signals the actuator 246 to drive the power transmission mechanism 266 to rotate the shafts 274 to their "6 o'clock" position to fully extend the stops 246.

The same process is repeated for the subsequent printed product 26*b* on the input conveyor 222. In one instance, the product 26*b* might have a specified width greater than the width of the preceding product 26*a*. To accommodate this custom trim size, the controller 234 prompts the actuator 250 to move the stops 246 (again, either backwards or forwards along the path) to a second distance D8 from the blade 226 before the leading edge 30 of the product 26*b* abuts the stops 246 (see FIG. 22). After the stops 246 are moved, the leading edge 30 of the product 26*b* abuts the stops 246, the retractable clamp secures the product 26*b* in position relative to the blade 226, the stops 246 are retracted (see FIG. 23), and the blade 226 trims the margin 58 from the minor dimension of the product 26*b*. After the margin 58 is trimmed from the product 26*b*, the product 26*b* is carried away by the output conveyor. This process may be repeated for all of the printed products 26 in a particular production run, thereby allowing each printed product 26 trimmed during the production run to receive a custom trim size. As discussed above, conventional trimmers may only be manually adjusted between production runs, such that differently-sized printed products may only be made during separate production runs. The adjustable trimming assembly 214 allows "on the fly" adjustment of the trim size of the printed products 26 during the same production run.

In other embodiments, the adjustable stop assembly 230 may be coupled with the blade housing 238 such that the adjustable stop assembly 230 moves with the blade housing 238 and is adjustable to vary the distance between the blade 226 and the stops 246 utilizing any of the actuators 62 shown in FIGS. 5-11.

With reference to FIGS. 24-27, another construction of an adjustable trimming assembly 500 is shown incorporated into a portion of a HARRIS-GOSS style trimmer, comprising an input conveyor 504 which defines a path along which printed media or printed products 26 are conveyed in the direction of arrow E, a blade 508 positioned downstream of the input conveyor 504, with respect to the direction of arrow E, an adjustable stop assembly 512 positioned downstream of the blade 508, with respect to the direction of arrow E, and a controller 516 operably coupled to the adjustable stop assembly 512. Like the adjustable trimming assemblies 46, 70, 74, 182, 214, 300, 400 described above, the adjustable trimming assembly 500 may interface with a higher level controller (e.g., the controller 67; see FIG. 28) programmed with the custom trim size data for each of the untrimmed printed products 26 in a particular production or binding run.

Like the assembly 214 of FIGS. 20-23, the adjustable trimming assembly 500 is incorporated into a "flying cut" trimmer, such that the blade 508 is coupled to a housing 520 that reciprocates in the direction of arrow E as the blade 508 moves up and down to trim margins 58 from the printed products 26. The adjustable stop assembly 512, however, does not reciprocate in the direction of arrow E with the blade housing 520. At any particular time when a piece of printed media or a printed product 26 is being trimmed, the blade housing 520 and the printed product 26 being trimmed move in unison in the direction of arrow E. The operation of the adjustable trimming assembly 500 is described in more detail below.

With reference to FIGS. 24-27, the adjustable stop assembly 512 is configured similarly to the schematic illustrated in FIGS. 8-11. Specifically, with reference to FIG. 24, the adjustable stop assembly 512 includes dual lugged chains 524 (only one of which is shown) operably coupled to an actuator 528. Each of the chains 524 includes an upwardly-extending stop 526, and each of the chains 524 is wrapped around a pair of spaced pulleys 530*a*, 530*b*. In the illustrated construction of the assembly 512, the actuator 528 is configured as a servo motor 532 attached to a speed-reducing gearbox or a power transmission mechanism 536. The power transmission mechanism 536 includes offset output shafts (not shown) to which the respective pulleys 530*a*, 530*b* are coupled via respective belts or chains 524.

During operation of the trimmer incorporating the adjustable trimming assembly 500, a first untrimmed printed product 26*a* is pushed from the input conveyor 504 by a pusher 544 such that the leading edge 30 of the product 26*a* abuts the stops 526. Before the leading edge 30 of the untrimmed printed product 26*a* abuts the stops 526, the higher level controller 67 associates the incoming untrimmed printed product 26*a* with a particular custom trim size, and outputs a signal to the controller 516 which, in turn, triggers the actuator 528 to adjust the distance between the stops 526 and the blade 508 according to that particular custom trim size. In this manner, the controller 516 prompts the actuator 528 to move the stops 526 (either backwards or forwards along the path) to a first distance D7 from the blade 508 to yield the custom trim size (see FIG. 24).

The adjustable trimming assembly 500 is configured to provide a book-to-book trim variability of about 25 mm. In other words, the maximum difference in custom trim sizes that the assembly 500 is configured to accommodate, from one printed product to another, is 25 mm. An adjustment spanning the entire range of variability (i.e., 25 mm) by the adjustable trimming assembly 500 may take about 20 ms, and such variability may be accomplished at an operational speed of the adjustable trimming assembly 500 of about 340 books or printed products per minute. Alternatively, the assembly 500 may be configured to provide a book-to-book trim variability more (e.g., about 40 mm) or less (e.g., about 20 mm) than about 25 mm. If configured to provide a book-to-book trim variability more than about 25 mm, the adjustable trimming assembly 500 may require more time to make such an adjustment between consecutive printed products 26. However, if configured to provide a book-to-book trim variability less than about 25 mm, the adjustable trimming assembly 500 may function at higher operational speeds (e.g., up to 700 books or printed products per minute).

Figure 24:
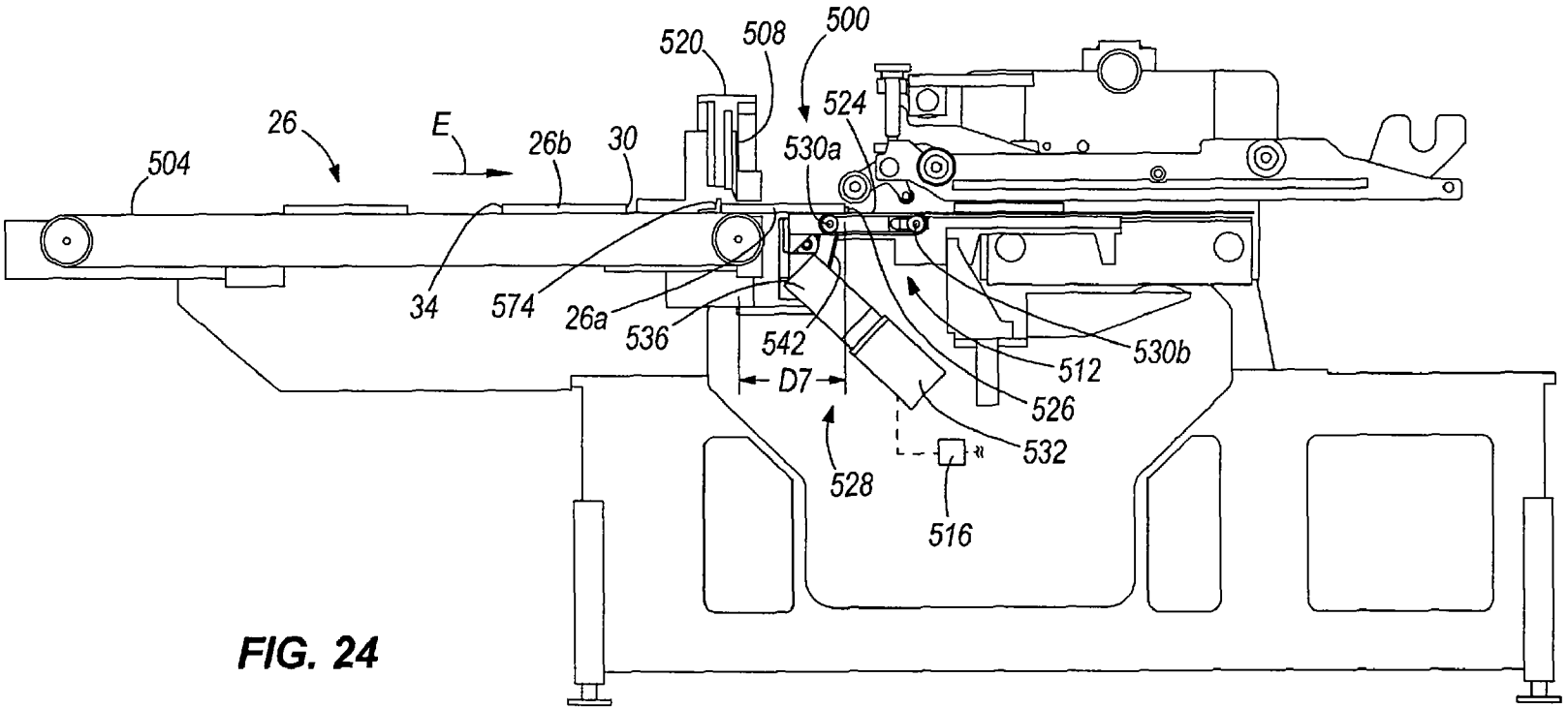
FIG. 24 is a side view of a portion of a trimmer incorporating a seventh construction of an adjustable trimming assembly, illustrating a first piece of printed media being conveyed to a first trimming position, according to an exemplary embodiment.
Figure 25:
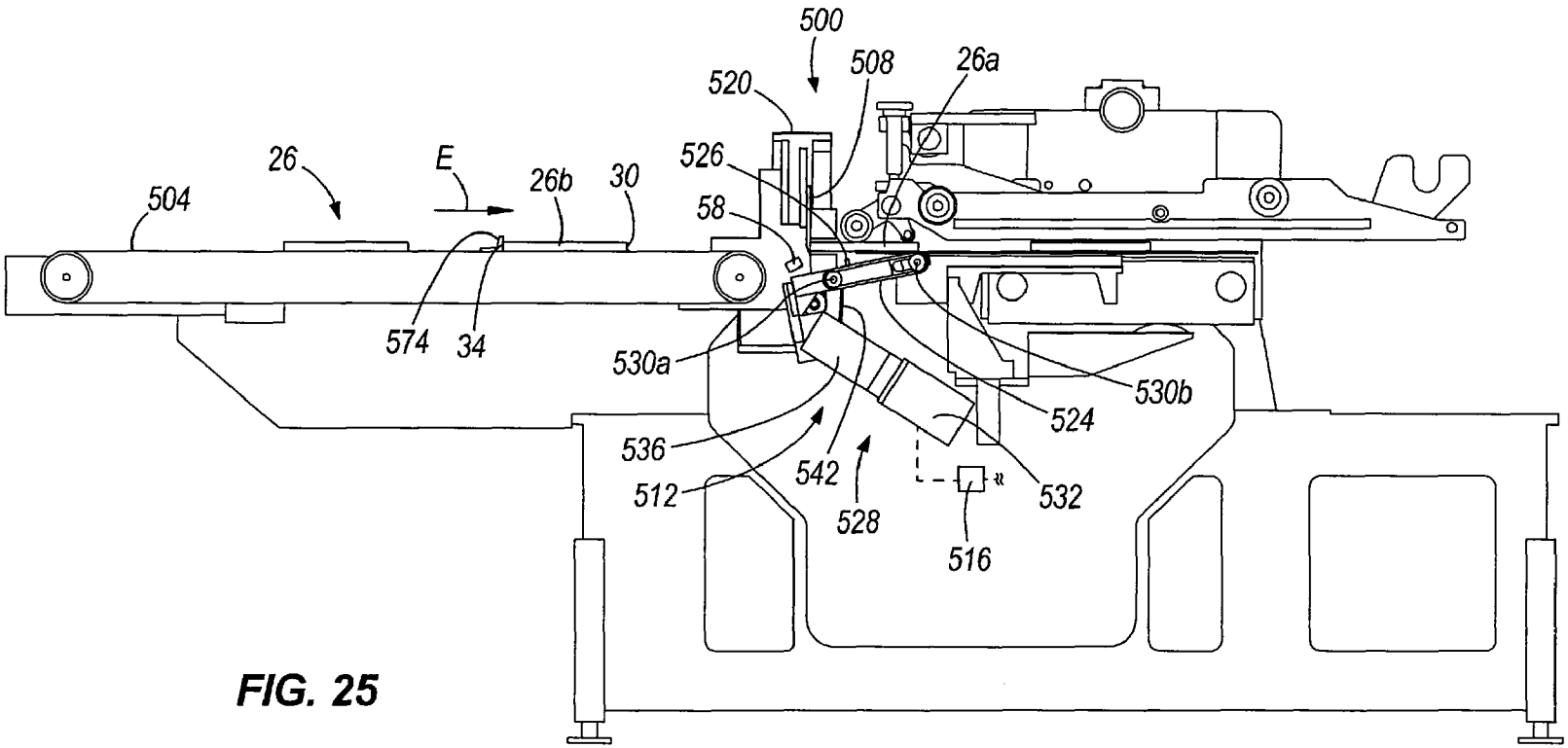
FIG. 25 is a side view of the adjustable trimming assembly of FIG. 24, illustrating the first piece of printed media being trimmed in the first trimming position, according to an exemplary embodiment.
Figure 26:
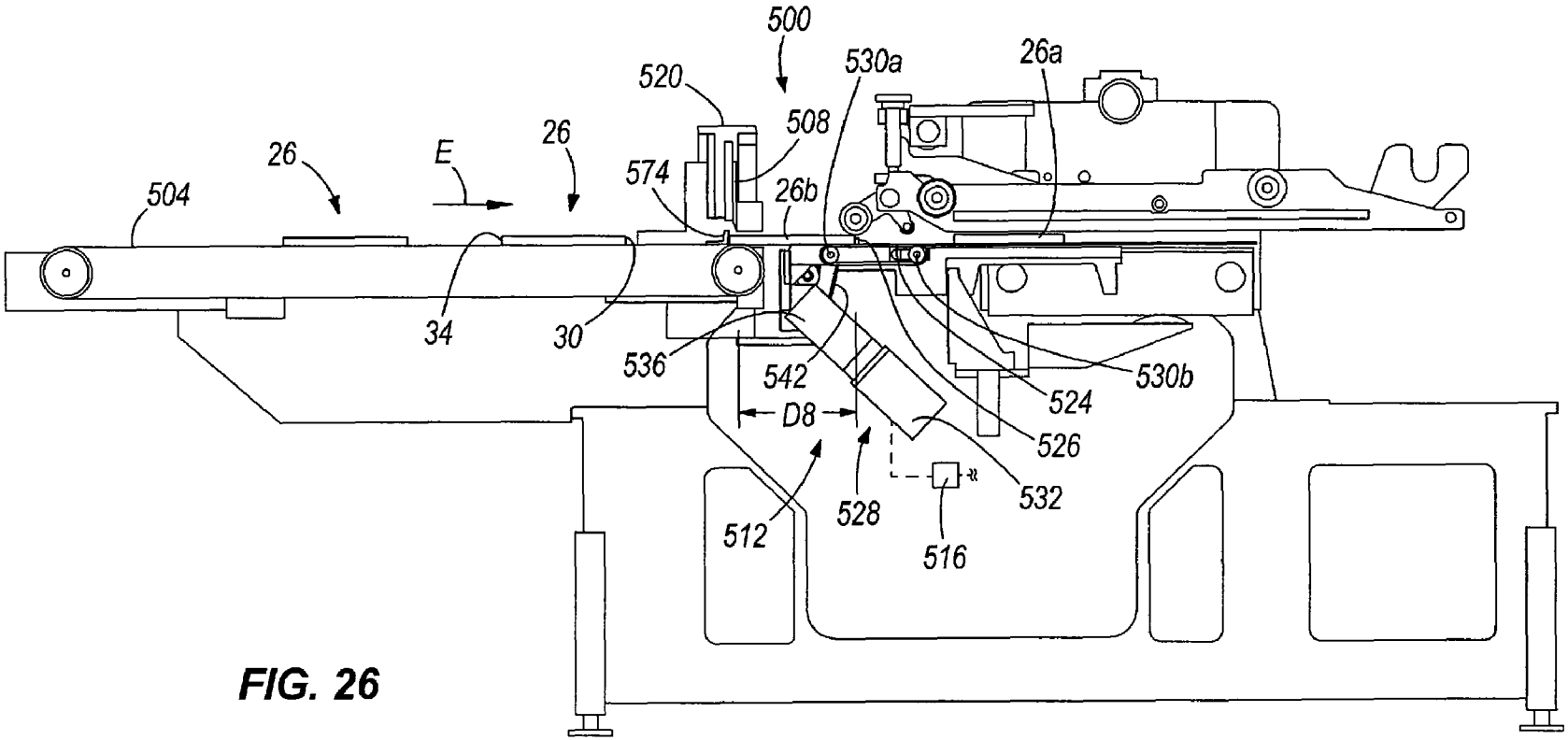
FIG. 26 is a side view of the adjustable trimming assembly of FIG. 24, illustrating a second piece of printed media being conveyed to a second trimming position, according to an exemplary embodiment.
Figure 27:
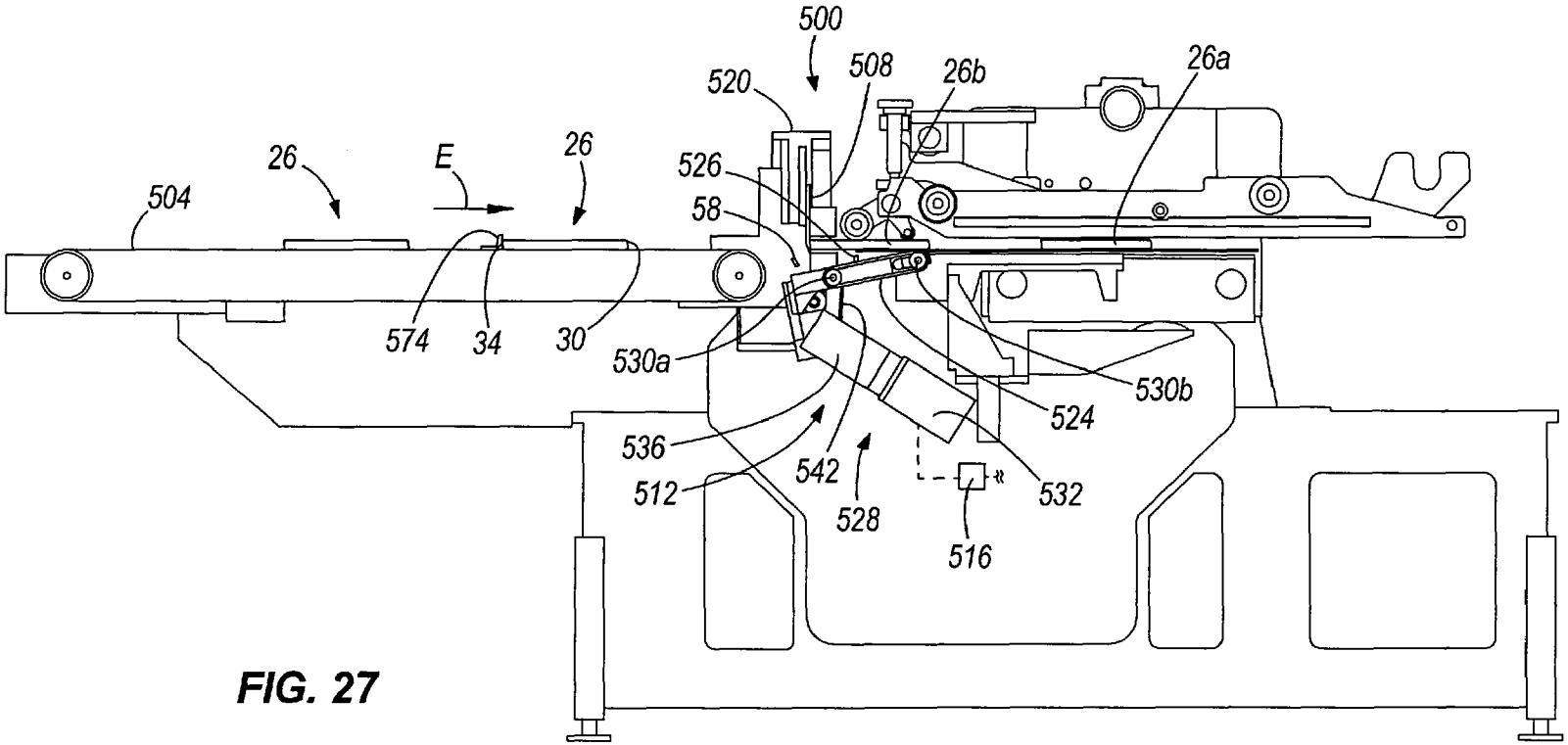
FIG. 27 is a side view of the adjustable trimming assembly of FIG. 24, illustrating the second piece of printed media being trimmed in the second trimming position, according to an exemplary embodiment.

Although not shown in FIG. 24, the trimmer includes a retractable clamp that maintains the product's position relative to the blade 508 after the leading edge 30 of the product 26*a* abuts the stops 526, such that the stops 526 may subsequently be retracted (i.e., moved downwardly with respect to the path; see FIG. 25). To lower the stops 526, the controller 516 or another, separate controller signals another servo motor or like device to downwardly pivot the adjustable stop assembly 512 as shown in FIG. 25. After the stops 526 are fully lowered or displaced from the path indicated by arrow E, the blade 508 trims the margin 58 from the minor dimension of the printed product 26*a*, which is then carried away by an output conveyor (not shown). Alternatively, the adjustable stop assembly 512 may remain stationary, and the servo motor 532 may be activated to move the stops 526 forwardly with the trimmed printed product 26 as the trimmed product is transferred along the path in the direction of arrow E. Upon reaching the pulleys 530*b*, the stops 526 rotate downwardly and away from the path indicated by arrow E about the respective pulleys 530*b*. After the trimmed printed product 26 has passed by the pulleys 530*b*, the servo motor 532 may continue to drive each lugged belt or chain 524 to move the stops 526 in a clockwise loop about the pulleys 530*a* (relative to the orientation of the assembly 512 in FIG. 24) until the stops 526 are positioned in a location corresponding with the custom trim size of the incoming printed product 26. Alternatively, the servo motor 532 may be activated to drive each lugged belt or chain 524 in a reverse direction (i.e., in a counter-clockwise direction around the pulleys 530*b*) to a location corresponding with the custom trim size of the incoming printed product 26.

As described above, the process for trimming the margin 58 from the product 26*a* occurs while the blade housing 520, the retractable clamp, and the product 26*a* move in unison as they reciprocate in the direction of arrow E. After the product 26*a* is trimmed (e.g., as in FIG. 25), the blade housing 520 and the retractable clamp reciprocate in unison in the direction opposite arrow E, back to the position shown in FIG. 24, assuming that the next product 26*b* to be trimmed has the same custom trim size as the product 26*a*. While the blade housing 520 reciprocates in the direction opposite arrow E, the stops 526 are moved into the path indicated by arrow E.

The same process is repeated for the subsequent printed product 26*b* on the input conveyor 504. In one instance, the product 26*b* might have a specified width greater than the width of the preceding product 26*a*. To accommodate this custom trim size, the controller 516 prompts the actuator 528 to move the stops 526 (again, either backwards or forwards along the path) to a second distance D8 from the blade 508 before the leading edge 30 of the product 26*b* abuts the stops 526 (see FIG. 26). After the stops 526 are moved, the leading edge 30 of the product 26*b* abuts the stops 526, the retractable clamp secures the product 26*b* in position relative to the blade 508, the stops 526 are lowered (see FIG. 27), and the blade 508 trims the margin 58 from the minor dimension of the product 26*b*. After the margin 58 is trimmed from the product 26*b*, the product 26*b* is carried away by the output conveyor. This process may be repeated for all of the printed products 26 in a particular production or binding run, thereby allowing each printed product 26 trimmed during the production run to receive a custom trim size. As discussed above, conventional trimmers may only be manually adjusted between production runs, such that differently-sized printed products may only be made during separate production runs. The adjustable trimming assembly 500 allows "on the fly" adjustment of the trim size of the printed products 26 during the same production run.

Figure 28:
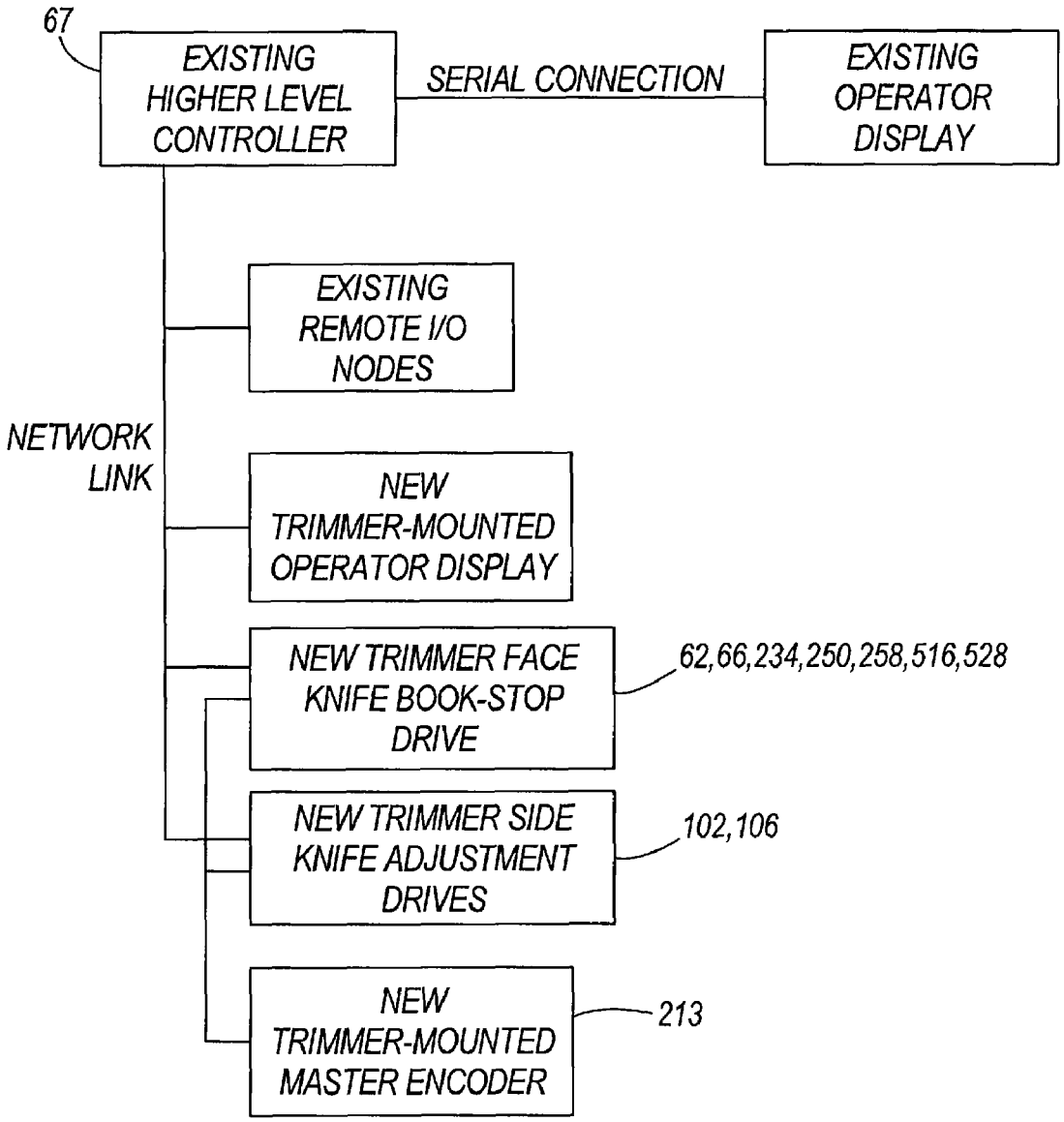
FIG. 28 is a block diagram illustrating the electronic components incorporated with the adjustable trimming assembly of FIGS. 1*a*-3*d* and FIGS. 20-27, according to an exemplary embodiment.

The adjustable trimming assemblies 46, 74, 214, 500 of FIGS. 1*a*, 1*b*, 3*a*, 3*b*, and 20-27 may be incorporated with an existing trimmer, replacing the structure and components used to manually adjust the stops 50, 246, 526 and the blades 94, 98 between production runs. FIG. 28 schematically illustrates the interface of the higher level controller 67 with the respective motion controllers 66, 106, 516 and actuators 62, 102, 250, 258, 528 of the adjustable trimming assemblies 46, 74, 214, 500. A network link, such as a Profibus, ProfiNet, or Ethernet may be utilized to communicate the higher level controller 67 with the respective motion controllers 66, 106, 516 and actuators 62, 102, 250, 258, 528 of the adjustable trimming assemblies 46, 74, 214, 500. Alternatively, the adjustable trimming assemblies 46, 74, 214 may be included as original equipment from the trimmer manufacturer.

Figure 29:
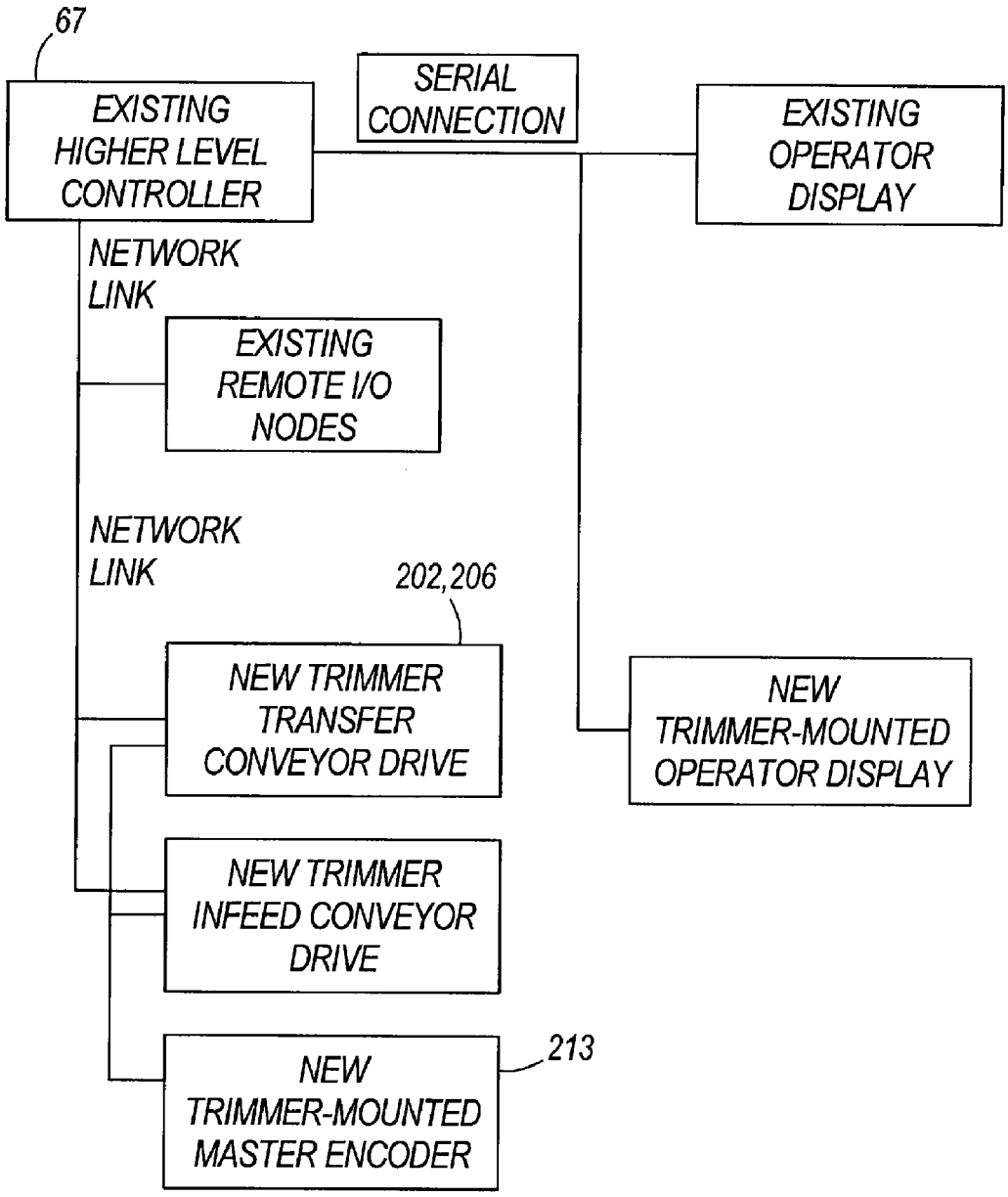
FIG. 29 is a block diagram illustrating the electronic components incorporated with the adjustable trimming assembly of FIGS. 12-15, according to an exemplary embodiment.

Likewise, the adjustable trimming assembly 182 of FIGS. 12-15 may be incorporated with an existing trimmer, replacing the structure and/or components used to manually adjust the trim size between production runs. FIG. 29 schematically illustrates the interface of the finishing control system 211, the actuator 202, and the controller 206 of the adjustable trimming assembly 182 with the existing control system of a trimmer. A network link, such as a Profibus, ProfiNet, or Ethernet may be utilized to communicate the higher level controller 67, the actuator 202, and the controller 206. Alternatively, the adjustable trimming assembly 182 may be included as original equipment from the trimmer manufacturer.

Figure 30:
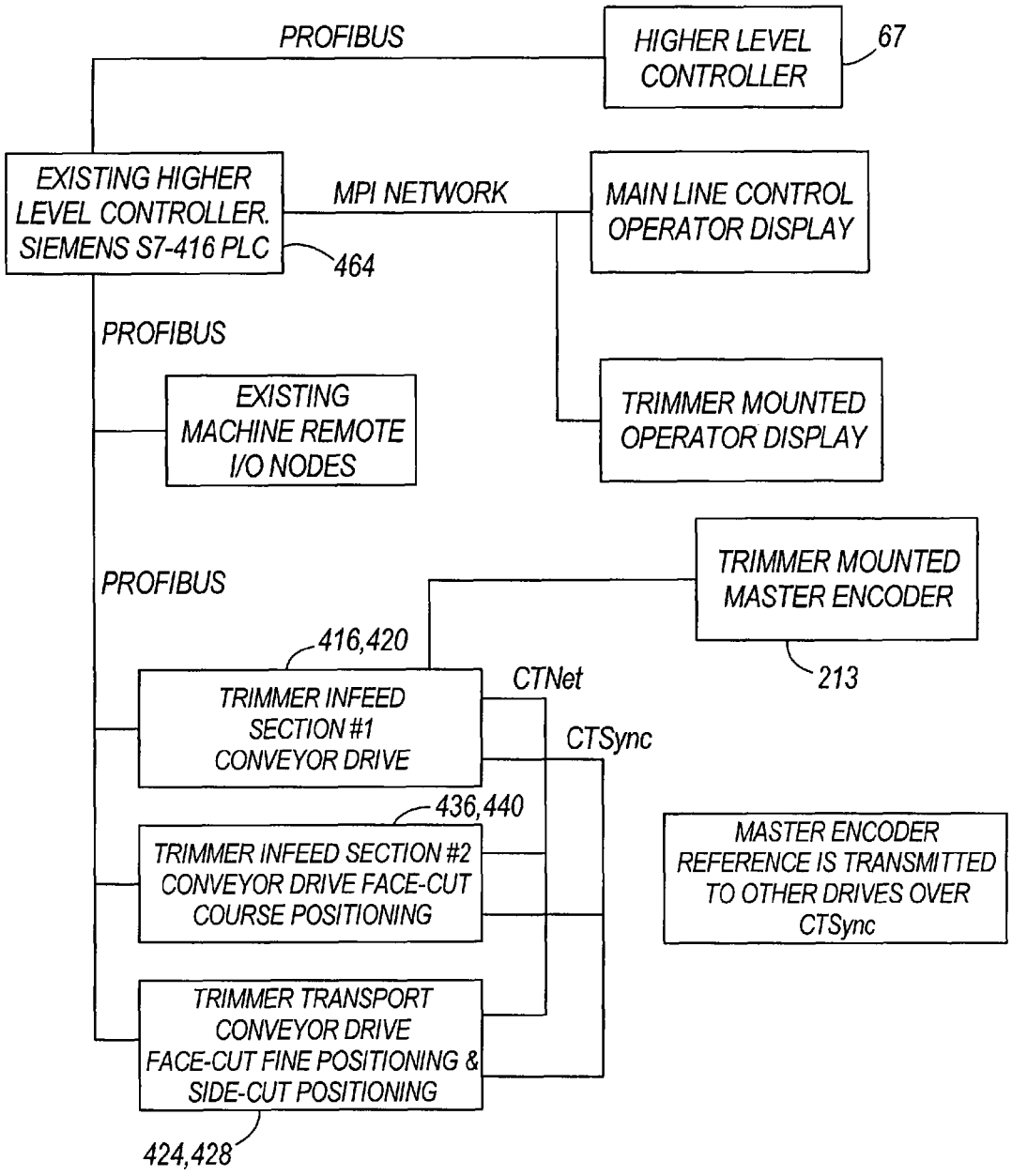
FIG. 30 is a block diagram illustrating the electronic components incorporated with the adjustable trimming assembly of FIGS. 16-19, according to an exemplary embodiment.

The adjustable trimming assembly 400 of FIGS. 16-19 may be incorporated with an existing trimmer, replacing the structure and/or components used to manually adjust the trim size between production runs. FIG. 30 schematically illustrates the interface of the higher level controller 67, the actuators 416, 424, 436, and the motion controllers 420, 428, 440 of the adjustable trimming assembly 400 with an existing control system of a trimmer. A network link, such as a Profibus, ProfiNet, or Ethernet may be utilized to communicate the higher level controller 67 with the actuators 416, 424, 436 and the motion controllers 420, 428, 440. Alternatively, the adjustable trimming assembly 400 may be included as original equipment from the trimmer manufacturer.

Any of the trimmers incorporating the adjustable trimming assemblies 46, 74, 300, 182, 214, 400, 500 illustrated in FIGS. 1*a*-3*d* and 12-27 may receive multiple "streams" of printed products from one or multiple binding lines binding printed products of different sizes, print lines, or other lines providing printed product. Gripper devices, or other devices known in the art, may be utilized to facilitate merger of the streams of printed products from the different binding lines toward the single trimmer utilizing the respective trimming assemblies 46, 74, 300, 182, 214, 400, 500.

Figure 31:
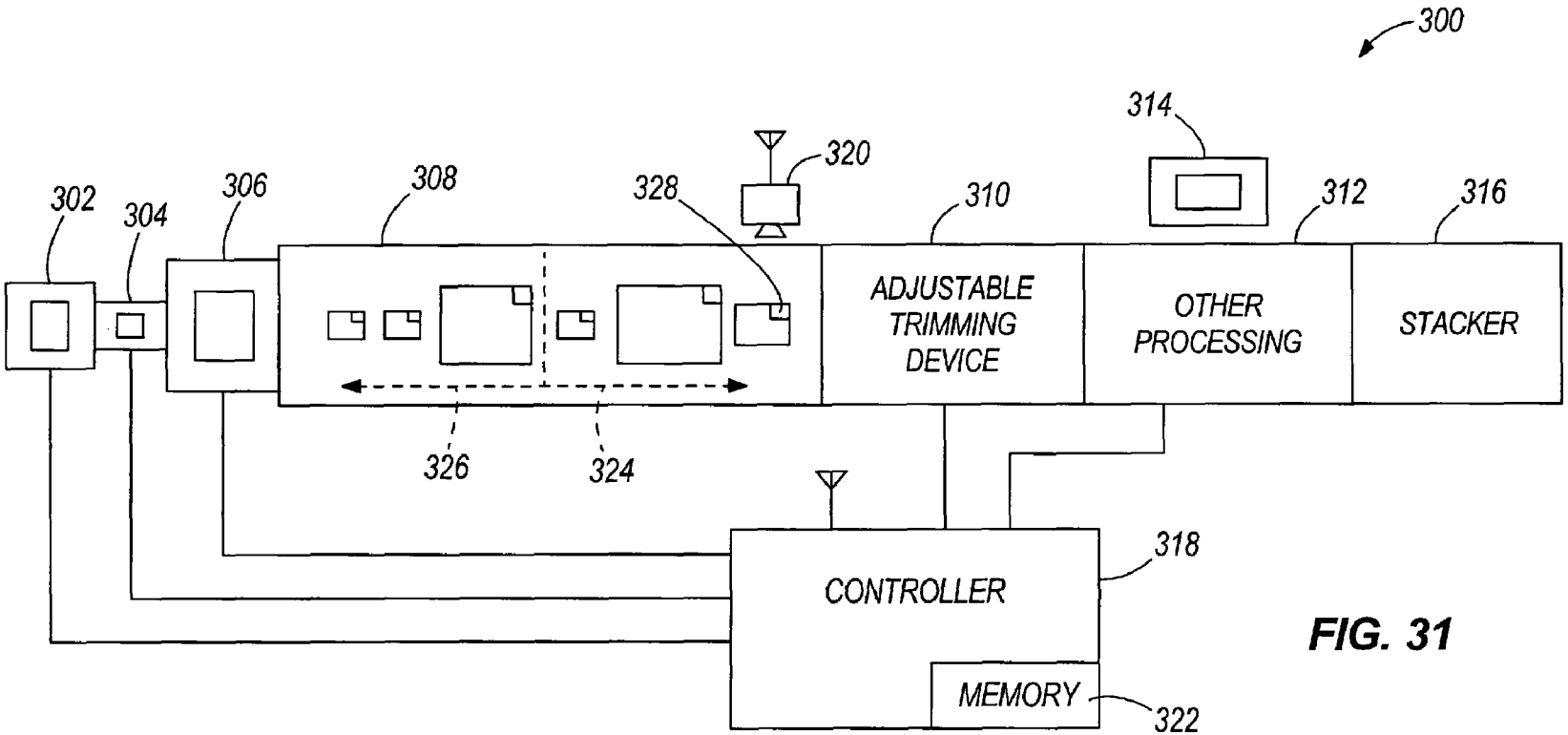
FIG. 31 is a block diagram of a system for trimming printed media of different sizes, according to an exemplary embodiment.

Referring now to FIG. 31, a finishing system 300 comprises a plurality of printed media sources 302, 304, 306, a conveyor 308, an adjustable trimming device 310, one or more other processing devices 312, a source 314 for devices 312, and a stacker 316. System 300 further comprises a controller 318 and a sensor 320.

According to one exemplary embodiment, system 300 is configured to trim a plurality of printed media of different sizes, which can be part of a co-mailing method or other method to bundle printed media to improve postage expense. Co-mailing may collate different printed media titles into a single mailstream to achieve finer presort levels and to build pallets of printed media that qualify for deeper delivery into the postal system based on postal class (e.g., which may range from carrier route rate to 5 digit zip code rate to 3 digit zip code rate, or other ranges of geographical or postal rate distinctions). The result may be lower per-piece postage rates. Co-mailing may comprise multi-mailing (e.g., collating a plurality of different titles or versions of printed media from a one or more publishers for shipping to a postal or delivery service), blended mailing (e.g., collating a plurality of different titles or versions of printed media from one or more publishers for shipping to a postal or delivery service), multi-wrap (e.g., collating a plurality of different titles or versions of printed media from one or more publishers, collating various enclosures, including onserts, bound and unbound printed media, on one or more of the various titles or versions of printed media, and wrapping the titles or versions, together with the various enclosures where applicable, for shipping to a postal or delivery service), multi-binding (e.g., binding in-line a plurality of different titles or versions of printed media from one or more publishers for shipping to a postal or delivery service), or other printed media collating methods and/or co-mailing methods. In a illustrative embodiment, at least two differently sized printed media may be assembled and/or bound on the same line. This can be done without having to manually adjust the trimmer, or remove the printed media from the line before trimming, or stop the assembly of the printed media.

Referring again to FIG. 31, printed media sources 302, 304, and 306 (which may be any number of sources) are each configured to provide printed media of a different size (e.g., 8 in.×11 in., 9 in.×11 in., etc.) to conveyor 308. Controller 318 may be configured to select an order or sequence in which different-sized printed media are to be provided to conveyor 308 based on delivery sequence data (e.g., mailing list data), which may be stored in a database in memory 322. Mailing list data may comprise geographic, demographic, postal and/or book information, or any combination of these types of information and other types of information not specifically identified here. Geographic information may comprise address data for each piece of printed media, regional data, state data, country data, language data, or other types of geographical or census data. Demographic data may comprise any data about the recipient or subscriber or class of recipients or subscribers of the printed media including personalization data which may be used by a printing device configured to print personalized content on the printed media during a finishing operation, age data, purchasing history data, income data, race or ethnicity data, religious data, hobby data, or any other data about a person or class of persons. Postal information may comprise any information useful to a postal delivery service or useful in taking advantage of the features offered by a postal delivery service including postal class data, such as first class, second class, third class, standard, flat rate, and priority, postal delivery information or sort information such as carrier route number, zip code (3 or 5 digit zip code data), SCF, or other geographic or postal rate data. Book information may comprise information about the book, title, or printed media being assembled including the title of the printed media, size data representing a size of at least one dimension of the printed media (e.g., a length to be trimmed, a length post-trim, lengths or widths, or locations/coordinates at which to set a knife or blade for trimming, etc.), page count, publisher, version, or any other information about the book, title, or printed media being assembled. The database may be pre-sorted or sorted by controller 318 by any of the various types of information described. In one illustrative embodiment, the mailing list data comprises at least book information, and further comprises at least size data.

Controller 318 may be configured to select the order or sequence based on the postal class data of each database entry. FIG. 31 illustrates a plurality of first different sized printed media associated with a first postal information 324 and a plurality of second different sized printed media associated with a second postal information 326. Alternatively, the media may be separated by demographic, geographic, book, postal information, or any combination thereof. Controller 318 may be configured to intersperse larger pieces of printed media with smaller pieces of printed media in a single in-line process (e.g., without requiring a new setup or make ready process). Advantageously, system 300 may be configured in one exemplary embodiment to trim printed media of various sizes without having to blend in pre-finished books of a different size after trimming, although this may still be done. In another exemplary embodiment system 300 may be configured to trim at least two printed media of different size with the same trimmer in a predetermined order (e.g., demographic, geographic, book, postal, etc.).

Controller 318 may be configured to control adjustable trimming device 310 to trim or cut the printed media at any of a plurality of adjustable locations, as described in the exemplary embodiments herein. Controller 318 electronically controls trimming device 310 by receiving size data representative of at least one dimension of the printed media to be trimmed and sending control signals over a wired or wireless communication wire, bus or network to device 310 to control at least one actuator on device 310. Device 310 may have a dedicated controller configured to communicate with controller 318, or controller 318 may directly control the actuators. Controller 318 may be configured to control trimming device 310 to locate and/or adjust one, two, three or more blades or knives based on the size data, which may be controlled to cut serially or simultaneously.

Controller 318 may receive the size data in any of a plurality of methods. For example, controller 318 may communicate via a wired or wireless communication link with sensor 320. Sensor 320 may be configured to scan or sense information 320, for example code or other readable indicia, tags, electronic or magnetic devices, resonators, etc., that are printed on, applied to, or made a part of at least one of the printed media on conveyor 308. Sensor 320 may transmit the information to controller 318. Controller 318 may then generate or determine the size data based on the information, or based on a look-up table (e.g., the mailing list data or other table of data) stored in memory 322. Alternatively, controller 318 may be configured to generate the size data based on the order or sequence stored in memory 322, and a preprogrammed known distance or time between controller 318 causing the release of the printed media from sources 302, 304, or 306 and arrival of the printed media at trimming device 310. Another alternative embodiment is to have the sensor transmit the size information directly to the trimmer, which will then trim the printed media to size. Other method of controller 318 receiving or generating size data to use to control trimming device 310 are contemplated.

Figure 32:
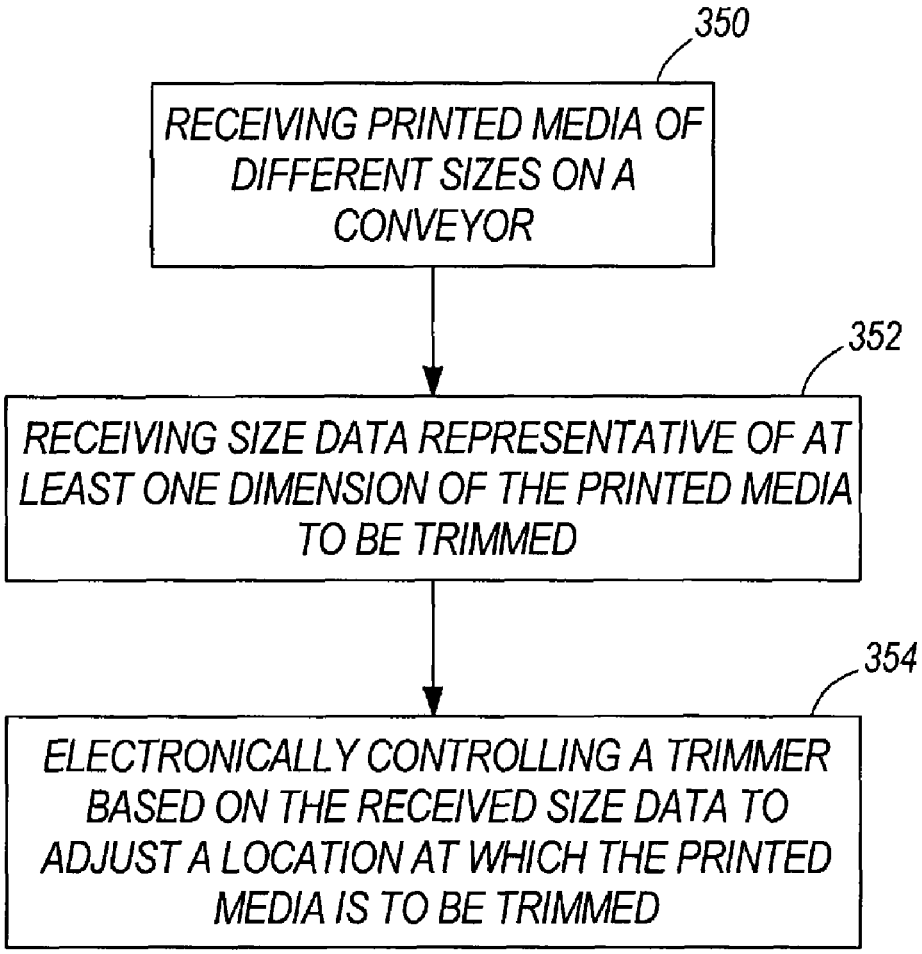
FIG. 32 is a flowchart of a method for trimming printed media of different sizes, according to an exemplary embodiment.

Referring now to FIG. 32, a method of trimming a plurality of printed media of different sizes will be described. At step 350, the method comprises receiving the printed media of different sizes (for example, at least two different sizes, more than two different sizes, no less than two different sizes, etc.) on a conveyor. At step 352, the method comprises receiving size data representative of at least one dimension of the printed media to be trimmed. At step 354, the method comprises electronically controlling a trimmer based on the received size data to adjust a location at which the printed media is to be trimmed.

Figure 33:
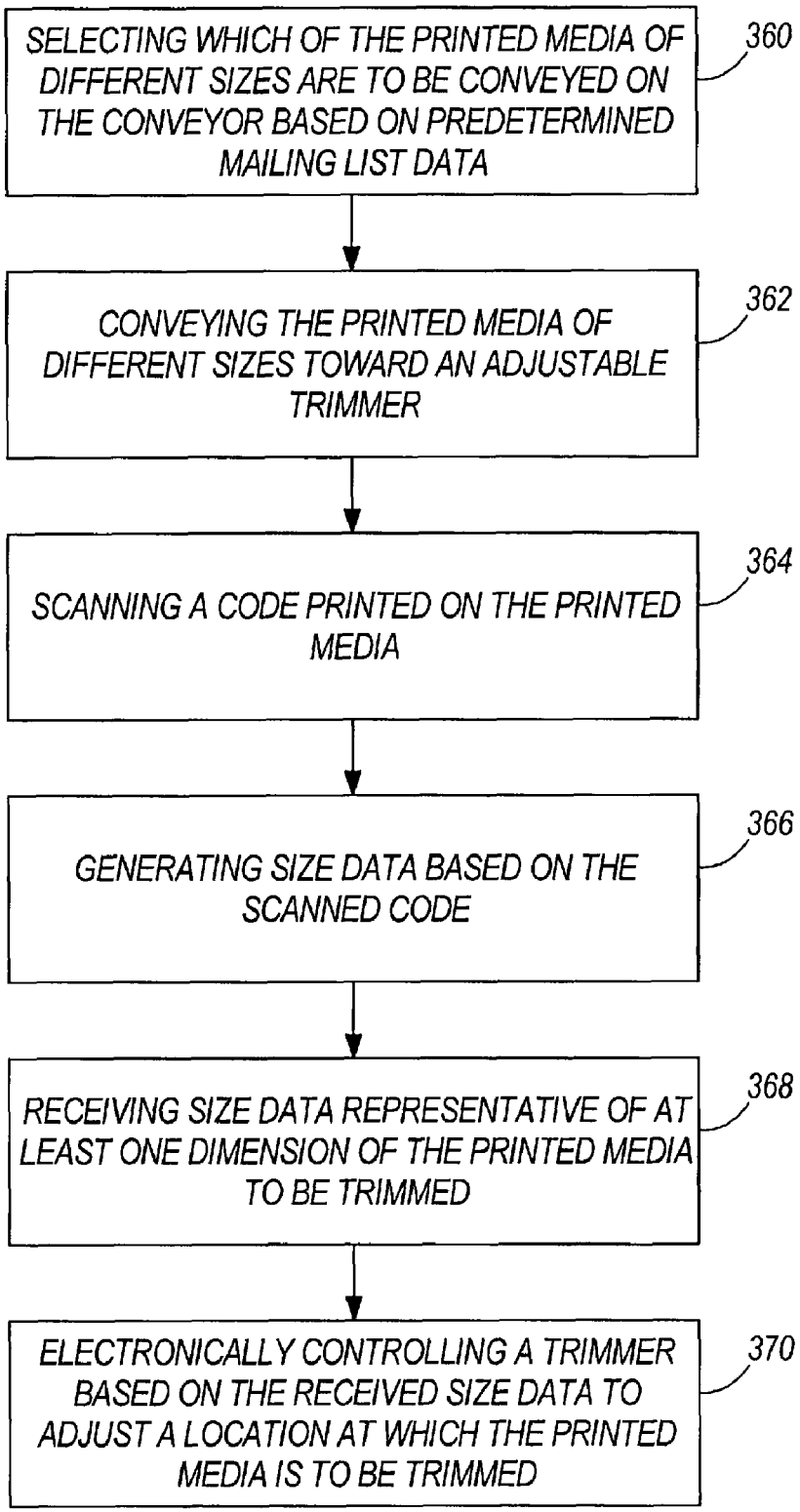
FIG. 33 is a flowchart of a method for trimming printed media of different sizes, according to an exemplary embodiment.

Referring now to FIG. 33, a method of trimming a plurality of printed media of different sizes will be described. At step 360, the method comprises selecting which of the printed media of different sizes (e.g., at least two pieces of printed media of different size) are to be conveyed on the conveyor. This selection may be based on predetermined mailing list data. At step 362, the method comprises conveying the printed media of different sizes toward an adjustable trimmer. At step 364, the method may further comprise scanning or acquiring information associated with the printed media. In one embodiment, this can be accomplished by scanning a code printed on the printed media. At step 366, the method comprises generating size data based on the information (or in the embodiment described, code). At step 368, the method comprises receiving the size data representative of at least one dimension of the printed media to be trimmed. At step 370, the method comprises controlling a trimmer based on the received size data to adjust a location at which the printed media is to be trimmed. In one embodiment, the trimmer may be electronically controlled.

According to one exemplary embodiment, controller 318 may be configured based on arranged data stored in memory 322 to assemble, select, or provide at least two printed media of different size in a predetermined order (e.g., demographic, regional, zip code, etc.) and to control trimming device 310 to trim each of the printed media to its proper size.

According to another exemplary embodiment, a method comprises creating a single mailstream of at least two differently sized pieces of printed media, and, optionally, for delivery in a predetermined order, by (a) combining mailing lists for each of at least two differently sized printed media, (b) adding size data to the mail lists, either before or after combination of the at least two different mailing lists, (c) assembling the printed media, and optionally, assembling the printed media in a predetermined order (e.g., geographic, postal, demographic, book, etc.), (d) conveying to an adjustable trimmer the size data about each printed media, (e) selectively adjusting the trimmer based upon the size data received, and (f) optionally, bundling the printed media in the predetermined order. For example, coded data may be used to assemble the at least two different sized books of a different title, version, or postal class on a finishing line in a zip-code order (e.g., 1 8×11, 1 9×11, 4 8×11, 3 9×11) and the controller may be configured to track each printed media and convey the code to the trimmer so the trimmer automatically adjusts to cut the printed media to the proper size.

Other processing devices 312 may comprise wrappers (e.g., paper, poly, etc.), wrapped product feeders, envelope feeders, accumulators, buffers, mail tables, shuttle hoppers, ink jet or printing machines (which may be configured for personalized printing based on a database of personalized data), etc., configured to apply further processes to printed media. Other devices 312 may be disposed anywhere within system 300, before or after trimming device 310, and may further include stitchers, binders, etc. Thus, system 300 may be integrated with one or more components disclosed in U.S. Pat. Nos. 6,167,326, 6,347,260, 7,096,088, 7,102,095, and/or U.S. Patent Application No. 2006/0071407, all of which are incorporated by reference herein. Stacker 316 may be configured to stack finished printed media for placement on pallets for shipping.

According to one exemplary embodiment, a method of trimming printed media having a first dimension, a first edge parallel to the direction of the first dimension, and a second dimension substantially perpendicular to the first dimension comprises: conveying printed media along a path; abutting the first edge of a first piece of printed media against a stop; trimming a first margin from the second dimension of the first piece of printed media with a blade defining a first distance between the stop and the blade; adjusting one of the stop and the blade in a direction substantially parallel with the path to define a second distance between the stop and the blade after adjustment; abutting the first edge of a second piece of printed media against the stop after adjustment; and trimming a second margin from the second dimension of the second piece of printed media with the blade after adjustment. The method may further comprise: (1) adjusting the stop in a direction substantially parallel with the path when adjusting one of the stop and the blade; and/or (2) displacing the stop from the path of the printed media before abutting the first edge of the second piece of printed media against the stop; and/or (3) conveying the printed media, lying flat, along the path when conveying the printed media; and/or (4) controllably adjusting the one of the stop and the blade when adjusting one of the stop and the blade; and/or (5) measuring the second dimension of the first piece of printed media after the first margin is trimmed from the second dimension of the first piece of printed media.

According to another exemplary embodiment, a method of trimming printed media having a first dimension and a second dimension substantially perpendicular to the first dimension comprises conveying printed media, optionally lying flat, along a path; trimming a margin from the first dimension of the printed media with a blade; and adjusting the blade along the first dimension of the printed media. The method may further comprise: (1) trimming a first margin from the first dimension of the printed media with a first blade when trimming a margin from the first dimension of the printed media with a blade, and/or (2) wherein the method further comprises trimming a second margin from the first dimension of the printed media with a second blade, and/or (3) adjusting the distance between the second blade and the first blade along the first dimension of the printed media when adjusting the blade; and/or (4) controllably adjusting the distance between the second blade and the first blade along the first dimension of the printed media when adjusting the distance between the second blade and the first blade; and/or (5) biasing an edge of the printed media opposite an edge from which the margin was trimmed against a guide surface.

According to another exemplary embodiment, an adjustable trimming assembly comprises a conveyor adapted to transport printed media, optionally lying flat, along a path, the printed media having a first dimension, a first edge parallel to the direction of the first dimension, and a second dimension substantially perpendicular to the first dimension; a stop movable to abut the first edge of the printed media moving along the path; a blade adapted to trim a margin from one of the first and second dimensions of the printed media; an actuator coupled to one of the blade and the stop to adjust the distance between the blade and the stop in at least one of a first direction substantially parallel with the first dimension of the printed media, and a second direction substantially parallel with the second dimension of the printed media; and a controller operably coupled to the actuator for controlling adjustment of the distance between the blade and the stop. The assembly may further comprise: (1) the blade is adapted to trim the margin from the second dimension of the printed media, and/or (2) the actuator is coupled to the stop to adjust the distance between the stop and the blade in the second direction, the second direction being substantially parallel with the path; and/or (3) the stop is movable between a first position to abut the first edge of the printed media moving along the path, and a second position displaced from the path of the printed media; and/or (4) the actuator includes a rack coupled to the stop, a pinion configured to drivably engage the rack, and a motor operably coupled to the pinion to drive the pinion; and/or (5) the actuator further comprises a shaft coupling the motor and the pinion; and/or (6) the shaft comprises a flexible shaft; and/or (7) the actuator includes a linear motor operably coupled to the stop to adjust the stop; and/or (8) the actuator comprises a cylinder having an extensible rod, and wherein the cylinder is operably coupled to the stop to adjust the stop; and/or (8) the cylinder comprises a pneumatic cylinder; and/or (9) the actuator includes at least two pulleys, a belt having the stop coupled thereto, the belt extending between the at least two pulleys, and a motor operably coupled to one of the at least two pulleys to drive the one of the at least two pulleys; and/or (10) the actuator further comprises a shaft coupling the motor and the one of the at least two pulleys, wherein the shaft may comprises a flexible shaft; and/or (11) the blade is adapted to trim the margin from the first dimension of the printed media, and wherein the actuator is coupled to the blade to adjust the distance between the stop and the blade in the first direction, the first direction being substantially transverse to the path; and/or (12) the actuator comprises a linear motor operably coupled to the blade to adjust the blade.

According to another exemplary embodiment, an adjustable trimming assembly comprises a first conveyor adapted to transport printed media along a path in a downstream direction, the printed media having a first dimension oriented perpendicular to the path and a second dimension substantially perpendicular to the first dimension; a blade adapted to cut a margin from the second dimension of the printed media, the blade positioned downstream of the first conveyor; a second conveyor adapted to receive printed media from the first conveyor along the path, the second conveyor positioned downstream of the blade; an actuator coupled to the second conveyor; and a controller operably coupled to the actuator to adjust the distance traveled by the printed media along the path before the margin is cut from the second dimension of the printed media. The adjustable trimming assembly may further comprise: (1) the printed media has a first edge parallel to the direction of the first dimension, and wherein the adjustable trimming assembly further comprises a sensor configured to detect the first edge of the printed media before the blade cuts the margin from the second dimension of the printed media; and/or (2) the sensor is operably coupled to the controller; and/or (3) the actuator comprises a servo motor.

According to another exemplary embodiment, a method of trimming printed media having a first dimension, a first edge parallel to the direction of the first dimension, and a second dimension substantially perpendicular to the first dimension comprises conveying printed media along a path; detecting the first edge of a first piece of printed media; positioning the first edge of the first piece of printed media along the path a first distance from a blade; trimming a first margin from the second dimension of the first piece of printed media with the blade; detecting the first edge of a second piece of printed media after the first piece of printed media is trimmed; positioning the first edge of the second piece of printed media along the path a second distance from the blade after detecting the first edge of the second piece of printed media; and trimming a second margin from the second dimension of the second piece of printed media with the blade after the first edge of the second piece of printed media is positioned the second distance from the blade. The method may further comprise: (1) conveying the printed media, lying flat, along the path when conveying the printed media.

According to another exemplary embodiment, products having different trim sizes can be generated and conveyed in a single "in-line" process and ultimately be co-mailed together. For example, co-mailing can be achieved without having to blend in pre-finished books of a different size after trimming. This can be done without having to stop or manually adjust the trimmer between products of different size or diverting one or more streams to a different trimmer.

According to another exemplary embodiment, the sequence for trimming at least two products of different size with same trimmer can be pre-determined and, in some examples, the pre-determined order can be based upon demographic, geographic, postal, or book information. This order can be determined by the system as the product is delivered to the trimmer.

According to another exemplary embodiment, the system can identify by some information (e.g., identifier, taggent, code, etc.) that can be read visually, electronically, or by any other means, what size a piece should be (in an in-line setting) and convey that information to the trimmer which adjusts to trim the piece to its coded size. For example, using an "eye" to read a code on the book that tells the trimmer the location of the book and what size to cut the book. Another option is to use a vision system that can tell what size the product is supposed to be.

According to another exemplary embodiment, a method for arranging data comprises assembling at least two printed products of different size in a pre-determined order (e.g., based upon demographic, geographic, postal, or book information), including at least trim size in such data, and trimming each of the pieces to its proper size.

According to another exemplary embodiment, a method for creating a single mailstream of at least two differently sized pieces for delivery in a pre-determined order comprises (a) combining mail lists, (b) adding size information to the mail lists, (c) assembling the printed pieces in a pre-determined order (e.g., zip-code order), (d) conveying to a trimmer the size information about each produced book, (e) selectively adjusting the trimmer based upon the size information received, (f) bundling the printed pieces in the pre-determined order. For example, the coded information could be used to assemble the two different sized books of a different title or mailing class on the finishing line in a zip-code order (e.g., 1 8×11, 1 9×11, 4 8×11, 3 9×11), and the system would track each book and convey this information to the trimmer so the trimmer automatically adjusts to cut the book to the proper size.

According to another exemplary embodiment, a variable trimmer may be used in combination with a printing line. The printing line may feed printed materials directly into a binding process. For example, a digital printer or pre-printed roll or sheets may be used or configured to provide printed materials (e.g., sheets or signatures) to a binding line, such as a perfect binder or saddle stitcher. The printed materials optionally may be provided having a different trim size from one another. The variable trimmer may also be used in other lines where, for example, different titles are printed, assembled, and finished in the same line. In other words, variable trimming is accomplished directly off of the press lines.

According to another exemplary embodiment, multiple streams of different product may be trimmed by the same variable trimmer. In such an embodiment, a single trimmer may be configured and/or used to perform the variable trimming, without having to divert printed media of different trim size or thickness to a different trimmer. In such embodiments, the trimmer may accept a single stream of untrimmed printed materials (some of which may be of different sizes) and output a single stream of printed products having varying trim sizes. In yet another embodiment, the trimmer may accept multiple streams of untrimmed printed materials, each stream having a plurality of printed materials to be trimmed in the same or different trim sizes, and output a single merged stream of printed products having varying or custom trim sizes, or multiple streams of printed products, with each stream having a single trim size or a plurality of trim sizes.

According to another exemplary embodiment, variable trim can also be used in the packaging industry, the cardboard industry, the copier industry, the paperboard industry, and the paper manufacturing industry.

In another exemplary embodiment, catalog or other book size may be customized in-line based upon coded information.

Figure 34:
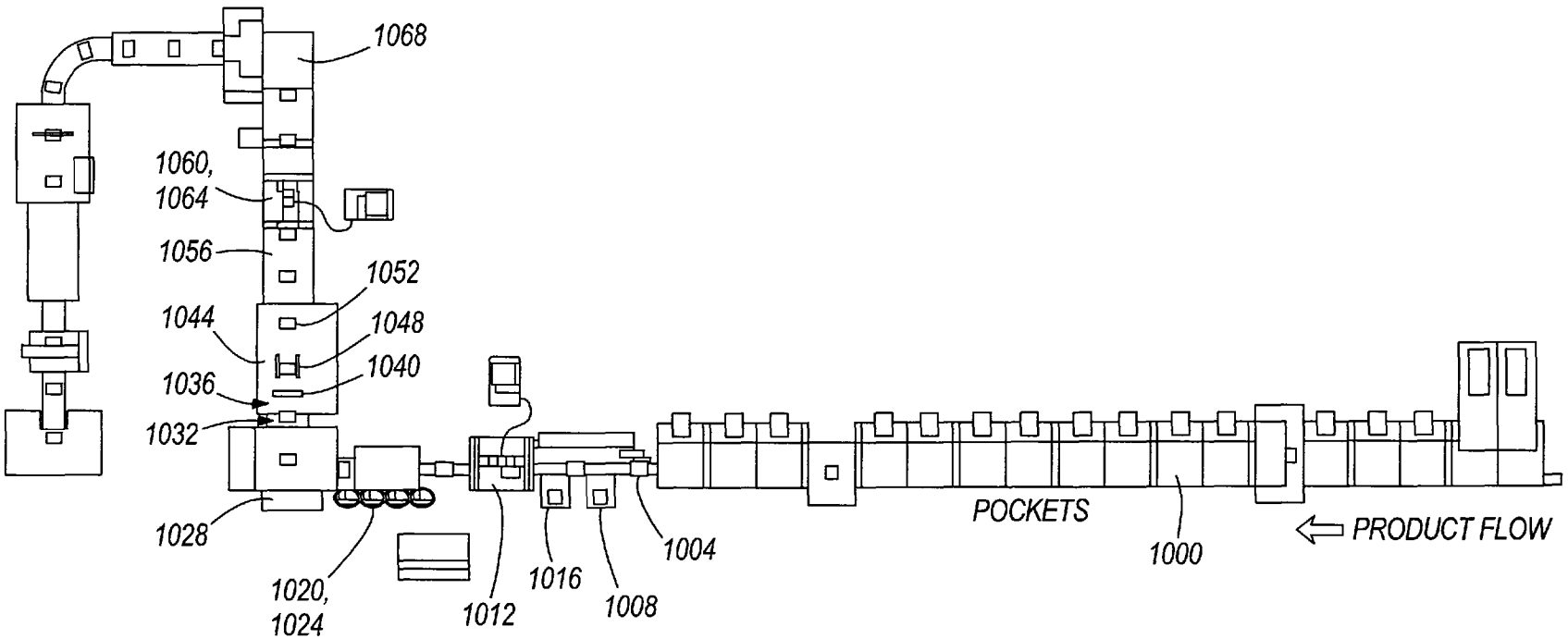
FIG. 34 is a schematic illustrating the flow of printed media through a saddle-stitch binding line incorporating any of the adjustable trimming assemblies of FIGS. 12-27.

FIG. 34 illustrates the flow of printed media through a saddle-stitch binding line incorporating any of the adjustable trimming assemblies 46, 74, 182, 214, 400, 500 of FIGS. 1*a*-27. The components, assemblies, or sub-assemblies identified in FIG. 34 and referenced in Table 1 may require modification to accommodate printed products 26 having custom trim sizes:

TABLE 1

| | Saddle Stitching-Area | Description |
|---|---|---|
| 1000 | Pocket-register stops | Adjust register stop according to custom trim size of printed products. |
| 1004 | Caliper-thickness products. | Adjust caliper to measure the different thicknesses of the custom trim size printed |
| 1008 | Long skew detect | Modify quality check to allow for different formats of custom trim size printed products. |
| 1012 | Center plow/inkjet | Modify to allow for varying opening positions of custom trim size printed products. |
| 1016 | Cardfeeder | Modify to allow variable position based upon custom trim size of printed products. |
| 1020 | Stitch placement | Modify to adjust stitch position based upon custom trim size of printed products. |
| 1024 | Stitch compression/clinchers | Adjust clinchers based upon custom trim size of printed products. |
| 1028 | Pull-up wheels | Modify to allow for greater variation and different formats of custom trim size printed products. |
| 1032 | Infeed side guides/rails | Modify to vary with the format and custom trim size of printed products. |
| 1036 | Infeed pusher (GOSS) | Automate to allow for variable lap by format and custom trim size of printed products. |
| 1040 | Face trim | As described herein. |
| 1044 | Side jogger/tamping device | As described herein. |
| 1048 | Head/food Trim | As described herein. |
| 1052 | Quality monitor (short book) | Modify to allow for quality monitoring of different formats and custom trim sizes of printed products. |

TABLE 1-continued

| | Saddle Stitching-Area | Description |
|---|---|---|
| 1056 | Mailtable rails | Modify to adjust with the type and custom trim size of printed products. |
| 1060 | Inkjet placement | Automate to allow for varying position by format and/or custom trim size of the printed products. |
| 1064 | Inkjet height | Automate to adjust inkjet head according to format and/or custom trim size of the printed products. |
| 1068 | Stacker guides | Modify to improve stack quality by adjusting the guides according to format and/or custom trim size of the printed products. |

Figure 35:
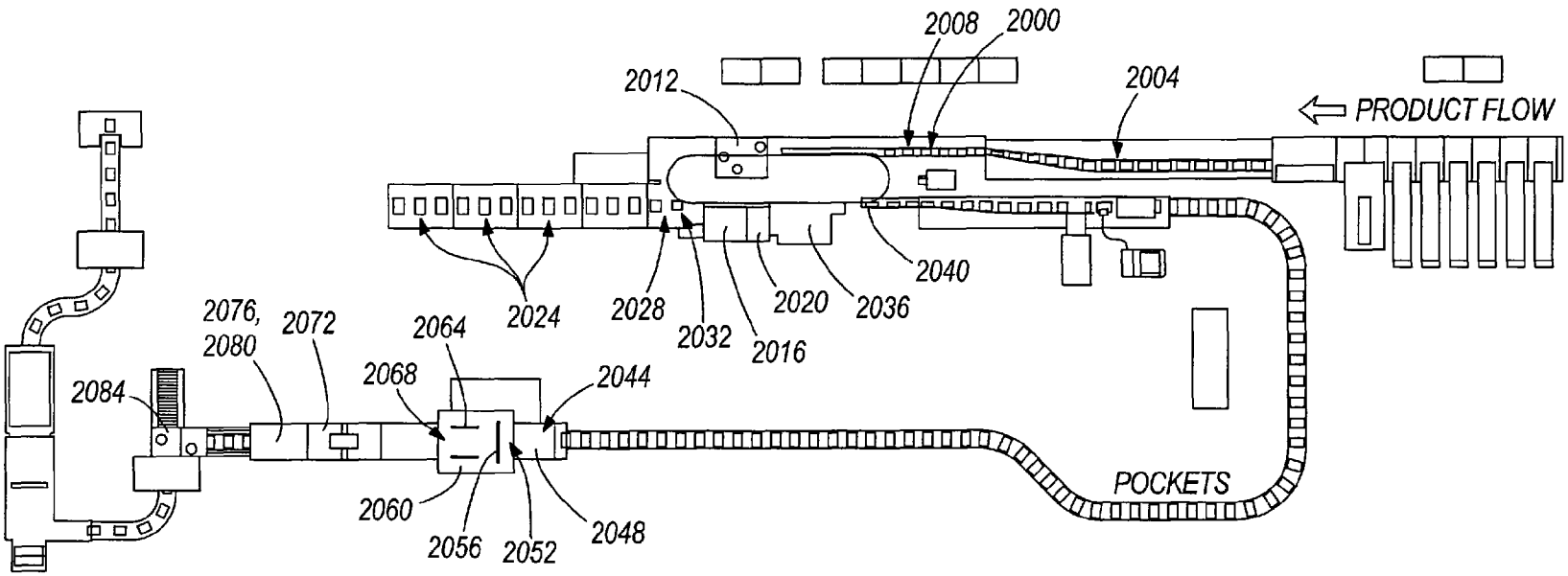
FIG. 35 is a schematic illustrating the flow of printed media through a perfect-bound binding line incorporating any of the adjustable trimming assemblies of FIGS. 12-27.

FIG. 35 illustrates the flow of printed media through a perfect-bound binding line incorporating any of the adjustable trimming assemblies 46, 74, 182, 214, 400, 500 of FIGS. 1*a*-27. The components, assemblies, or sub-assemblies identified in FIG. 35 and referenced in Table 2 may require modification to accommodate printed products 26 having custom trim sizes:

TABLE 2

| | Perfect Binding-Area | Description |
|---|---|---|
| 2000 | Infeed guides | Modify to vary with the format and custom trim size of printed products. |
| 2004 | HUT | Variable lug to adjust for varying head/foot product requirements. |
| 2008 | Infeed belts | Variable timing to advance/retard book block to specific clamp to insure smooth/consistent transfer to carrousel clamps and changes in product. |
| 2012 | Saw/rougher | Variable integration, (more or fewer units) based upon requirements of custom trim size printed products (raise/lower as needed). |
| 2016 | Glue pot | Engage/disengage multiple glue wheels as needed based on format and custom trim size of printed products. |
| 2020 | Cover applier | Advance/retard cover to book block to ensure consistent alignment with variable book size. |
| 2024 | Cover feeders | Modify to allow selective feeding of variable size covers. |
| 2028 | Cover scoring | Vary scoring location and/or inclusion based on format and custom trim size of printed products. |
| 2032 | Cover raceway | Lateral variable shifting (center) of cover to align with book block in clamp. |
| 2036 | Cover breaker | Vary breaker settings to handle greater variable thickness. |
| 2040 | Quality monitor | Variable sensors to handle changing head/foot and spine/face dimensions as they vary by format and custom trim size of printed products |
| 2044 | Trimmer infeed belts | Books transition from face-registered on cooling conveyors to spine-registered. Create a variable infeed to phase shift as need by format and custom trim size of printed products to deliver a consistent spine reference to trimmer. |
| 2048 | Infeed side guides/rails | Modify to vary with the format and custom trim size of printed products. |
| 2052 | Infeed pusher (GOSS) | Automate to allow for variable lap by format and custom trim size of printed products. |
| 2056 | Face trim | As described herein. |
| 2060 | Side jogger | As described herein. |
| 2064 | Head/food Trim | As described herein. |
| 2068 | Quality monitor (short book) | Modify to allow for quality monitoring of different formats and custom trim sizes of printed products. |
| 2072 | Mailtable rails | Modify to adjust with the type and custom trim size of printed products. |
| 2076 | Inkjet placement | Automate to allow for varying position by format and/or custom trim size of the printed products. |
| 2080 | Inkjet height | Automate to adjust inkjet head according to format and/or custom trim size of the printed products. |
| 2084 | Stacker guides | Modify to improve stack quality by adjusting the guides according to format and/or custom trim size of the printed products. |

The higher level controller 67 may interface with each of the components listed above in the binding line (e.g., a saddle-stitch binding line or a perfect-bound binding line) to adjust the components based upon the custom trim sizes of the printed products moving through the lines.

While the detailed drawings, specific examples and particular formulations given describe preferred and exemplary embodiments, they serve the purpose of illustration only. The embodiments disclosed are not limited to the specific forms shown. For example, the methods may be performed in any of a variety of sequence of steps. The hardware and software configurations shown and described may differ depending on the chosen performance characteristics and physical characteristics of the computing devices. For example, the type of computing device, communications bus, or processor used may differ. The systems and methods depicted and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. A method of trimming printed media, comprising:

creating predetermined delivery sequence data by combining geographical or postal mailing list data for a first printed media and a second printed media;

accessing the predetermined delivery sequence data;

selecting printed media to be positioned on a conveyor based on the predetermined delivery sequence data, wherein the selected printed media comprises the first printed media having an associated first size data, and the second printed media having an associated second size data, and wherein each of the first and second printed media comprises a first dimension, a first edge parallel to the direction of the first dimension, and a second dimension substantially perpendicular to the first dimension;

positioning the first and second printed media successively on the conveyor in a single production run;

receiving the first size data representative of a first trim dimension of the first printed media to be trimmed;

using an electronic controller to adjust a location of a stop based on the received first size data;

positioning the first edge of the first printed media adjacent the stop;

trimming a first margin from the second dimension of the first printed media with a trimming device defining a first distance between the stop and the trimming device;

receiving the second size data representative of a second trim dimension of the second printed media to be trimmed, wherein the first trim dimension is different from the second trim dimension;

using the controller to adjust the stop to define a second distance between the stop and the trimming device after adjustment;

positioning the first edge of the second printed media adjacent the stop after adjustment; and producing in the single production run the first printed media having the first trim dimension and the second printed media having the second trim dimension.

2. The method of claim 1, further comprising:

acquiring information associated with the first and second printed media; and generating the first size data and the second size data based on the information.

3. The method of claim 1, further comprising:

trimming a second margin from the second dimension of the second printed media with the trimming device after adjustment.

4. The method of claim 1, wherein selecting the printed media includes selecting printed media of different titles.

5. The method of claim 1, wherein selecting the printed media includes selecting printed media of different thicknesses.

6. A method of trimming printed media, comprising:

creating predetermined delivery sequence data by combining geographical or postal mailing list data for a first printed media and a second printed media;

accessing the predetermined delivery sequence data;

selecting printed media to be positioned on a conveyor based on the predetermined delivery sequence data, wherein the selected printed media comprises the first printed media having an associated first size data, and the second printed media having an associated second size data;

positioning the first and second printed media successively on the conveyor in a single production run in which the first and second printed media are transported by the conveyor at the same time;

receiving the first size data representative of a first trim dimension of the first printed media to be trimmed and the second size data representative of a second trim dimension of the second printed media to be trimmed, wherein the first trim dimension is different from the second trim dimension;

electronically controlling the position of a stop for the first printed media based on the received first size data to adjust a location at which the first printed media is to be trimmed;

electronically controlling an adjustment of the position of the stop for the second printed media based on the received second size data to adjust a location at which the second printed media is to be trimmed; and producing in the single production run the first printed media having the first trim dimension and the second printed media having the second trim dimension.

7. The method of claim 6, further comprising:

acquiring information associated with the first and second printed media; and generating the first size data and the second size data based on the information.

8. The method of claim 6, wherein each of the first and second printed media comprises a first dimension, a first edge parallel to the direction of the first dimension, and a second dimension substantially perpendicular to the first dimension, and wherein the method further comprises:

conveying the first printed media along a path;

positioning the first edge of the first printed media adjacent the stop; and trimming a first margin from the second dimension of the first printed media with a trimming device defining a first distance between the stop and the trimming device.

9. The method of claim 8, further comprising:

adjusting the stop in a direction substantially parallel with the path to define a second distance between the stop and the trimming device after adjustment;

conveying the second printed media along the path;

positioning the first edge of the second printed media adjacent the stop after adjustment; and trimming a second margin from the second dimension of the second printed media with the trimming device after adjustment.

10. The method of claim 6, wherein each of the first and second printed media comprises a first dimension, a first edge parallel to the direction of the first dimension, and a second dimension substantially perpendicular to the first dimension, and wherein the method further comprises:

conveying the first printed media along a path;

positioning the first edge of the first printed media along the path a first distance from a trimming device using the stop;

trimming a first margin from the second dimension of the first printed media with the trimming device;

conveying the second printed media along the path;

positioning the first edge of the second printed media along the path a second distance from the trimming device using the stop; and trimming a second margin from the second dimension of the second printed media with the trimming device after the first edge of the second printed media is positioned the second distance from the trimming device.

* * * * *